US010710766B2

(12) United States Patent
Tashiro et al.

(10) Patent No.: US 10,710,766 B2
(45) Date of Patent: Jul. 14, 2020

(54) CAN LID AND BEVERAGE CAN

(71) Applicant: SHOWA ALUMINUM CAN CORPORATION, Shinagawa-ku, Tokyo (JP)

(72) Inventors: Yasushi Tashiro, Tokyo (JP); Hiroyuki Okada, Tokyo (JP); Shinichi Ojima, Tokyo (JP); Kazunori Ikeda, Tokyo (JP); Tetsuo Kashiwazaki, Tokyo (JP); Asumi Suwa, Tokyo (JP)

(73) Assignee: SHOWA ALUMINUM CAN CORPORATION, Tokyo (JP)

( * ) Notice: Subject to any disclaimer, the term of this patent is extended or adjusted under 35 U.S.C. 154(b) by 726 days.

(21) Appl. No.: 14/897,384

(22) PCT Filed: Jun. 13, 2014

(86) PCT No.: PCT/JP2014/065798
§ 371 (c)(1),
(2) Date: Dec. 10, 2015

(87) PCT Pub. No.: WO2014/200098
PCT Pub. Date: Dec. 18, 2014

(65) Prior Publication Data

US 2016/0130031 A1 May 12, 2016

(30) Foreign Application Priority Data

Jun. 13, 2013 (JP) ..... 2013-125055
Nov. 27, 2013 (JP) ..... 2013-245407
(Continued)

(51) Int. Cl.
*B65D 17/00* (2006.01)
*B65D 1/20* (2006.01)
(Continued)

(52) U.S. Cl.
CPC ..... *B65D 1/20* (2013.01); *B65D 7/04* (2013.01); *B65D 17/02* (2013.01); *B65D 17/404* (2018.01);
(Continued)

(58) Field of Classification Search
CPC .... B65D 17/165; B65D 17/02; B65D 17/404; B65D 17/4012; B65D 17/24; B65D 1/165;
(Continued)

(56) References Cited

U.S. PATENT DOCUMENTS 3,894,651 A 7/1975 Hannon
3,900,128 A 8/1975 Brown
(Continued)

FOREIGN PATENT DOCUMENTS

CA 1034520 A 7/1978
CN 201347226 Y 11/2009
(Continued)

OTHER PUBLICATIONS

International Search Report for PCT/JP2014/065798 dated Aug. 5, 2014 [PCT/ISA/210].
(Continued)

*Primary Examiner* — Robert Poon
(74) *Attorney, Agent, or Firm* — Sughrue Mion, PLLC

(57) ABSTRACT

A first score line (430) is curled inward at one end section (431) and the other end section (432) of the first score line (430) so as to go into a region enclosed by the first score line (430), and the first score line (430) approaches a center line (CL) of a tab as going to the trailing ends thereof. In addition, a curvature at which the first scored line (430) is brought closer to the other end section (432) side is applied to the one end section (431) of the first score line (430), and a curvature at which the first score line (430) is brought
(Continued)

closer to the one end section (431) side is also applied to the other end section (432) of the first score line (430).

20 Claims, 38 Drawing Sheets

(30) Foreign Application Priority Data

Nov. 27, 2013 (JP) ..... 2013-245408
Jun. 12, 2014 (JP) ..... 2014-121887

(51) Int. Cl.
*B65D 17/28* (2006.01)
*B65D 8/00* (2006.01)

(52) U.S. Cl.
CPC .. *B65D 17/4012* (2018.01); *B65D 2517/0014* (2013.01)

(58) Field of Classification Search
CPC .... B65D 1/20; B65D 7/04; B65D 2517/0014; B65D 2517/0011
USPC ..... 220/269–270, 266, 272–273
See application file for complete search history.

(56) References Cited

U.S. PATENT DOCUMENTS

| | | | | |
|---|---|---|---|---|
| 3,967,752 | A | 7/1976 | Cudzik | |
| 5,219,257 | A | 6/1993 | Koch | |
| 6,024,239 | A | 2/2000 | Turner et al. | |
| 6,164,480 | A * | 12/2000 | Heinicke | B65D 17/4012 220/269 |
| 6,354,453 | B1 | 3/2002 | Chasteen | |
| 8,783,496 | B2 * | 7/2014 | Neiner | B65D 51/1677 220/272 |
| 8,870,012 | B2 * | 10/2014 | Stengel, Jr. | B65D 17/165 220/269 |
| 2008/0067171 | A1 * | 3/2008 | Heinicke | B65D 17/4011 220/269 |
| 2008/0099480 | A1 * | 5/2008 | Chang | B65D 17/4012 220/269 |
| 2011/0163096 | A1 | 7/2011 | Wichelhaus | |
| 2013/0037542 | A1 | 2/2013 | Crothers | |

FOREIGN PATENT DOCUMENTS

| | | | |
|---|---|---|---|
| CN | 102123917 | A | 7/2011 |
| CN | 102951343 | A | 3/2013 |
| EP | 0993408 | A | 4/2000 |
| JP | 51-082188 | A | 7/1976 |
| JP | 55-050108 | Y2 | 11/1980 |
| JP | 61-008525 | U | 1/1986 |
| JP | 63-028633 | U | 2/1988 |
| JP | 05-178345 | A | 7/1993 |
| JP | 06-219448 | A | 8/1994 |
| JP | 07-132937 | A | 5/1995 |
| JP | 09-039962 | A | 2/1997 |
| JP | 11-321860 | A | 11/1999 |
| JP | 2003-095264 | A | 4/2003 |
| JP | 2003-517974 | A | 6/2003 |
| JP | 2004-035063 | A | 2/2004 |
| JP | 4187144 | B2 | 11/2008 |
| JP | 2009-067407 | A | 4/2009 |
| JP | 2012-166826 | A | 9/2012 |
| WO | 2012/091430 | A2 | 7/2012 |

OTHER PUBLICATIONS

Extended European Search Report dated Jul. 2, 2018 for corresponding European Patent Application No. 18166343.6.

* cited by examiner

CROSS SECTION OF LINE VII2B-VII2B

CROSS SECTION OF LINE VII3B-VII3B

CAN LID AND BEVERAGE CAN

CROSS REFERENCE TO RELATED APPLICATIONS

This application is a National Stage of International Application No. PCT/JP2014/065798 filed Jun. 13, 2014, claiming priority based on Japanese Patent Application Nos. 2013-125055 filed Jun. 13, 2013, 2013-245407 filed Nov. 27, 2013, 2013-245408 filed Nov. 27, 2013 and 2014-121887 filed Jun. 12, 2014 the contents of all of which are incorporated herein by reference in their entirety.

TECHNICAL FIELD

The present invention relates to a can lid and a beverage can.

RELATED ART

A beverage can in which breakage of a panel is caused at a score line by a press of part of the panel by a tab to thereby form an opening that functions as a place a person drinks from is suggested (for example, refer to Patent Document 1).

CITATION LIST

Patent Literature

Patent Document 1: Japanese Patent Application Laid-Open Publication No. 51-82188

SUMMARY OF INVENTION

Technical Problem

In general, in a can lid used for a beverage can, score lines are formed on the surface of a panel, and when an opening is to be formed on the can lid, breakage of the panel proceeds along the score lines. Incidentally, breakage of the panel becomes less likely to proceed in some cases depending on a shape of the score lines; in this case, there is a possibility of reducing workability in operations performed by a user when the opening is formed.

Moreover, in general, in a can lid used for a beverage can, an opening is formed by tab operation by a user, and accordingly, it becomes possible to drink a beverage inside the beverage can. By the way, various external forces act on the can lid, and thereby, there is a possibility that the opening is formed by the external forces even though a user does not perform the tab operation.

Moreover, in general, in a can lid used for a beverage can, score lines are formed on the surface of a panel, and when an opening is to be formed on the can lid, first, a piece-like portion is formed by breakage of the panel along the score lines, and further, the piece-like portion is bent inward of the beverage can. Incidentally, if the bending of the piece-like portion is hardly performed, there occurs a possibility of reducing workability in operations performed by a user when the opening is formed.

Moreover, in general, a tab is attached to a can lid used for a beverage can, and accordingly, the opening serving as a place a person drinks from is formed by pulling up the tab by an operator. Here, when the tab is pulled up, the tab is brought into a state of projecting from the surface of the can lid; therefore, usually, it is necessary to perform operation of laying the tab down after the pulling up operation of the tab.

An object of the present invention is to successfully perform breakage of a panel along a score line.

Moreover, another object of the present invention is to suppress formation of an opening on a can lid despite that operation of a tab by a user is not carried out.

Moreover, still another object of the present invention is to cause a piece-like portion generated by breakage of the panel along the score line to be bent with ease.

Moreover, still another object of the present invention is to simplify the operation of the tab required to form the opening on the can lid.

Solution to Problem

A can lid to which the present invention is applied includes: a panel attached to a can barrel; a first score line formed on the panel, formed into a U-shape, including one end section and the other end section, and facilitating breakage of the panel; a second score line formed on the panel, connected to the first score line, and formed to head toward an inside of a region enclosed by the first score line from a connecting section with the first score line, and facilitating breakage of the panel; and a tab that pressing a portion, of the panel, positioned inside the first score line that is formed into the U-shape, and causing breakage of the panel along the second score line and the first score line, wherein, at the one end section of the first score line, a curvature that brings the first score line closer to the other end section side of the first score line is imparted, and at the other end section of the first score line, a curvature that brings the first score line closer to the one end section side of the first score line is imparted.

Here, the first score line is formed to be linearly symmetric with respect to a center line of the tab, which extends along a longitudinal direction of the tab, as a symmetrical axis.

Moreover, a portion, of the one end section of the first score line, where the curvature is imparted and a portion, of the other end section of the first score line, where the curvature is imparted are positioned behind the tab in a case where the panel is viewed from a side on which the tab is attached. In this case, as compared to a case in which the portion where the curvature is imparted is not positioned behind the tab and is exposed, an outer appearance of the can lid can be improved.

From another point of view, a can lid to which the present invention is applied includes: a panel attached to a can barrel; a score line on the panel, formed into a U-shape, including one end section and the other end section, and facilitating breakage of the panel; and a tab that pressing a portion, of the panel, positioned inside the score line that is formed into the U-shape, and causing breakage of the panel along the score line, wherein, at least at one of the one end section and the other end section of the score line, a curvature that brings the score line closer to the other of the one end section and the other end section is imparted.

Here, also at the other of the one end section and the other end section of the score line, a curvature that brings the score line closer to the one of the end sections is imparted. In this case, as compared to a case in which the curvature is imparted only to one end section, breakage of the panel along the score line is performed more successfully.

Moreover, there is further provided a second score line connected to the score line, and formed to head toward an inside of a region enclosed by the score line from a connecting section with the score line. In this case, it becomes possible to cause breakage of the panel within the region, of the panel, enclosed by the score line.

Moreover, in a case where the present invention is perceived as a beverage can, there is provided a beverage can including: a can barrel containing a beverage; and a can lid attached to the can barrel, wherein the can lid includes: a panel attached to the can barrel; a score line on the panel, formed into a U-shape, including one end section and the other end section, and facilitating breakage of the panel; and a tab that pressing a portion, of the panel, positioned inside the score line that is formed into the U-shape, and causing breakage of the panel along the score line, wherein, at least at one of the one end section and the other end section of the score line, a curvature that brings the score line closer to the other of the one end section and the other end section is imparted.

A can lid to which the present invention is applied includes: a panel including a first surface and a second surface positioned on an opposite side of the first surface, and attached to an aperture of a can barrel; a tab attached to the first surface of the panel, and pressing a predetermined location of the panel; a score line formed on the first surface of the panel, formed to enclose the predetermined location, and facilitating breakage of the panel; and a recession-processed section formed in a region, of the panel, enclosed by the score line, and, in a case where the panel is viewed from the first surface side, at least a part of which being positioned behind the tab, to increase bending stiffness of the region, wherein the recession-processed section is formed by pressing a mold against the panel from the first surface side of the panel, and a protruding section generated with formation of the recession-processed section is positioned on the second surface side.

Here, an entirety of the recession-processed section is positioned behind the tab in a case where the panel is viewed from the first surface side. In this case, grit and dust are less likely to be accumulated inside the recession-processed section.

Moreover, there is further provided a second score line that is formed within the region enclosed by the score line, one end thereof being positioned within the enclosed region and the other end being connected to the score line, wherein the recession-processed section is formed into a groove-like shape, and is formed to enclose the one end of the second score line. In this case, if breakage of the panel proceeding from the other end side toward the one end of the second score line is generated at a portion beyond the one end, it becomes possible to stop the breakage.

Moreover, an attachment section in which the tab is attached to the panel is positioned in the region enclosed by the score line, and the recession-processed section is formed into the groove-like shape and is formed to enclose the attachment section.

Moreover, there is further provided a second score line that is formed within the region enclosed by the score line, one end thereof being positioned within the enclosed region and the other end being connected to the score line, wherein, within the region enclosed by the score line, a first region and a second region facing each other with the second score line interposed therebetween are provided, and the recession-processed section is formed into a groove-like shape, includes one end section positioned within the first region and the other end section positioned within the second region, formed to proceed from the one end section toward the other end section, and formed to pass beside the one end of the second score line and head toward the other end section, without intersecting the second score line when proceeding. In this case, if breakage of the panel proceeding from the other end side toward the one end of the second score line is generated at a portion beyond the one end, it becomes possible to stop the breakage.

Moreover, in a case where the recession-processed section is assumed to be a first recession-processed section, a second recession-processed section is provided outside the first recession-processed section. In this case, it is possible to improve stiffness of the panel.

Moreover, the second recession-processed section is formed to enclose the tab, and further, a protruding section generated with formation of the second recession-processed section is positioned on the first surface side. In this case, it becomes possible, not only to improve the stiffness of the panel, but also to keep the position of the tab provided to the can lid, and thereby to suppress rotation of the tab when forming an opening.

From another point of view, a can lid to which the present invention is applied includes: a panel including a first surface and a second surface positioned on an opposite side to the first surface, and attached to an aperture of a can barrel; a tab attached to the first surface of the panel, and pressing a predetermined location of the panel; a score line formed on the first surface of the panel, formed to enclose the predetermined location, and facilitating breakage of the panel; and a recession-processed section formed in a region, of the panel, enclosed by the score line, and increasing bending stiffness of the region, wherein the recession-processed section is formed by pressing a mold against the panel from the first surface side of the panel, and a protruding section generated with formation of the recession-processed section is positioned on the second surface side.

Moreover, in a case where the present invention is perceived as a beverage can, there is provided a beverage can including: a can barrel containing a beverage; and a can lid attached to the can barrel, wherein the can lid is any one of the can lids described above.

A can lid to which the present invention is applied includes: a panel including an outer peripheral edge, and attached to an aperture of a can barrel; a score line including a U-shaped portion that has one end section and the other end section, formed to swell toward the outer peripheral edge side of the panel and includes a vertex section on the outer peripheral edge side, and facilitating breakage of the panel; and a tab attached to an attached section positioned within an enclosed region, of the panel, enclosed by the U-shaped portion, arranged along one direction from the vertex section side of the U-shaped portion toward a center portion side of the panel to press the inside of the enclosed region of the panel, and pressing a side on which the vertex section is positioned with respect to a virtual line, which is orthogonal to the one direction and passes through the attached section when pressing, wherein the score line is further provided with a portion, which is connected to one of the one end section and the other end section of the U-shaped portion, and extends, from a connecting section with the one of the one end section and the other end section as a starting point, toward the other of the one end section and the other end section.

Here, the portion, which extends from the one of the one end section and the other end section as the starting point toward the other of the one end section and the other end section, is provided to reach a location beyond a straight line that extends while passing through the vertex section and the attached section. In this case, the length of the part, of a piece-like portion generated by breakage of the panel along the score line, that requires bending can be smaller, and thereby it becomes possible to bend the piece-like portion with a smaller force.

Moreover, the panel is provided with a second score line that is connected to the U-shaped portion of the score line and is headed toward the inside of the enclosed region from a location of being connected to the U-shaped portion, and the second score line is connected to a portion, of the U-shaped portion, positioned between the other of the one end section and the other end section and the vertex section. In this case, as compared to a case in which the second score line is connected to a portion, of the U-shaped portion, positioned between the one end section and the vertex section, breakage of the panel along the score line is caused with more reliability.

Moreover, in a case where the present invention is perceived as a beverage can, a beverage can provided by the present invention includes: a can barrel containing a beverage; and a can lid attached to an aperture of the can barrel, wherein the can lid includes: a panel including an outer peripheral edge, and attached to the aperture of the can barrel; a score line including a U-shaped portion that has one end section and other end section, formed to swell toward the outer peripheral edge side and includes a vertex section on the outer peripheral edge side, and facilitating breakage of the panel; and a tab attached to an attached section positioned within an enclosed region, of the panel, enclosed by the U-shaped portion, arranged along one direction from the vertex section side of the U-shaped portion toward a center portion side of the panel to press the inside of the enclosed region of the panel, and pressing a side on which the vertex section is positioned with respect to a virtual line, which is orthogonal to the one direction and passes through the attached section when pressing, wherein the score line is further provided with a portion, which is connected to one of the one end section and the other end section of the U-shaped portion, and extends, from a connecting section with the one of the one end section and the other end section as a starting point, toward the other of the one end section and the other end section.

A can lid to which the present invention is applied includes: a panel attached to an aperture of a can barrel; a tab including one end section and the other end section, a portion of which positioned between the one end section and the other end section being fastened to the panel by a rivet, and pressing a predetermined pressed location of the panel with the other end section; and a score line formed on the panel, which includes a first portion that passes one side of the tab to head toward the one end section side of the tab, a second portion that passes the other side of the tab to head toward the one end section side of the tab, and a third portion that is formed to connect the first portion and the second portion and passes outside of an outer peripheral edge of the tab on the other end section side of the tab, wherein each of the first portion and the second portion heading toward the one end section side is formed to reach any of a location beyond the one end section, a location where the one end section is positioned, and a location positioned beside the one end section.

Here, one of the first portion and the second portion is formed to have a curvature and to change a proceeding direction thereof to head toward the other of the portions, or, one of the first portion and the second portion is formed to have a curvature and to change a proceeding direction thereof to head toward the other of the portions, and the other of the portions is also formed to have a curvature and to change a proceeding direction thereof to head toward the one of the portions.

Moreover, the tab is attached to, of one surface and the other surface of the panel, the one surface side, due to breakage of the panel on the score line, a tongue-shaped portion that is configured with part of the panel and formed into a tongue-shape is generated, the tongue-shaped portion is bent toward the other surface side of the panel by an operation of the tab by an operator, and the tab is moved with the tongue-shaped portion to the other surface side of the panel. In this case, it is possible to make a protrusion, which is generated in the tab due to the manufacturing process of the tab, enter into the inside of the can body.

Moreover, in a state in which the tab has been moved to the other surface side of the panel, the one end section of the tab is not positioned on the other surface side, but is positioned on the one surface side. In this case, a finger of an operator who operates the tab is less likely to enter into the inside of the can body.

Moreover, at the predetermined pressed location of the panel, a protrusion that protrudes toward the tab side is provided. In this case, breakage of the panel on the score line is likely to be generated.

Moreover, at the other end section of the tab, a protrusion that protrudes toward the panel side is provided. In this case, breakage of the panel on the score line is likely to be generated.

Moreover, a location, of the panel, where the third portion of the score line is provided has a thickness smaller than thicknesses of the other locations of the panel. In this case, breakage of the panel on the score line is likely to be generated.

Moreover, there is further provided a second score line that is formed to pass between the predetermined pressed location of the panel and the rivet, and is connected to the score line. In this case, as compared to a case in which the second score line is not formed, it is possible to reduce the operation load of the tab.

Moreover, in a case where the present invention is perceived as a beverage can, a beverage can to which the present invention is applied includes: a can barrel containing a beverage; and a can lid attached to an aperture of the can barrel, wherein the can lid includes: a panel attached to the aperture of the can barrel; a tab including one end section and the other end section, a portion of which positioned between the one end section and the other end section being fastened to the panel by a rivet, and pressing a predetermined pressed location of the panel with the other end section; and a score line formed on the panel, which includes a first portion that passes one side of the tab to head toward the one end section side of the tab, a second portion that passes the other side of the tab to head toward the one end section side of the tab, and a third portion that is formed to connect the first portion and the second portion and passes outside of an outer peripheral edge of the tab on the other end section side of the tab, wherein each of the first portion and the second portion heading toward the one end section side is formed to reach any of a location beyond the one end section, a location where the one end section is positioned, and a location positioned beside the one end section.

Here, due to breakage of the panel on the score line, a tongue-shaped portion that is configured with part of the panel and formed into a tongue-shape is generated, the tongue-shaped portion enters into an inside of the beverage can by an operation of the tab by an operator, and the tab is moved with the tongue-shaped portion and enters into the inside of the beverage can. In this case, it is possible to make a protrusion, which is generated in the tab due to the manufacturing process of the tab, enter into the inside of the can body.

Moreover, in a state in which the tab has entered into the inside of the beverage can, the one end section of the tab does not enter into the inside of the beverage can, but is positioned outside the beverage can. In this case, a finger of an operator who operates the tab is less likely to enter into the inside of the can body.

Advantageous Effects of Invention

According to the present invention, it becomes possible to successfully perform breakage of the panel along the score line.

Moreover, according to the present invention, it is possible to suppress formation of the opening on the can lid despite that operation of the tab by the user is not carried out.

Moreover, according to the present invention, it is possible to cause the piece-like portion generated by breakage of the panel along the score line to be bent with ease.

Moreover, according to the present invention, it is possible to simplify the operation of the tab required to form the opening on the can lid.

BRIEF DESCRIPTION OF DRAWINGS

FIGS. 12-2A and 12-2B are diagrams showing another configuration example of the can lid;

FIGS. 12-3A and 12-3B are diagrams showing another configuration example of the can lid;

FIG. 14-1 is a diagram for illustrating breakage of a panel;

FIG. 14-2 is a diagram showing another mode of the can lid;

FIG. 22-1 is a diagram for illustrating breakage of a panel;

FIG. 22-2 is a diagram showing another mode of the can lid;

DESCRIPTION OF EMBODIMENTS

First Exemplary Embodiment

Hereinafter, an exemplary embodiment according to the present invention will be described in detail with reference to attached drawings.

Figure 1:
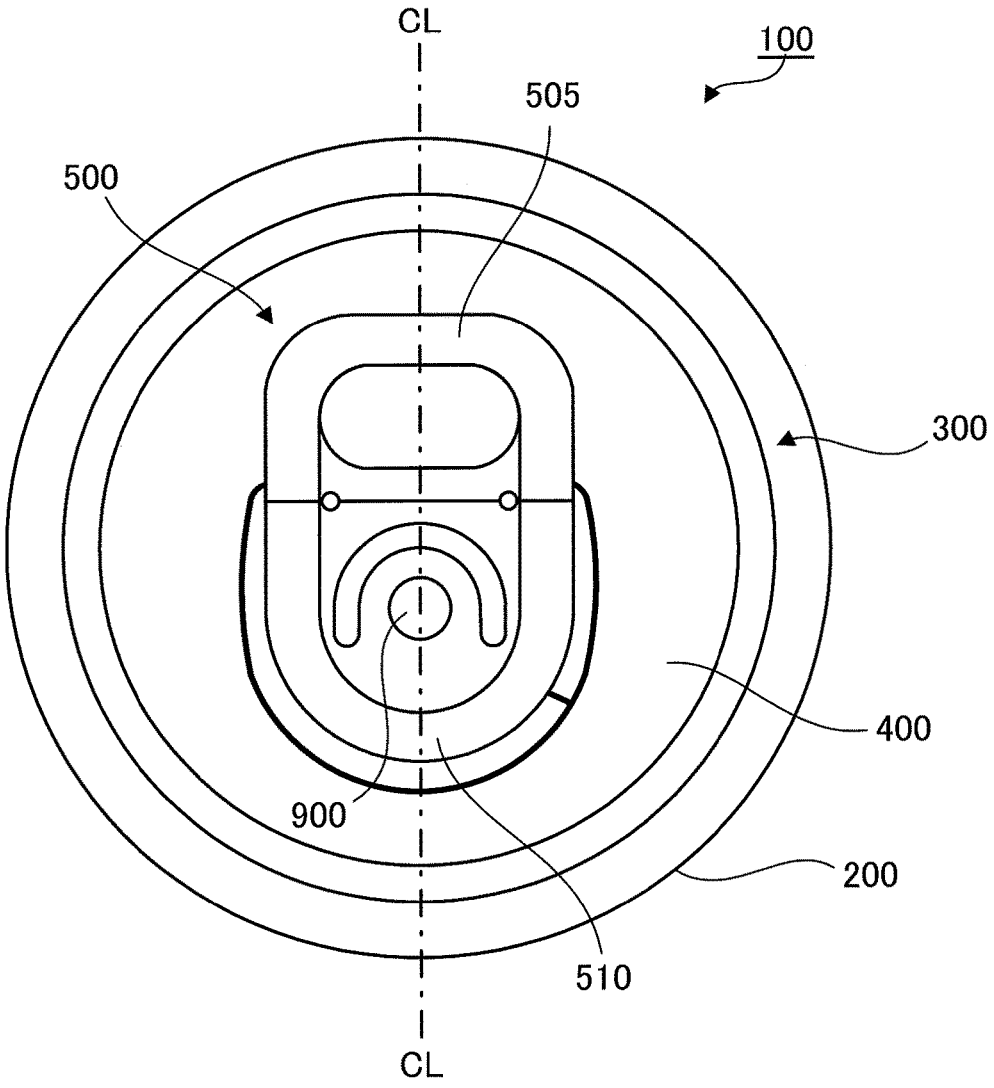
FIG. 1 is a top view of a beverage can to which an exemplary embodiment is applied.

FIG. 1 is a top view of a beverage can 100 to which the exemplary embodiment is applied. As shown in the figure, the beverage can 100 includes a container body (can barrel) 200 that is formed in a cylindrical shape and has an opening at an upper portion and a bottom section at a lower portion, and a can lid 300 that is attached to the opening of the container body 200 to block the opening. Note that the beverage can 100 contains a drink, such as a soft drink, a carbonated drink or an alcoholic beverage.

The can lid 300 includes a disk-shaped panel 400 that functions as a substrate and is attached to the container body 200. Moreover, a tab 500 to be operated by a user is attached to the can lid 300. The tab 500 is operated (lifted up) by the user at one end portion (in the figure, an upper end portion), and thereby the other end portion thereof (a tip end portion) is pressed against a predetermined location of the panel 400 (to be described in detail later), to thereby press the panel 400. Note that, in the present specification, the upper end portion of the tab 500 in the figure is referred to as an operated section 505, and a lower end portion of the tab 500 in the figure is referred to as a tip end section 510.

The tab 500 is fastened to the panel 400 by a rivet 900 provided at a position deviated from a center portion of the panel 400. To additionally describe, the tab 500 is fastened to the panel 400 by the rivet 900 provided in a decentered state with respect to the panel 400. Further, in the tab 500, a portion positioned between the operated section 505 and the tip end section 510 is fastened to the panel 400 by the rivet 900.

Note that, in the exemplary embodiment, description is given by taking a case in which the tab 500 is fastened to the panel 400 by the rivet 900 provided at the position deviated from the center portion of the panel 400 as an example; however, the tab 500 can be fastened to the panel 400 by a rivet 900 provided at the center portion of the panel 400. Moreover, in the exemplary embodiment, a tab 500 in which the tip end section 510 is formed into an arc shape is exemplified; however, the tab 500 can be formed into a rectangular shape, and in this case, the tab 500 includes a linear-shaped tip end section 510.

With reference to FIGS. 2A to 2D (the diagrams for illustrating the tab 500), the tab 500 will be described further.

Figure 2A:
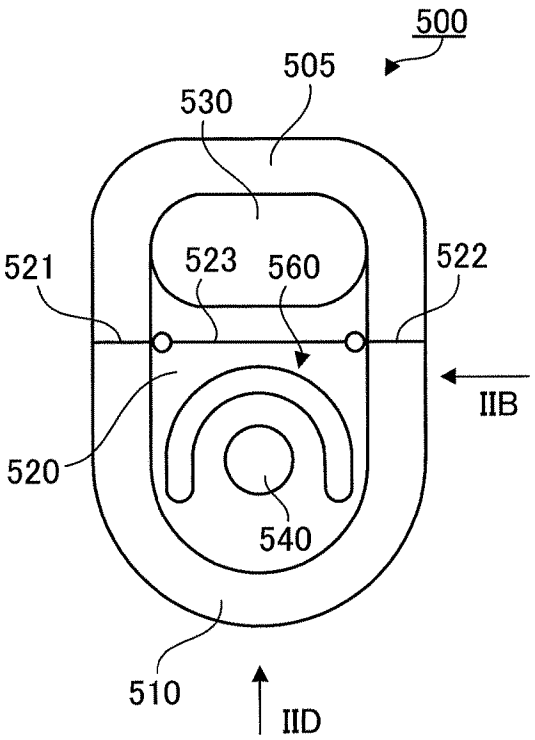
FIGS. 2A to 2D are diagrams for illustrating a tab.
Figure 2B:
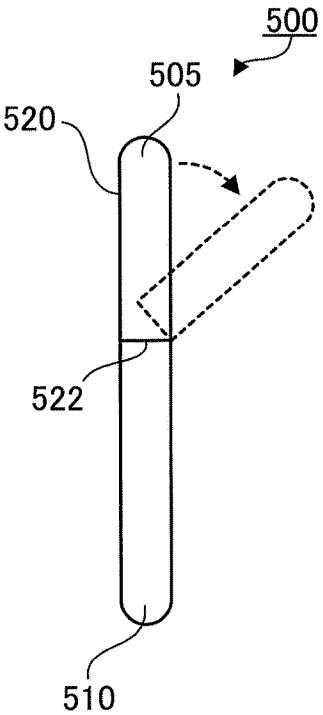
Figure 2C:
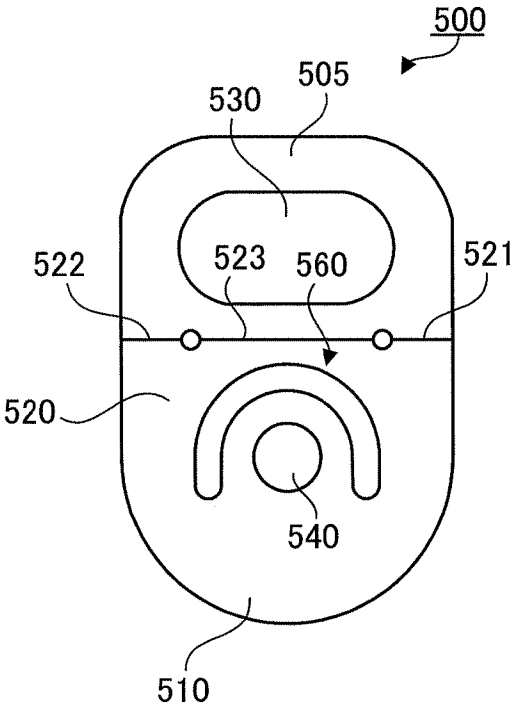
Figure 2D:
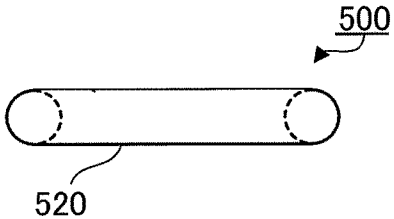

Note that FIG. 2A is a front view of the tab 500 and FIG. 2B is a diagram showing the tab 500 as viewed from the direction of arrow IIB in FIG. 2A. Moreover, FIG. 2C is a diagram showing a reverse side of the tab 500. FIG. 2D is a diagram showing the tab 500 as viewed from the direction of arrow IID in FIG. 2A.

The tab 500 includes, as shown in FIG. 2A, a tab main body section 520 that is formed into a plate-like shape and into substantially a rectangular shape. Note that, in the exemplary embodiment, as shown in FIG. 2D, bending processing (curling processing) is applied to an outer peripheral edge of the tab main body section 520, and accordingly, the outer peripheral edge of the tab main body section 520 is in a state of curling into the inside. To additionally describe, at the edge section provided all around the tab main body section 520, curling sections are formed.

Consequently, in the exemplary embodiment, bending stiffness of the tab 500 is increased. Further, in the tab 500, as shown in FIG. 2A, a through hole (a finger hole) 530 in which user's finger is caught is formed on a side (the operated section 505 side) opposite to the side on which the tip end section 510 is provided. Moreover, in the tab 500, an insertion hole 540 into which the protruding section 420 (to be described later) provided in the panel 400 is inserted is formed on the tip end section 510 side. Further, round the insertion hole 540, a penetrating section 560 that is formed into a U-shape and penetrates through the tab main body section 520 is provided.

Further, of the four curling sections provided all around the tab main body section 520, in the curling section provided along the longitudinal direction of the tab 500, a first slit 521 is formed. Moreover, of the four curling sections, in another curling section provided along the longitudinal direction of the tab 500, a second slit 522 is formed. Further, of the tab main body section 520, in the portion positioned between the first slit 521 and the second slit 522, a groove 523 along the short direction of the tab 500 is formed.

Here, the first slit 521, the second slit 522 and the groove 523 are provided on the same straight line. Moreover, the first slit 521, the second slit 522 and the groove 523 are provided along the width direction of the tab 500. In addition, the first slit 521, the second slit 522 and the groove 523 are arranged between the insertion hole 540 and the through hole 530. Here, in the exemplary embodiment, the first slit 521, the second slit 522 and the groove 523 are formed in this manner, and accordingly, stiffness (bending stiffness) in the portions where these are formed is decreased.

Consequently, as shown in FIG. 2B, if a load is applied to the operated section 505 side of the tab 500, the tab 500 is bent. Note that, in the exemplary embodiment, the groove 523 is formed between the first slit 521 and the second slit 522 to decrease the stiffness in the portion; however, the stiffness is able to be decreased not only by forming such a groove, but also by applying the bending processing. Moreover, the groove 523 is not necessarily required, and the groove 523 may be omitted. Note that, in a case where a load that acts on a direction opposite to the direction of the arrow indicated in FIG. 2B is applied to the operated section 505 (in a case where a load that acts on the left direction in the figure is applied to the operated section 505), planes divided into two by the first slit 521 or the like (of the tab 500, portions positioned at both sides of the first slit 521 or the like) face each other, to thereby prevent the tab 500 from bending.

Figure 3:
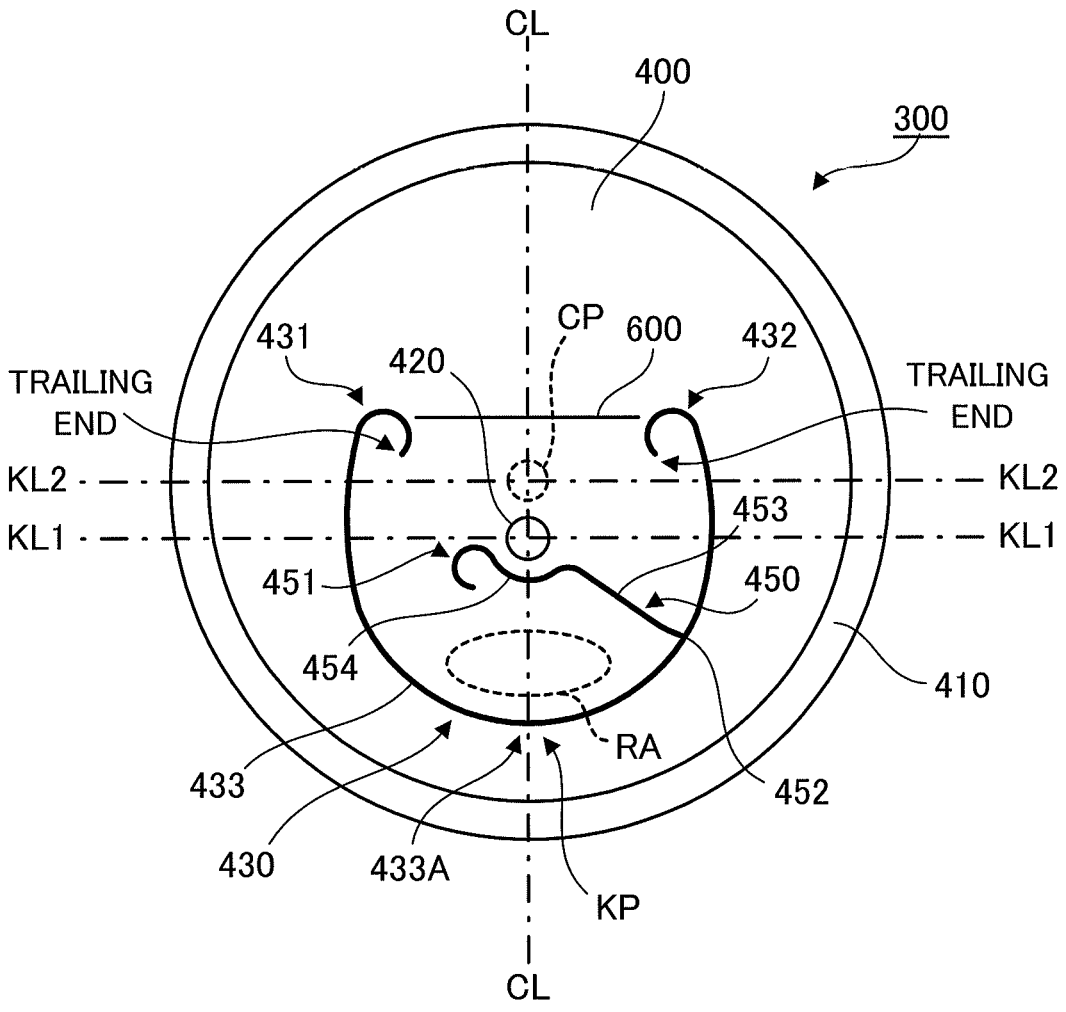
FIG. 3 is a front view showing a can lid before the tab is attached.

FIG. 3 is a front view of the can lid 300 before the tab 500 is attached.

The can lid 300 of the exemplary embodiment includes a panel 400 that is formed into a disk shape. The panel 400 has an outer peripheral edge 410 in which bending processing has applied. In the exemplary embodiment, in a state where the outer peripheral edge 410 and an upper edge section (not shown) of the container body 200 (refer to FIG. 1) are brought into contact with each other, so-called seaming processing is applied to the outer peripheral edge 410 and the upper edge section. This fastens the can lid 300 (the panel 400) to the upper edge section of the container body 200.

Further, in the can lid 300, a protruding section (nipple) 420, which will be crushed when the tab 500 is fastened to the panel 400 to become the above-described rivet 900 (refer to FIG. 1), is formed. The protruding section 420 is provided at a location deviated from the center portion CP of the panel 400. Moreover, on a surface of the panel 400, a U-shaped first score line 430 is formed.

The first score line 430 is configured with a groove formed on the surface of the panel 400 and plays a role of inducing breakage of the panel 400 (to be described later). To additionally describe, the first score line 430 is able to be grasped as a breakage prediction line on which breakage of the panel 400 is predicted. To describe further, the first score line 430 has a role of facilitating breakage of the panel 400, which is caused by being pressed by the tab 500, so as to be generated at a predetermined location of the panel 400.

Here, the first score line 430 is formed to curve toward the outer peripheral edge 410 of the panel 400 from the center portion side of the panel 400, and is formed into a U-shape when the panel 400 is viewed from the front. Further, the first score line 430 includes one end section 431 and the other end section 432 on the center portion CP side of the panel 400, and a vertex section 433A on the outer peripheral edge 410 side of the panel 400. Note that, in the exemplary embodiment, a region RA of the panel 400, which is to be pressed by the tab 500, is positioned inside a region enclosed by the first score line 430.

The one end section 431 of the first score line 430 is arranged on one side (in the figure, the region on the left side) of two regions that face each other with the center line CL (the center line along the longitudinal direction of the tab 500, also refer to FIG. 1) of the tab 500 interposed therebetween. On the other hand, the other end section 432 is arranged on the other side (in the figure, the region on the right side) of two regions that face each other with the center line CL interposed therebetween. Moreover, in the exemplary embodiment, the first score line 430 is formed to be linearly symmetric with respect to the center line CL of the tab 500 as a symmetrical axis.

Further, by arranging the one end section 431 and the other end section 432 in a state of being separated from each other, between the one end section 431 and the other end section 432 of the panel 400, there is provided a discontinuous section where the first score line 430 is not formed. By providing the discontinuous section, a later-described tongue section is not separated from the panel 400, and the tongue section is kept in a state of attaching to the panel 400. Note that, in the exemplary embodiment, as shown in FIG. 3, the center line CL of the tab 500 passes through the center portion CP of the panel 400 and the protruding section 420 formed on the panel 400.

In addition, in the exemplary embodiment, in a case where a first virtual line KL1, which is a virtual line that is orthogonal to the above-described center line CL and passes through the protruding section 420 (rivet 900), is assumed, the above-described one end section 431 and the other end section 432 are positioned closer to the center portion CP side of the panel 400 than the first virtual line KL1.

Moreover, in the exemplary embodiment, as shown in FIG. 3, the vertex section 433A is positioned in one of two regions that face each other with a second virtual line KL2, which is a virtual line that is orthogonal to the center line CL and passes through the center portion CP of the panel 400, interposed therebetween, and the one end section 431 and the other end section 432 are positioned in the other region.

Further, the protruding section 420 that will become the rivet 900 is provided in a portion of the panel 400 enclosed by the first score line 430, which is positioned closer to the vertex section 433A side than the one end section 431 and the other end section 432 of the first score line 430. Moreover, as shown in FIG. 3, the first score line 430 includes a curved section 433. The curved section 433 connects the one end section 431 and the other end section 432, swells toward a side on which the protruding section 420 is provided, and passes through a side closer to the outer peripheral edge 410 of the panel 400 than the protruding section 420. Moreover, the curved section 433 has the vertex section 433A at a location crossing the center line CL.

In the exemplary embodiment, by operation of the tab 500 by a user, the region enclosed by the first score line 430 is pressed by the tab 500, and accordingly, the panel 400 is broken on the location where the first score line 430 is formed (to be described in detail later). This causes the region on which the first score line 430 is formed to be in the tongue shape, and also causes the region to be bent toward the inside of the beverage can 100. Consequently, an opening that plays a role of a place a person drinks from is formed in the beverage can 100.

Note that, in the present specification, hereinafter, the above-described tongue-shaped portion formed by breakage caused on the first score line 430 is referred to as a tongue section, in some cases.

Further, in the exemplary embodiment, on the surface of the panel 400, the second score line 450 is formed. The second score line 450 is also configured with a groove formed on the surface of the panel 400 and plays a role of inducing breakage of the panel 400. Of the two regions facing each other with the first virtual line KL1 interposed therebetween, the second score line 450 is provided in the region where the vertex section 433A (the vertex section 433A of the first score line 430) is provided.

Moreover, the second score line 450 includes one end section 451 and the other end section 452. Here, the other end section 452 of the second score line 450 is connected to the curved section 433 of the first score line 430. Accordingly, in the exemplary embodiment, the score line branches at a location where the first score line 430 and the second score line 450 are connected.

The other end section 452 of the second score line 450 is connected to a portion positioned between the center line CL and the first virtual line KL1 in the curved section 433 of the first score line 430. To describe further, the other end section 452 of the second score line 450 is connected to a portion positioned between the vertex section 433A and the other end section 432 of the first score line 430. Moreover, the other end section 452 of the second score line 450 is connected to, of the first score line 430, a location other than the location where the vertex section 433A is provided.

To describe further, the connecting section of the first score line 430 and the second score line 450 is provided at a location other than a crossing location KP where the center line CL and the first score line 430 cross each other. Moreover, in the exemplary embodiment, the second score line 450 is provided to head toward the inside of the region enclosed by the first score line 430 from the connecting section with the first score line 430.

Moreover, in the exemplary embodiment, the connecting section of the first score line 430 and the second score line 450 is provided closer to a side where the above-described crossing location KP is provided than the first virtual line KL1 arranged in a relation orthogonal to the center line CL. In addition, in the exemplary embodiment, the connecting section of the first score line 430 and the second score line 450 is provided closer to a side where the region RA is positioned than the first virtual line KL1 arranged in a relation orthogonal to the center line CL.

Moreover, in the exemplary embodiment, the distance between the connecting section of the first score line 430 and the second score line 450 and the one end section 431 of the first score line 430 is larger than the distance between the connecting section and the other end section 432 of the first score line 430. To describe further, the length of the portion positioned between the one end section 431 of the first score line 430 and the above-described connecting section is longer than the length of the portion positioned between the other end section 432 of the first score line 430 and the above-described connecting section.

Note that, in the exemplary embodiment, the description has been given of a case where the second score line 450 is formed to head in the lower right direction in the figure from the center portion side of the panel 400; however, the second score line 450 may be formed to head in the lower left direction in the figure. In this case, the second score line 450 is connected to a portion positioned between the vertex section 433A and the one end section 431 of the first score line 430.

Further, the one end section 451 of the second score line 450 is provided in proximity to the protruding section 420. Moreover, the one end section 451 of the second score line 450 is arranged in one of the two regions facing with the centerline CL interposed therebetween, and the other end section 452 of the second score line 450 is arranged in the other one of the two regions. Further, the second score line 450 includes a linear section 453 heading toward the protruding section 420 from the other end section 452. Moreover, the second score line 450 includes a curved section 454 that is connected to the linear section 453 and arranged to have a distance with the protruding section 420 formed into a circular-cylindrical shape, and is formed along the outer peripheral edge of the protruding section 420.

The curved section 454 of the second score line 450 is formed between the protruding section 420 and the first score line 430. To describe in detail, the curved section 454 is formed between the vertex section 433A of the first score line 430 and the protruding section 420. To additionally describe, on the center line CL, the curved section 454 of the second score line 450 is arranged between the protruding section 420 and the first score line 430.

Moreover, the curved section 454 is provided to pass between the region RA, of the panel 400, pressed by the tab 500 and the protruding section 420. To additionally describe, in the exemplary embodiment, the second score line 450 is provided to pass through closer to a side where the protruding section 420 (the rivet 900) is provided than the above-described region RA, and also the second score line 450 is provided to pass between the region RA and the protruding section 420.

Moreover, the curved section 454 of the second score line 450 is provided to cross the center line CL. To describe further, the second score line 450 in the exemplary embodiment, after passing between the region RA and the protruding section 420, proceeds along the direction crossing the center line CL, and is connected to the first score line 430. To describe further, the second score line 450, which proceeds along the direction intersecting the center line CL and toward the first score line 430, passes beside the region RA. Moreover, the second score line 450, after passing between the region RA and the protruding section 420, proceeds to be gradually separated from the first virtual line KL1, and is connected to the first score line 430.

Here, with reference to FIGS. 4A to 4F (the diagrams showing states of the can lid 300 when the tab 500 is operated), the can lid 300 will be described further. Note that, in each of FIGS. 4A to 4F, there are shown two states, namely, a state of the can lid 300 when the can lid 300 is viewed from the front side and a state of the can lid 300 when the can lid 300 is viewed from the lateral side.

In the exemplary embodiment, when the operated section 505 (the rear end section) of the tab 500 (refer to FIG. 1) is pulled up by a user, the tip end section 510 of the tab 500 presses the region RA (refer to FIG. 3) positioned between the curved section 454 of the second score line 450 and the vertex section 433A of the first score line 430. Then, when the region RA is pressed by the tab 500, first, breakage of the panel 400 occurs on the curved section 454 of the second score line 450 provided to pass between the region RA and the rivet 900 (the protruding section 420) (refer to FIG. 4B).

Figure 4A:
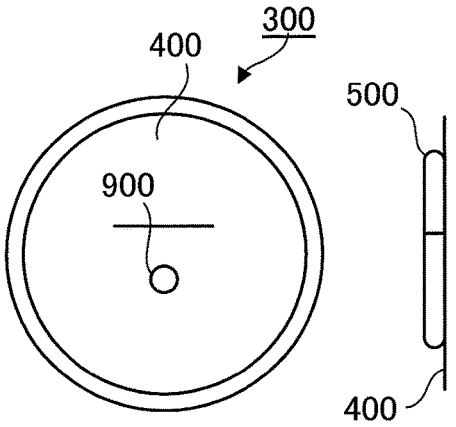
FIGS. 4A to 4F are diagrams showing states of the can lid when the tab is operated.
Figure 4B:
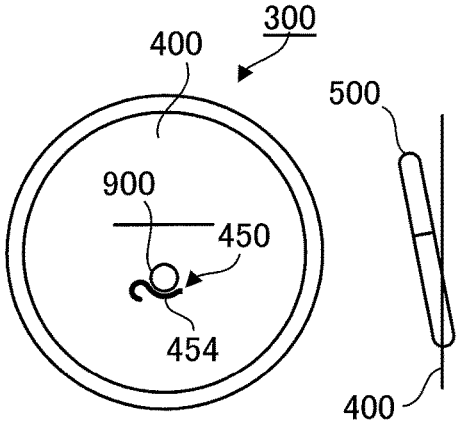
Figure 4C:
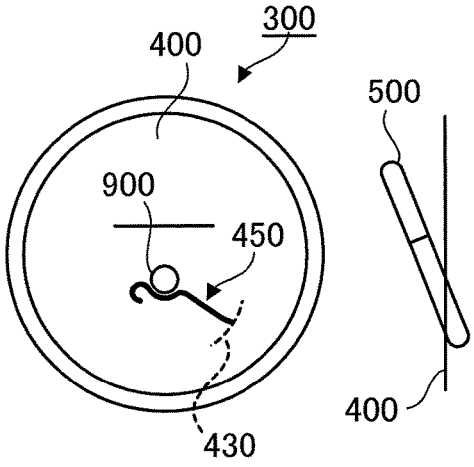
Figure 4D:
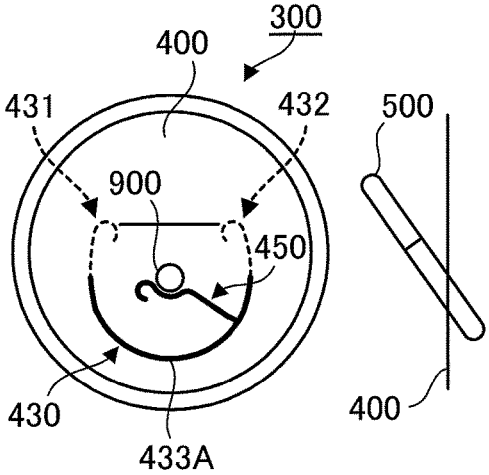

Thereafter, breakage of the panel 400 proceeds along the second score line 450, and, as shown in FIG. 4C, the panel 400 is broken to the connecting section of the first score line 430 and the second score line 450. After that, in the exemplary embodiment, as shown in FIG. 4D, breakage of the panel 400 from the connecting section toward the one end section 431 of the first score line 430 and breakage of the panel 400 from the connecting section toward the other end section 432 of the first score line 430 proceed.

Figure 4E:
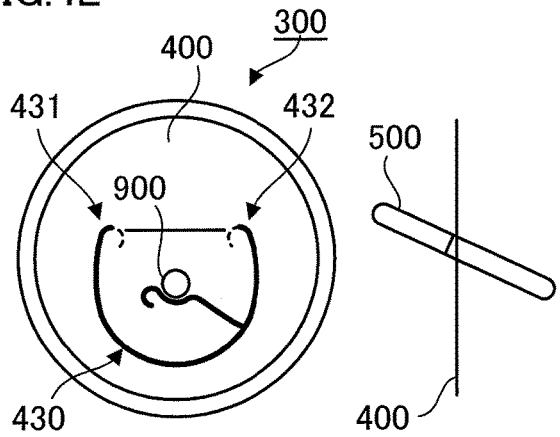

Thereafter, in the exemplary embodiment, the tab 500 is pressed into an inward direction of the beverage can 100 by the user. Consequently, as shown in FIG. 4E, breakage of the panel 400 further proceeds to the one end section 431 and the other end section 432 of the first score line 430. This causes the region enclosed by the first score line 430 to become the tongue section. In addition, the tongue section is bent at a basal part of the tongue section (the location positioned between the one end section 431 and the other end section 432 of the first score line 430), and the tongue section enters into the inside of the beverage can 100.

Figure 4F:
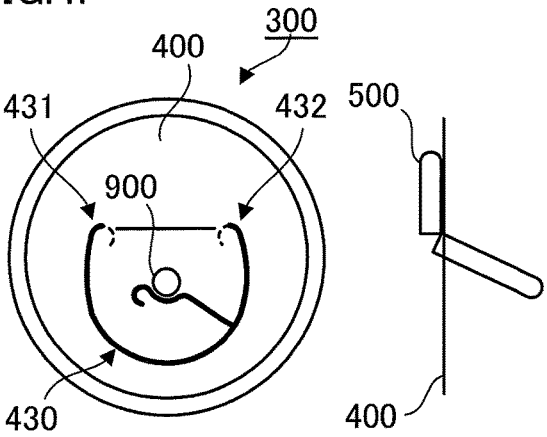

Consequently, in the beverage can 100, an opening that functions as a place a person drinks from is formed. After that, operation of the operated section 505 side of the tab 500 is carried out by the user, and, as shown in FIG. 4F, the tab 500 is bent. This causes the operated section 505 side of the tab 500 to follow the panel 400 of the can lid 300. In this case, there is no protrusion on the operated section 505 side, and accordingly, irritations in drinking are reduced.

Here, in the exemplary embodiment, by bending the tab 500 in this manner, a state in which the tip end section 510 of the tab 500 is inserted into the inside of the beverage can 100 is maintained. To additionally describe, even if the tab 500 that has been pulled up is laid down to follow the panel 400, the state in which the tip end section 510 of the tab 500 is inserted into the inside of the beverage can 100 is maintained. This prevents the opening having been formed from being blocked by the tip end section 510 of the tab 500, and accordingly, the opening grows wider. Note that, in the exemplary embodiment, description has been given by taking the bendable tab 500 as an example; however, it is possible to use an unbending tab 500 as a matter of course. Note that, in this case, it is desirable to take measures to reduce a protruding amount of the operated section 505 of the tab 500.

Here, breakage of the panel 400 caused on the first score line 430 and the second score line 450 will be further described with reference to FIG. 5 (a diagram for illustrating breakage of the panel 400).

In the exemplary embodiment, as described above, when the operated section 505 of the tab 500 is pulled up by a user, the region RA (refer to FIG. 3) positioned between the curved section 454 of the second score line 450 and the vertex section 433A of the first score line 430 is pressed by the tab 500. This causes, first, breakage of the panel 400 at the curved section 454 of the second score line 450 (refer to FIG. 5).

Thereafter, breakage of the panel 400 proceeds along the second score line 450, and the panel 400 is broken to the connecting section of the first score line 430 and the second score line 450. After that, the panel 400 is broken on the first score line 430. Specifically, of the first score line 430, breakage of the panel 400 is generated in a region indicated by the reference sign 4C.

Figure 5:
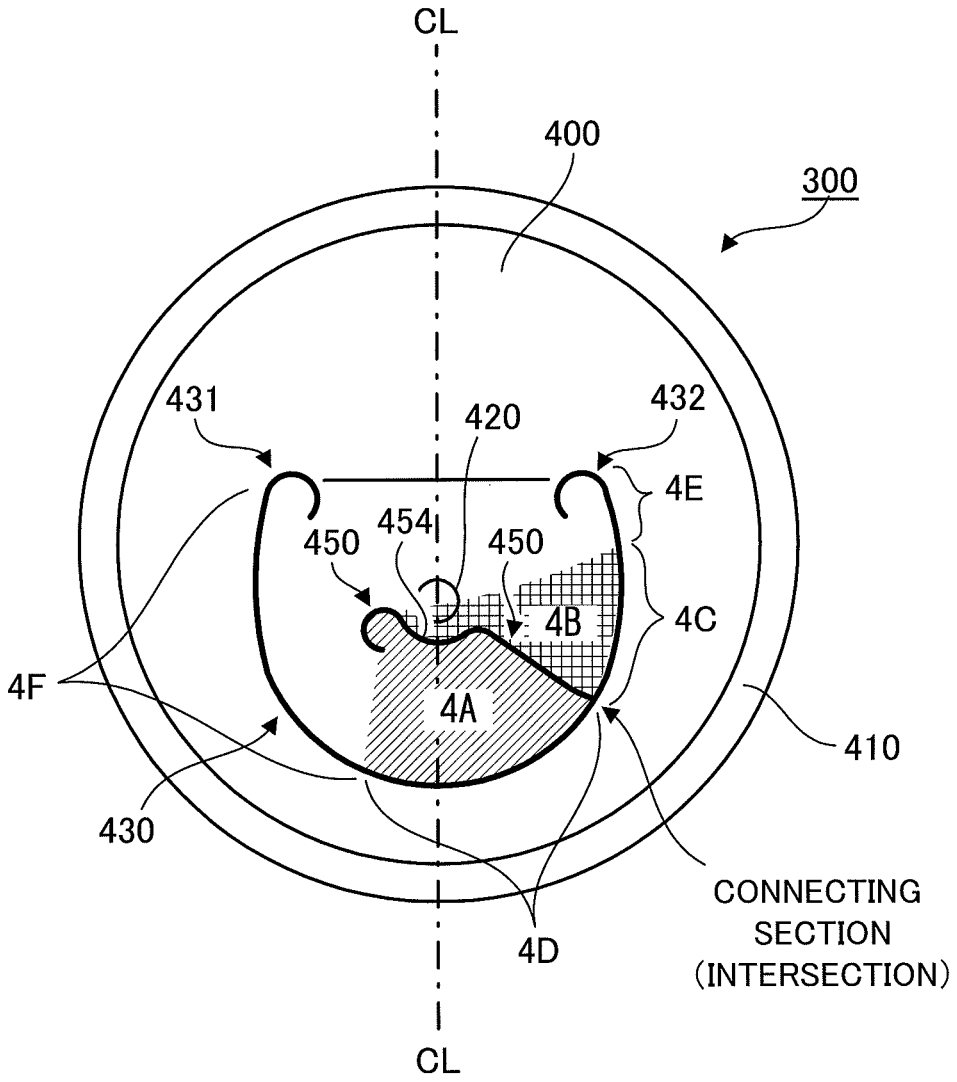
FIG. 5 is a diagram for illustrating breakage of a panel.

To describe in detail, in the exemplary embodiment, the tab 500 is pressed against the region RA, and thereby the region RA is pressed into the inward direction of the beverage can 100; at this time, the protruding section 420 is pulled by the tab 500 to an outward direction of the beverage can 100 (to the frontward direction in FIG. 5). This pulls the location indicated by the reference sign 4B in FIG. 5 to the outward direction of the beverage can 100. As a result, a shearing force acts on the region indicated by the reference sign 4C, and thereby the panel 400 is broken in the region indicated by the reference sign 4C. To additionally describe, the panel 400 is broken in the portion, of the first score line 430, positioned closer to the other end section 432 side than the connecting section.

Moreover, in the exemplary embodiment, pressing of the tab 500 against the region RA is continued, and by the pressing, a portion, of the panel 400, indicated by the reference sign 4A is pressed toward the inward direction of the beverage can 100. Consequently, a shearing force acts on the region indicated by the reference sign 4D, and thereby the panel 400 is broken in the region indicated by the reference sign 4D. To additionally describe, the panel 400 is broken in the portion, of the first score line 430, positioned closer to the one end section 431 side than the connecting section.

Thereafter, in the exemplary embodiment, the tab 500 is pressed into the inward direction of the beverage can 100 by the user, and this causes further breakage of the panel 400 on the first score line 430. Specifically, the panel 400 is broken in two regions, namely, a region indicated by the reference sign 4E and a region indicated by the reference sign 4F in the figure. Further, in the exemplary embodiment, the tongue section is bent at a basal part of the tongue section (the location positioned between the one end section 431 and the other end section 432 of the first score line 430). Consequently, the tongue section enters into the inside of the beverage can 100, and thereby the opening is formed in the beverage can 100.

Note that, in the exemplary embodiment, when breakage of the panel 400 is generated on the first score line 430, first, breakage of the panel 400 is generated on the side closer to the other end section 432 than the connecting section (the region indicated by the reference sign 4C), and subsequently, breakage of the panel 400 is generated on the side closer to the one end section 431 than the connecting section (the region indicated by the reference sign 4D). Consequently, in the exemplary embodiment, an operation load when the user operates the tab 500 is reduced.

Here, for example, in a case where breakage of the panel 400 is generated simultaneously on both sides, namely, on the side closer to the one end section 431 than the connecting section and on the side closer to the other end section 432 than the connecting section, breakage of the panel 400 comes to be generated simultaneously in two locations. In such a case, with respect to the tab 500, it becomes necessary to apply the operation load required for breakage in two locations, and accordingly, the operation load on the tab 500 is increased.

On the other hand, in the exemplary embodiment, first, breakage of the panel 400 is generated on the side closer to the other end section 432 than the connecting section, and subsequently, breakage of the panel 400 is generated on the side closer to the one end section 431 than the connecting section. In this case, it is sufficient to apply the operation load required for breakage in one location on the tab 500, and the operation load on the tab 500 is reduced, as compared to the case in which the panel 400 is broken in two locations simultaneously.

Note that, in the above, description has been given by taking the case as an example, in which, first, breakage of the panel 400 is generated on the side closer to the other end section 432 than the connecting section, and subsequently, breakage of the panel 400 is generated on the side closer to the one end section 431 than the connecting section. By the way, this breaking mode is merely an example, and depending on the thickness of the panel 400, the form of the first score line 430, the form of the second score line 450, the shape of the tab 500, and so on, breakage of the panel 400 is first generated on the side closer to the one end section 431 than the connecting section, and subsequently, breakage of the panel 400 is generated on the side closer to the other end section 432 than the connecting section.

To describe further, in the exemplary embodiment, the above-described connecting section is provided at a location deviated from the center line CL, to thereby reduce the operation load of the tab 500. Here, for example, in a case where the above-described connecting section is positioned on the center line CL, breakage of the panel 400 from the connecting section toward the one end section 431 and breakage of the panel 400 from the connecting section toward the other end section 432 are likely to occur at the same timing. In such a case, there occurs a state in which breakage of the panel 400 is generated at two locations and simultaneously, and thereby the operation load of the tab 500 is increased as compared to the case where breakage of the panel 400 is generated at a single location.

Note that, in the exemplary embodiment, as shown in FIG. 3, the groove 600 is provided in the region positioned between the one end section 431 and the other end section 432 of the first score line 430 (at a basal part of the tongue section), though description thereof was omitted above. The groove 600 is formed to head from the side on which the one end section 431 is provided toward the side on which the other end section 432 is provided. Consequently, in the exemplary embodiment, bending of the tongue section is likely to occur. Note that the groove 600 is not necessarily required and the groove 600 may be omitted. Moreover, the groove is not limited to be linearly formed, but may be formed with curvature.

Figure 6:
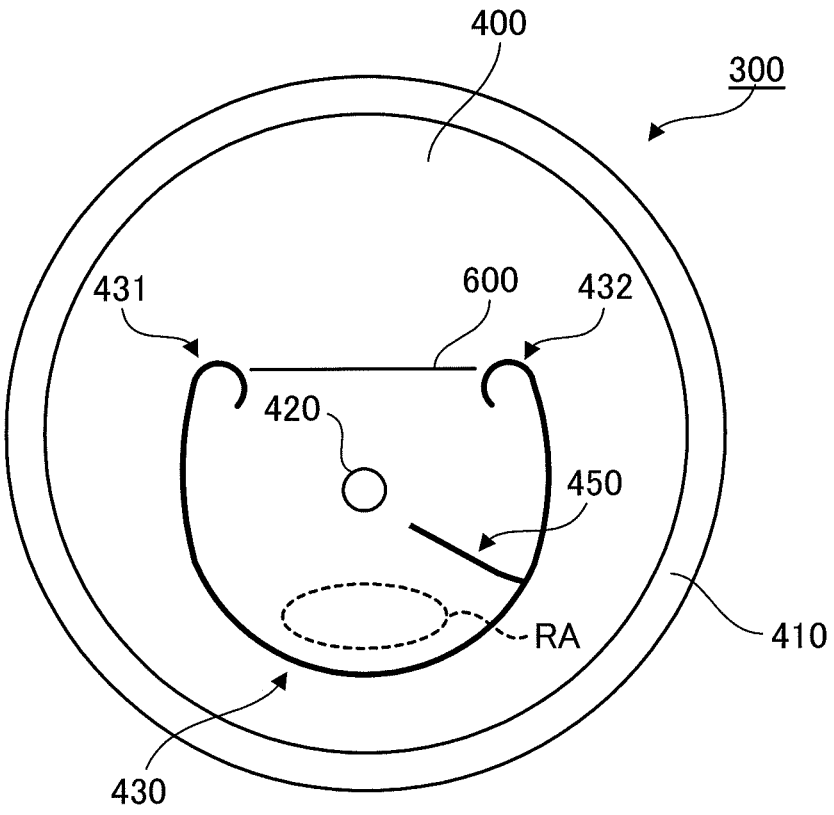
FIG. 6 is a diagram showing another configuration example of the can lid.

Moreover, in the exemplary embodiment, as described above, a case in which the second score line 450 is provided to pass between the region RA and the protruding section 420 has been exemplified; however, the mode of arranging the second score line 450 is not limited to the mode like this. For example, as shown in FIG. 6 (a diagram showing another configuration example of the can lid 300), a second score line 450 that does not pass between the region RA and the protruding section 420 may be provided. Further, the form of the second score line 450 is not particularly limited, too, and the second score line 450 may be provided with curvature.

Here, with reference to FIG. 3 again, the one end section 431 and the other end section 432 of the first score line 430 will be described in detail. In the exemplary embodiment, as shown in FIG. 3, in the one end section 431 and the other end section 432 of the first score line 430, the first score line 430 is curled inward to head toward the inside of the region enclosed by the first score line 430, and the first score line 430 approaches the center line CL of the tab 500 as moving toward a trailing end thereof.

Here, in the exemplary embodiment, as described above, breakage of the panel 400 is generated toward the one end section 431 and the other end section 432 of the first score line 430, and by curling of the first score line 430 in each of the one end section 431 and the other end section 432, the proceeding direction of the first score line 430 sharply changes in the one end section 431 and the other end section 432. Then, in this case, breakage of the panel 400 becomes stopped in the one end section 431 and the other end section 432.

Figure 9:
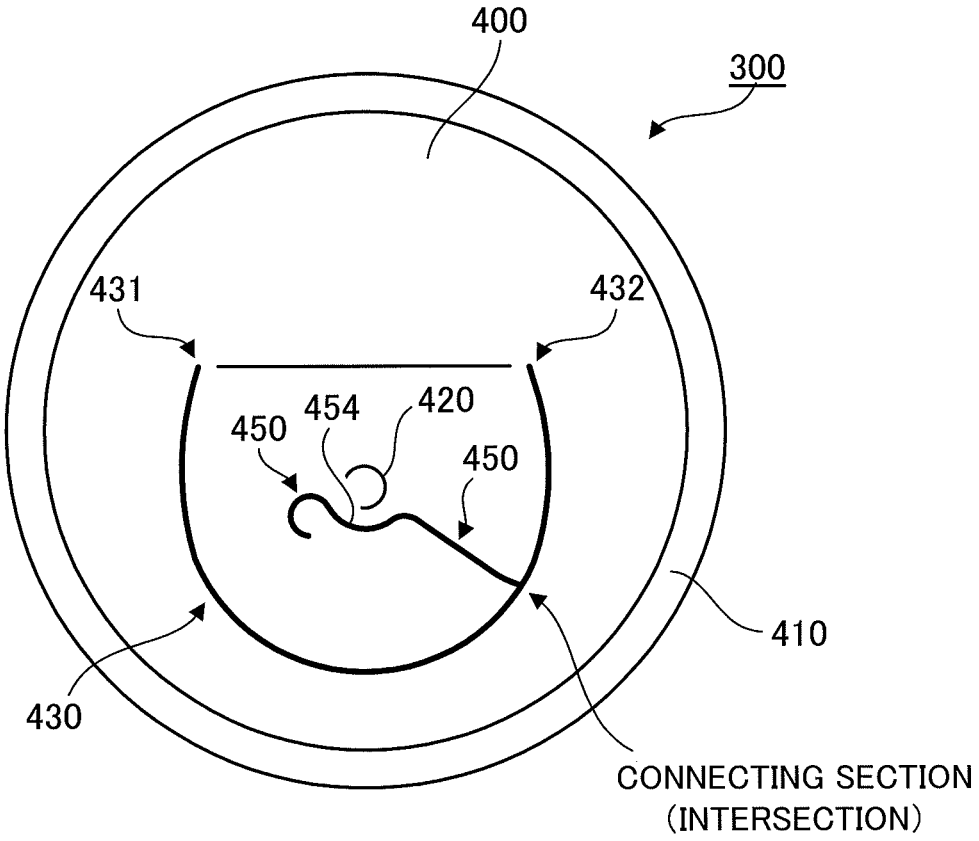
FIG. 9 is a diagram showing a comparative example of the can lid.

Here, for example, as shown in FIG. 9 (a diagram showing a comparative example of the can lid 300), if the one end section 431 and the other end section 432 are not curled but formed linearly, breakage of the panel 400 is apt to be generated at locations beyond the one end section 431 and the other end section 432 (a location positioned on an extension of the first score line 430 or a location where breakage is not expected).

Figure 7:
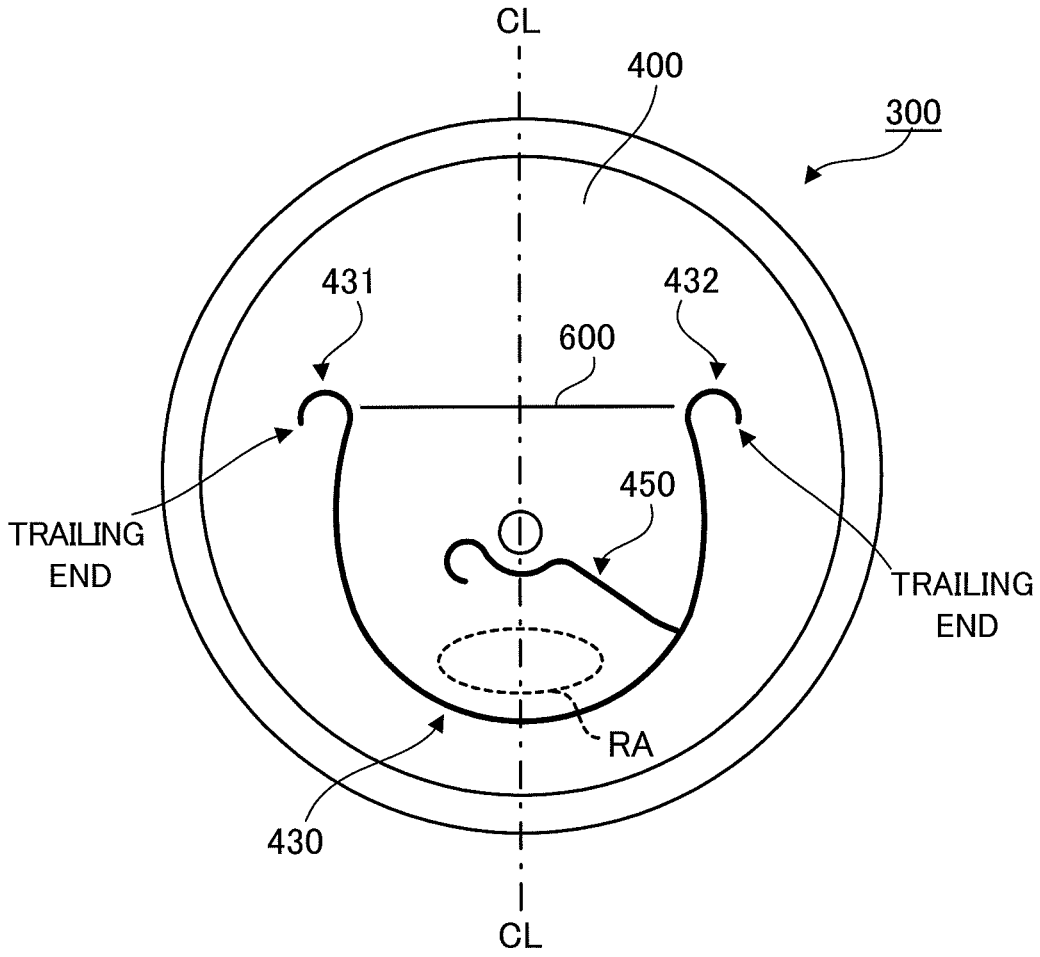
FIG. 7 is a diagram showing a comparative example of the can lid.

FIG. 7 is a diagram showing a comparative example of the can lid 300.

In this comparative example, as shown in the figure, in the one end section 431 and the other end section 432 of the first score line 430, the first score line 430 is curled outward to head toward the outside of the region enclosed by the first score line 430, and the first score line 430 moves away from the center line CL of the tab 500 as moving toward a trailing end thereof.

Here, also in this comparative example, similar to the exemplary embodiment, the proceeding direction of the first score line 430 sharply changes in the one end section 431 and the other end section 432, and accordingly, breakage of the panel 400 becomes stopped in the one end section 431 and the other end section 432. On the other hand, in this comparative example, a separation distance between the region RA and the first score line 430 becomes larger as moving toward the trailing end of the first score line 430.

In such a case, as approaching the trailing end of the first score line 430, the load from the tab 500 acted on the region RA becomes less likely to act on the first score line 430. In such a case, as approaching the trailing end of the first score line 430, breakage of the panel 400 on the first score line 430 becomes less likely to be generated. Then, in this case, there is a possibility that an opening to be formed is reduced in size. Moreover, in a case where the opening is to be broadened, the operation load of the tab 500 results in increasing.

Note that the size of the opening in this case indicates a bending angle of an opening piece (the tongue section), which is a portion inside the first score line 430 that is pressed into the inward direction of the can in forming the opening, rather than the opening area. In a case where the bending angle of the opening piece is small, a resistance, which acts on a drink when the drink passes through the location where the opening piece is positioned, is increased, and accordingly, the drink in the can becomes less likely to be discharged, whereas, in a case where the bending angle is large, the resistance is reduced, and therefore, the drink is more likely to be discharged.

On the other hand, in the exemplary embodiment, as described above, the first score line 430 is curled inwardly. To additionally describe, in the exemplary embodiment, the one end section 431 of the first score line 430 is provided with curvature that brings the first score line 430 closer to the other end section 432 side, and in addition, the other end section 432 of the first score line 430 is also provided with curvature that brings the first score line 430 closer to the one end section 431 side.

In such a case, the separation distance between the region RA and the first score line 430 is prevented from becoming larger as approaching the trailing end of the first score line 430. To additionally describe, in the configuration of the exemplary embodiment, as compared to the above-described comparative example, the one end section 431 and the other end section 432 of the first score line 430 become positioned at locations closer to the center line CL of the tab 500.

Then, in this case, as compared to the above-described comparative example, the load from the tab 500 is likely to act on the one end section 431 and the other end section 432 of the first score line 430, and breakage of the panel 400 is more likely to be generated to a location closer to the trailing end, as compared to the above-described comparative example. Then, in this case, the opening to be formed becomes larger.

Moreover, in the exemplary embodiment, breakage of the panel 400 in the one end section 431 and the other end section 432 is more likely to be generated as compared to the comparative example, the operation load of the tab 500 results in reducing as compared to the comparative example. To additionally describe, in the attempts to form an opening of the same size in the comparative example and in the exemplary embodiment, the operation load of the tab 500 is smaller in the exemplary embodiment than the comparative example.

Note that, in the exemplary embodiment, as described above, description has been given of the mode in which both of the one end section 431 and the other end section 432 are provided with inward curling; however, the curling may be provided to only one of them, not to both of them.

FIG. 8 includes diagrams showing modified examples of the can lid 300.

The form of the first score line 430 is not limited to the form as described above, and may be the following forms.

Figure 8A:
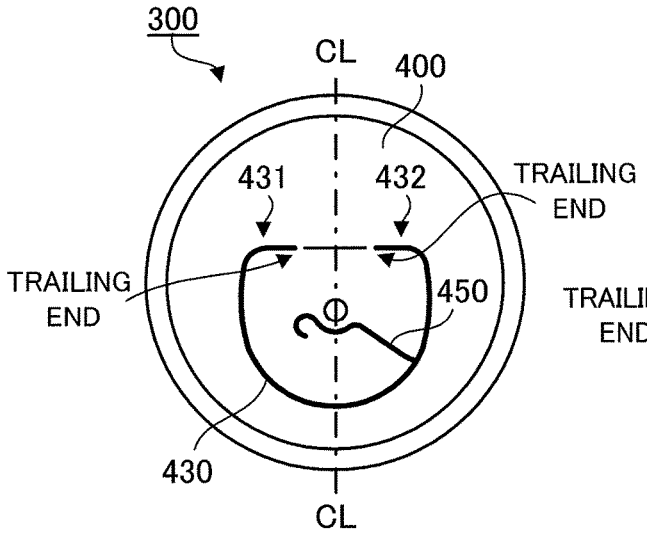
FIG. 8A to 8D include diagrams showing modified examples of the can lid.

For example, as shown in FIG. 8A, it is possible to form the first score line 430 so that the first score line 430 is bent on the way to the trailing end of the first score line 430, and portions positioned closer to the trailing end than the bent portions are formed linearly to head toward the center line CL.

To additionally describe, in this example, in the one end section 431, the first score line 430 is provided with curvature that brings the first score line 430 closer to the other end section 432 side; however, the section provided with the curvature is not assumed to be a trailing end, and the first score line 430 is further extended as if a score line that is linear and heading toward the center line CL is added, and thereafter, the first score line 430 reaches the trailing end. Moreover, in the other end section 432, the first score line 430 is provided with curvature that brings the first score line 430 closer to the one end section 431 side; however, the section provided with the curvature is not assumed to be a trailing end, and the first score line 430 is further extended as if a score line that is linear and heading toward the center line CL is added, and thereafter, the first score line 430 reaches the trailing end. Note that, though illustration is omitted, it may be possible to provide curvature to both trailing ends, namely, the one trailing end and the other trailing end, to thereby allow the one trailing end and the other trailing end to come close to each other.

Figure 8B:
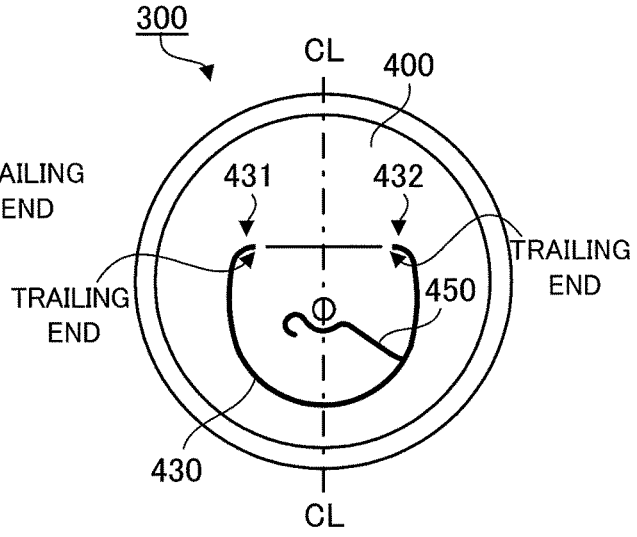

Next, to describe a mode shown in FIG. 8B, in the mode shown in FIG. 8B, as shown in the figure, each of the one end section 431 and the other end section 432 of the first score line 430 is provided with, for example, an inward quarter of an arc.

Figure 8C:
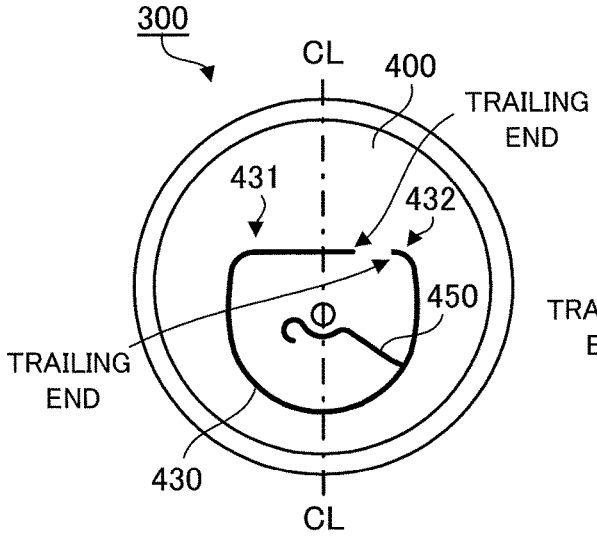

Moreover, in an example shown in FIG. 8C, in the one end section 431 side of the first score line 430, the first score line 430 is bent at a midpoint thereof, and a portion positioned closer to a trailing end than the bending portion is formed linearly and is caused to head toward the center line CL. On the other hand, the other end section 432 side of the first score line 430 is, similar to FIG. 8B, provided with an inward quarter of an arc. Note that, in the one end section 431 side of the first score line 430, the linear portion heading toward the center line CL is extended to a location beyond the center line CL.

Figure 8D:
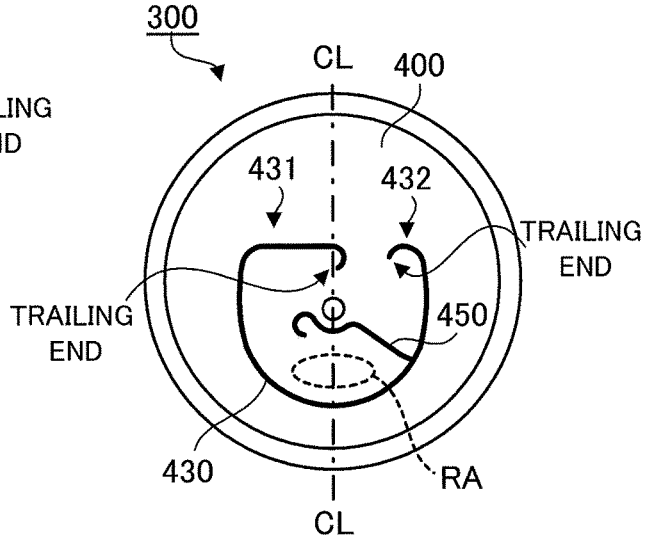

Moreover, in an example shown in FIG. 8D, similar to the mode shown in FIG. 8C, in the one end section 431 side of the first score line 430, the first score line 430 is bent at a midpoint thereof, and a portion positioned closer to a trailing end than the bending portion is formed linearly to head toward the center line CL.

Further, in this example, the tip end portion of the linear portion is curled, and in the tip end portion, the first score line 430 approaches the region RA as proceeding to the trailing end of the first score line 430. Moreover, in the other end section 432 side of the first score line 430, inward half of an arc is provided. In addition, in the other end section 432 side, as compared to the modes shown in FIGS. 8B and 8C, the first score line 430 is extended to a position closer to the center line CL.

Here, in the example shown in FIG. 8C, there is a possibility that breakage of the panel 400 is generated beyond the tip end portion of the linear portion (the trailing end of the first score line 430 in the one end section 431 side); however, in the example shown in FIG. 8D, the tip end portion of the linear portion is curled, and accordingly, breakage of the panel 400 beyond the tip end portion is less likely to occur. Moreover, in the configuration example shown in FIG. 8D, the tip end portion of the linear portion is curled to approach the region RA, and therefore, as compared to a case where the tip end portion is curled to move away from the region RA, breakage of the panel 400 is likely to be generated to a location closer to the trailing end of the one end section 431.

Further, though description is omitted in the above, in the exemplary embodiment, as shown in FIG. 1, the curling portion (the portion provided with curvature) of the one end section 431 and the curling portion (the portion provided with curvature) of the other end section 432 of the first score line 430 are positioned behind the tab 500.

To additionally describe, in the exemplary embodiment, in a case where the panel 400 is viewed from the side on which the tab 500 is attached, the above-described curling portions are positioned behind the tab 500. In this case, the curling portions are hidden by the tab 500. Then, in this case, the outer appearance becomes more simplified, to thereby improve the outer appearance (sense of beauty).

Second Exemplary Embodiment

Hereinafter, an exemplary embodiment according to the present invention will be described in detail with reference to attached drawings.

Figure 10:
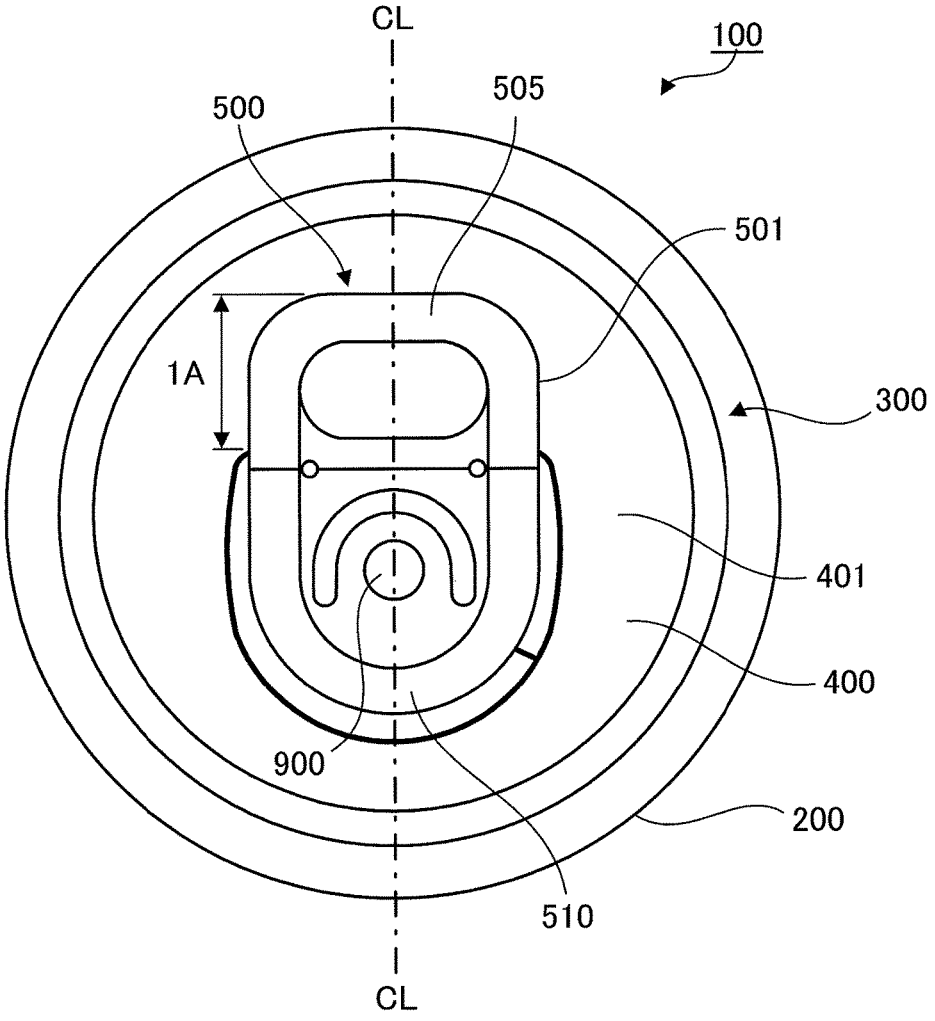
FIG. 10 is a top view of a beverage can.

FIG. 10 is a top view of a beverage can 100 to which the exemplary embodiment is applied. As shown in the figure, the beverage can 100 includes a container body (can barrel) 200 that is formed in a cylindrical shape and has an opening at an upper portion and a bottom section at a lower portion, and a can lid 300 that is attached to the opening of the container body 200 to block the opening. Note that the beverage can 100 contains a drink, such as a soft drink, a carbonated drink or an alcoholic beverage.

The can lid 300 includes a disk-shaped panel 400 that functions as a substrate and is attached to the container body 200. Moreover, a tab 500 to be operated by a user is attached to the can lid 300. The tab 500 is operated (lifted up) by the user at one end portion (in the figure, an upper end portion), and thereby the other end portion thereof (a tip end portion) is pressed against a predetermined location of the panel 400 (to be described in detail later), to thereby press the panel 400. Note that, in the present specification, the upper end portion of the tab 500 in the figure is referred to as an operated section 505, and a lower end portion of the tab 500 in the figure is referred to as the tip end section 510.

The tab 500 is fastened to the panel 400 by a rivet 900 provided at a position deviated from a center portion of the panel 400. To additionally describe, the tab 500 is fastened to the panel 400 by the rivet 900 provided in a decentered state with respect to the panel 400. Further, in the tab 500, a portion positioned between the operated section 505 and the tip end section 510 is fastened to the panel 400 by the rivet 900.

Note that, in the exemplary embodiment, description is given by taking a case in which the tab 500 is fastened to the panel 400 by the rivet 900 provided at the position deviated from the center portion of the panel 400 as an example; however, the tab 500 can be fastened to the panel 400 by a rivet 900 provided at the center portion of the panel 400. Moreover, in the exemplary embodiment, a tab 500 in which the tip end section 510 is formed into an arc shape is exemplified; however, the tab 500 can be formed into a rectangular shape, and in this case, the tab 500 includes a linear-shaped tip end section 510.

With reference to FIGS. 11A to 11D (the diagrams for illustrating the tab 500), the tab 500 will be described further.

Figure 11C:
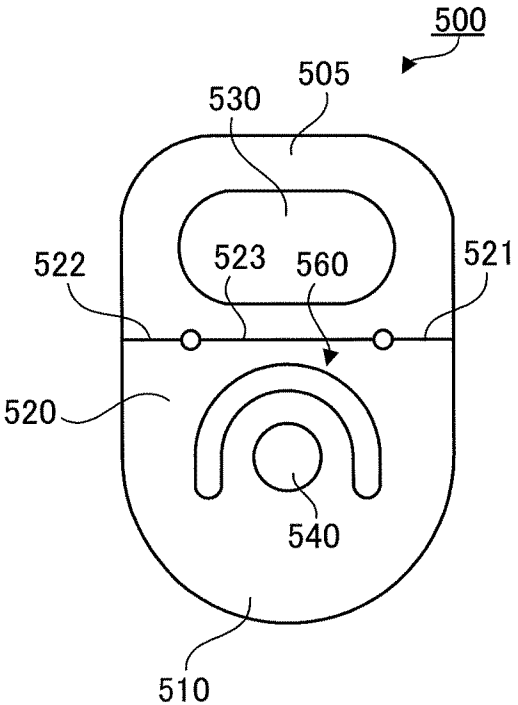
FIGS. 11A to 11D are diagrams for illustrating a tab.
Figure 11B:
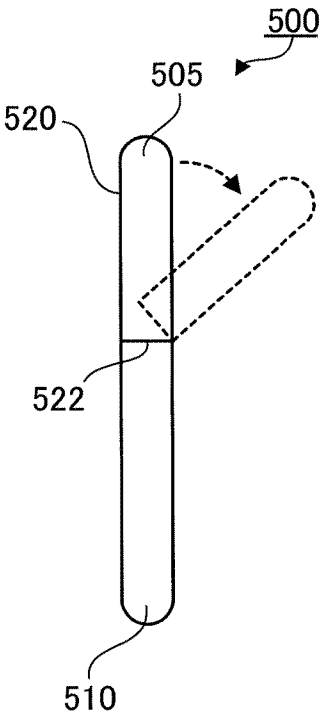
Figure 11A:
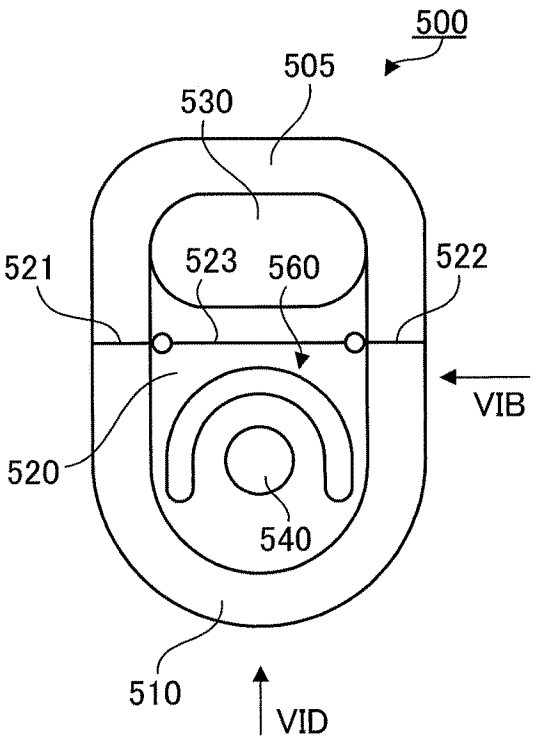
Figure 11D:
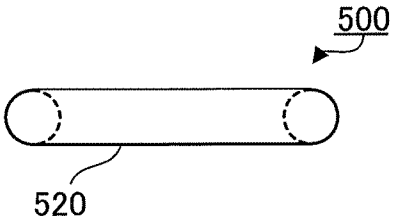

Note that FIG. 11A is a front view of the tab 500 and FIG. 11B is a diagram showing the tab 500 as viewed from the direction of arrow VIB in FIG. 11A. Moreover, FIG. 11C is a diagram showing a reverse side of the tab 500. FIG. 11D is a diagram showing the tab 500 as viewed from the direction of arrow VID in FIG. 11A.

The tab 500 includes, as shown in FIG. 11A, a tab main body section 520 that is formed into a plate-like shape and into substantially a rectangular shape. Note that, in the exemplary embodiment, as shown in FIG. 11D, bending processing (curling processing) is applied to an outer peripheral edge of the tab main body section 520, and accordingly, the outer peripheral edge of the tab main body section 520 is in a state of curling into the inside. To additionally describe, at the edge section provided all around the tab main body section 520, curling sections are formed.

Consequently, in the exemplary embodiment, bending stiffness of the tab 500 is increased. Further, in the tab 500, as shown in FIG. 11A, a through hole (a finger hole) 530 in which user's finger is caught is formed on a side (the operated section 505 side) opposite to the side on which the tip end section 510 is provided. Moreover, in the tab 500, an insertion hole 540 into which the protruding section 420 (to be described later) provided in the panel 400 is inserted is formed on the tip end section 510 side. Further, round the insertion hole 540, a penetrating section 560 that is formed into a U-shape and penetrates through the tab main body section 520 is provided.

Further, of the four curling sections provided all around the tab main body section 520, in the curling section provided along the longitudinal direction of the tab 500, a first slit 521 is formed. Moreover, of the four curling sections, in another curling section provided along the longitudinal direction of the tab 500, a second slit 522 is formed. Further, of the tab main body section 520, in the portion positioned between the first slit 521 and the second slit 522, a groove 523 along the short direction of the tab 500 is formed.

Here, the first slit 521, the second slit 522 and the groove 523 are provided on the same straight line. Moreover, the first slit 521, the second slit 522 and the groove 523 are provided along the width direction of the tab 500. In addition, the first slit 521, the second slit 522 and the groove 523 are arranged between the insertion hole 540 and the through hole 530. Here, in the exemplary embodiment, the first slit 521, the second slit 522 and the groove 523 are formed in this manner, and accordingly, stiffness (bending stiffness) in the portions where these are formed is decreased.

Consequently, as shown in FIG. 11B, if a load is applied to the operated section 505 side of the tab 500, the tab 500 is bent. Note that, in the exemplary embodiment, the groove 523 is formed between the first slit 521 and the second slit 522 to decrease the stiffness in the portion; however, the stiffness is able to be decreased not only by forming such a groove, but also by applying the bending processing. Moreover, the groove 523 is not necessarily required, and the groove 523 may be omitted.

Note that, in a case where a load that acts on a direction opposite to the direction of the arrow indicated in FIG. 11B is applied to the operated section 505 (in a case where a load that acts on the left direction in the figure is applied to the operated section 505), two facing portions formed by dividing the tab 500 by the first slit 521 or the like (of the tab 500, portions positioned at both sides of the first slit 521 or the like) bump against each other, to thereby prevent the tab 500 from bending.

Figures 1A, 12:
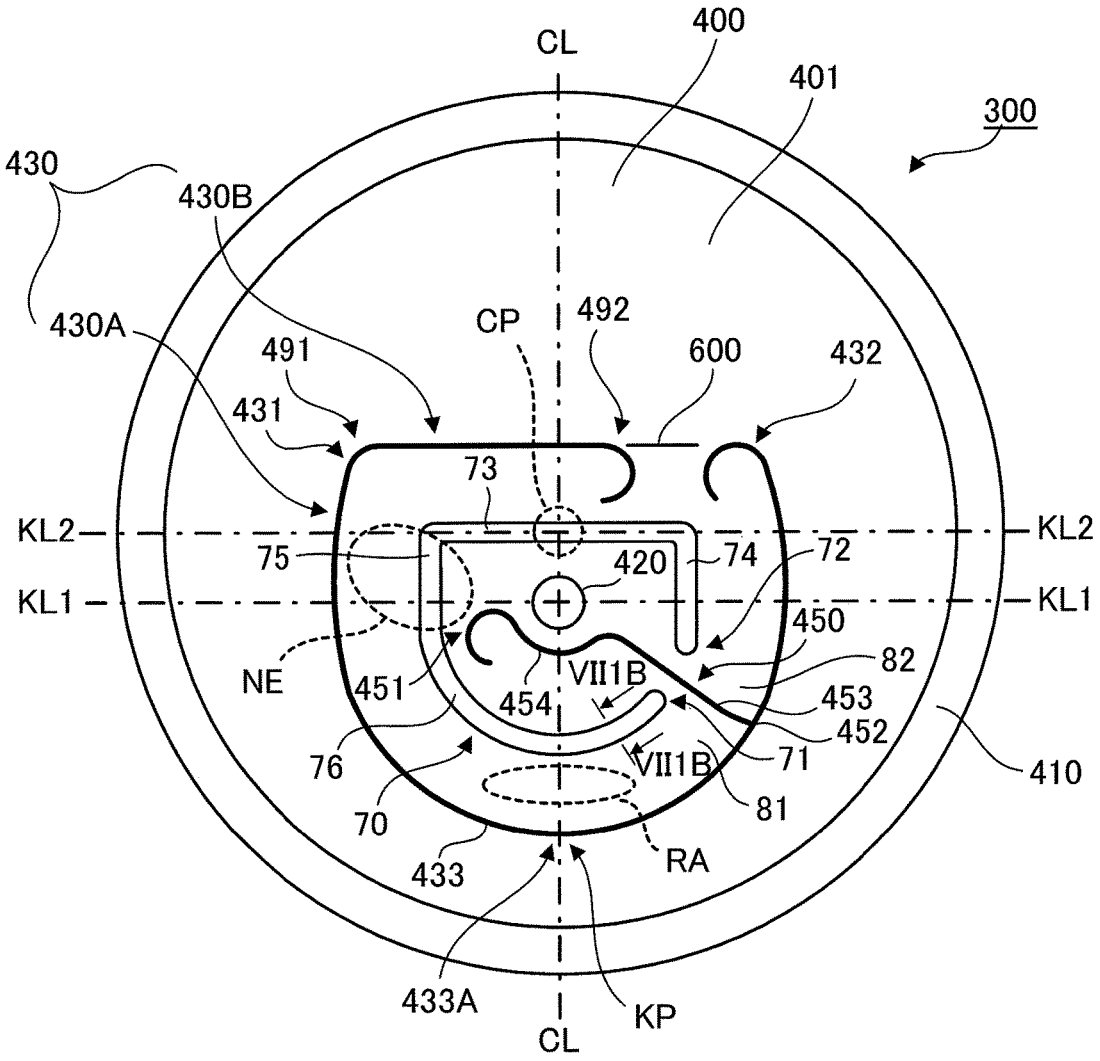
FIGS. 12-1A and 12-1B are diagrams for illustrating a can lid before the tab is attached.
Figures 1B, 12:
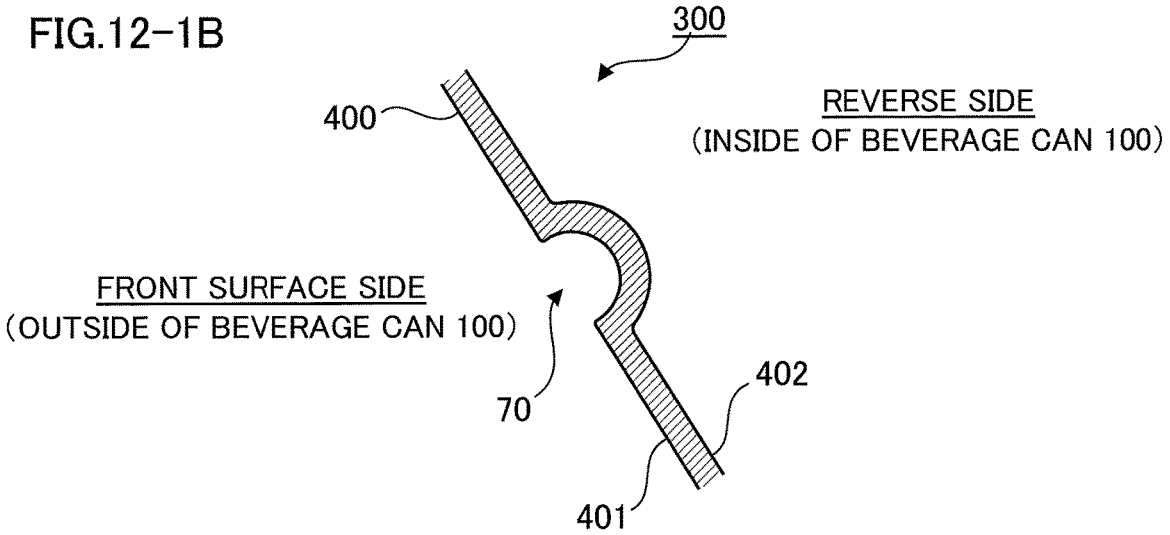
Figures 2A, 12:
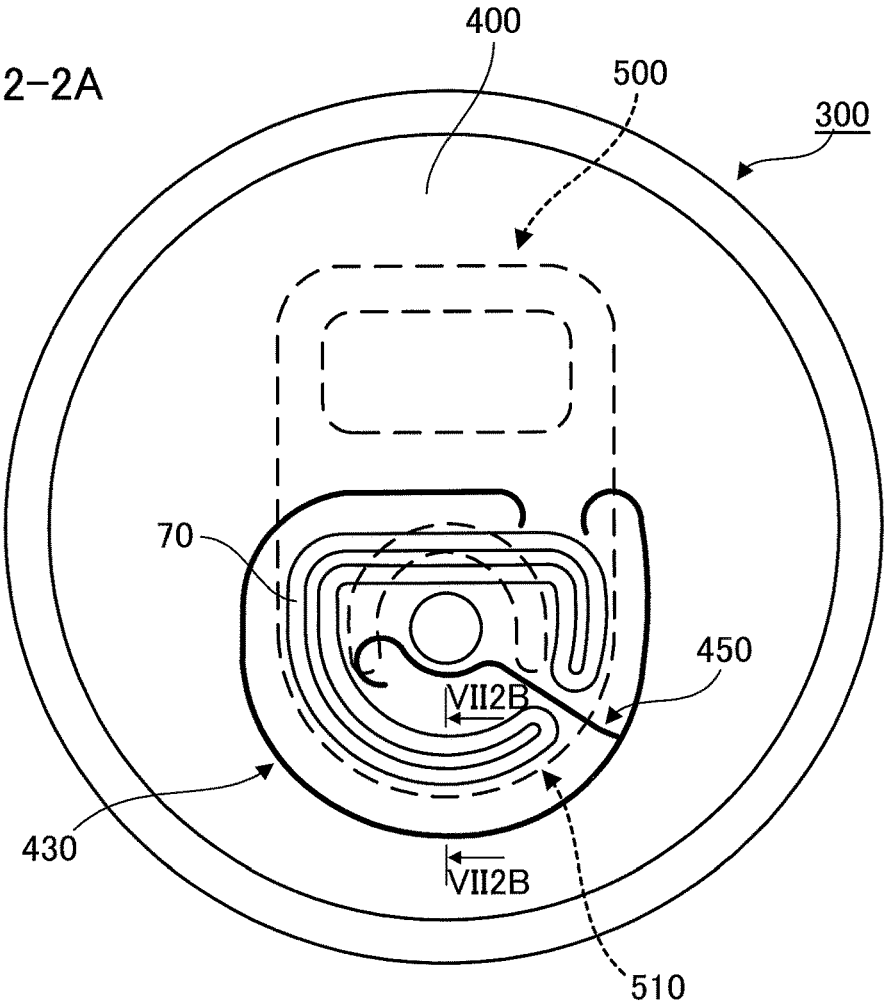
Figures 2B, 12:
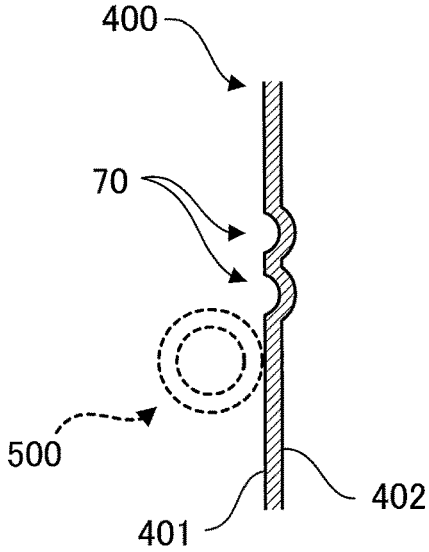

FIGS. 12-1A and 12-1B are diagrams for illustrating the can lid 300 before the tab 500 is attached. Note that FIG. 12-1A is a front view and FIG. 12-1B is a cross-sectional view along the line VIIIB-VIIIB in FIG. 12-1A.

As shown in FIG. 12-1A, the can lid 300 of the exemplary embodiment includes a panel 400 that is formed into a disk shape. The panel 400 is formed of a plate member, and includes a first surface 401 and a second surface 402 on a side opposite to the first surface 401 (refer to FIG. 12-1B).

Further, as shown in FIG. 12-1A, the panel 400 has an outer peripheral edge 410 in which bending processing has applied. In the exemplary embodiment, in a state where the outer peripheral edge 410 and an upper edge section (not shown) of the container body 200 (refer to FIG. 10) are brought into contact with each other, so-called seaming processing is applied to the outer peripheral edge 410 and the upper edge section. This fastens the can lid 300 (the panel 400) to the upper edge section of the container body 200.

Further, on the first surface 401 side of the can lid 300, a protruding section (nipple) 420, which will be crushed when the tab 500 is fastened to the panel 400 to become the above-described rivet 900 (refer to FIG. 10), is formed. The protruding section 420 is provided at a location deviated from the center portion CP of the panel 400. Further, in the exemplary embodiment, on the surface of the panel 400, the first score line 430 is formed.

The first score line 430 is configured with a groove formed on the surface of the panel 400 and plays a role of inducing breakage of the panel 400 (to be described later). To additionally describe, the first score line 430 is able to be grasped as a breakage prediction line on which breakage of the panel 400 is predicted. To describe further, the first score line 430 has a role of facilitating breakage of the panel 400, which is caused by being pressed by the tab 500, so as to be generated at a predetermined location of the panel 400.

Here, in the first score line 430, a U-shaped section 430A that is formed into a U-shape and a linear section 430B that is connected to the U-shaped section 430A are provided.

The U-shaped section 430A is formed to curve toward the outer peripheral edge 410 of the panel 400 from the center portion side of the panel 400, and is formed into a U-shape when the panel 400 is viewed from the front. Further, the U-shaped section 430A includes one end section 431 and the other end section 432 on the center portion CP side of the panel 400, and a vertex section 433A on the outer peripheral edge 410 side of the panel 400.

The linear section 430B is connected to the one end section 431 of the U-shaped section 430A, and is formed to extend toward the other end section 432 of the U-shaped section 430A from a connecting section with the one end section 431 as a starting point. To additionally describe, the linear section 430B is formed to head toward the other end section 432 side of the U-shaped section 430A regarding the connecting section with the one end section 431 as the starting point. Further, the linear section 430B includes a left end section 491 that is positioned on the left side of the figure and connected to the one end section 431 and a right end section 492 that is positioned on the right side of the figure and arranged near the other end section 432.

Note that, in the exemplary embodiment, the other end section 432 of the U-shaped section 430A and the right end section 492 of the linear section 430B are curled, and thereby breakage of the panel 400 beyond the other end section 432 and breakage of the panel 400 beyond the right end section 492 are suppressed. In a case where these sections are not curled and formed linearly, there is a possibility that the panel 400 is split at the location beyond the other end section 432 and at the location beyond the right end section 492, and thereby breakage of the panel 400 is generated. To additionally describe, above the other end section 432 in the figure, and on the right side of the right end section 492 in the figure, there is a possibility that breakage of the panel 400 is generated.

The one end section 431 of the U-shaped section 430A is arranged on one side (in the figure, the region on the left side) of two regions that face each other with the center line CL (the center line along the longitudinal direction of the tab 500, also refer to FIG. 10) of the tab 500 interposed therebetween. On the other hand, the other end section 432 is arranged on the other side (in the figure, the region on the right side) of two regions that face each other with the center line CL interposed therebetween. Moreover, in the exemplary embodiment, the U-shaped section 430A is formed to be linearly symmetric with respect to the center line CL of the tab 500 as a symmetrical axis.

Further, in the exemplary embodiment, the one end section 492 of the linear section 430B and the other end section 432 of the U-shaped section 430A are provided in a state of being separated from each other, and accordingly, between the one end section 492 and the other end section 432, there is provided a discontinuous section where the first score line 430 is not formed. By providing the discontinuous section, a later-described tongue section is not separated from the panel 400, and the tongue section is kept in a state of attaching to the panel 400. Note that, in the exemplary embodiment, as shown in FIG. 12-1, the center line CL of the tab 500 passes through the center portion CP of the panel 400 and the protruding section 420 formed on the panel 400.

In addition, in the exemplary embodiment, in a case where a first virtual line KL1, which is a virtual line that is orthogonal to the above-described center line CL and passes through the protruding section 420 (rivet 900), is assumed, the above-described one end section 431 and the other end section 432 are positioned closer to the center portion CP side of the panel 400 than the first virtual line KL1.

Moreover, in the exemplary embodiment, as shown in FIG. 12-1, the vertex section 433A is positioned in one of two regions that face each other with a second virtual line KL2, which is a virtual line that is orthogonal to the center line CL and passes through the center portion CP of the panel 400, interposed therebetween, and the one end section 431 and the other end section 432 are positioned in the other region.

Further, the protruding section 420 that will become the rivet 900 is provided in a portion, of the panel 400, enclosed by the first score line 430. Moreover, in the U-shaped section 430A, as shown in FIG. 12-1, a curved section 433 is provided. The curved section 433 swells toward the outer peripheral edge 410 side of the panel 400, and passes through a side closer to the outer peripheral edge 410 side of the panel 400 than the protruding section 420. Moreover, the curved section 433 has the vertex section 433A at a location crossing the center line CL.

In the exemplary embodiment, by operation of the tab 500 by a user, the region enclosed by the first score line 430 is pressed by the tab 500, and accordingly, the panel 400 is broken on the location where the first score line 430 is formed (to be described in detail later). This causes the region on which the first score line 430 is formed to be in the tongue shape, and also causes the region to be bent toward the inside of the beverage can 100. Consequently, an opening that plays a role of a place a person drinks from is formed in the beverage can 100.

Note that, in the present specification, hereinafter, the above-described tongue-shaped portion formed by breakage caused on the first score line 430 is referred to as a tongue section, in some cases.

Further, in the exemplary embodiment, on the surface of the panel 400, the second score line 450 is formed. The second score line 450 is also configured with a groove formed on the surface of the panel 400 and plays a role of inducing breakage of the panel 400. Of the two regions facing each other with the first virtual line KL1 interposed therebetween, the second score line 450 is provided in the region where the vertex section 433A (the vertex section 433A of the U-shaped section 430A) is provided.

Moreover, the second score line 450 includes one end section 451 and the other end section 452. Here, the other end section 452 of the second score line 450 is connected to the curved section 433 provided to the first score line 430. Accordingly, in the exemplary embodiment, the score line branches at a location where the first score line 430 and the second score line 450 are connected.

The other end section 452 of the second score line 450 is connected to a portion positioned between the center line CL and the first virtual line KL1 in the curved section 433 of the first score line 430. To describe further, the other end section 452 of the second score line 450 is connected to a portion positioned between the vertex section 433A and the other end section 432 of the first score line 430. Moreover, the other end section 452 of the second score line 450 is connected to, of the first score line 430, a location other than the location where the vertex section 433A is provided.

To describe further, the connecting section of the first score line 430 and the second score line 450 is provided at a location other than a crossing location KP where the center line CL and the U-shaped section 430A cross each other. Moreover, in the exemplary embodiment, the second score line 450 is provided to head toward the inside of the region enclosed by the first score line 430 from the connecting section with the first score line 430.

Moreover, in the exemplary embodiment, the connecting section of the first score line 430 and the second score line 450 is provided closer to a side where the above-described crossing location KP is provided than the first virtual line KL1 arranged in a relation orthogonal to the center line CL. In addition, in the exemplary embodiment, the connecting section of the first score line 430 and the second score line 450 is provided closer to a side where the region RA is positioned than the first virtual line KL1 arranged in a relation orthogonal to the center line CL. To additionally describe, in the exemplary embodiment, the portion of the region RA, of the panel 400, is pressed by the tab 500, and the connecting section of the first score line 430 and the second score line 450 is provided closer to a side where the pressed portion is positioned than the first virtual line KL1. Further, in the exemplary embodiment, the region RA is in a state of being enclosed by the first score line 430.

Moreover, in the exemplary embodiment, the distance between the connecting section of the first score line 430 and the second score line 450 and the one end section 431 of the U-shaped section 430A is larger than the distance between the connecting section and the other end section 432 of the U-shaped section 430A. To describe further, the length of the portion positioned between the one end section 431 of the U-shaped section 430A and the above-described connecting section is longer than the length of the portion positioned between the other end section 432 of the U-shaped section 430A and the above-described connecting section.

Note that, in the exemplary embodiment, the description has been given of a case where the second score line 450 is formed to head in the lower right direction in the figure from the center portion side of the panel 400; however, the second score line 450 may be formed to head in the lower left direction in the figure. In this case, the second score line 450 is connected to a portion positioned between the vertex section 433A and the one end section 431 of the U-shaped section 430A.

Further, the one end section 451 of the second score line 450 is provided in proximity to the protruding section 420. Moreover, the one end section 451 of the second score line 450 is arranged in one of the two regions facing with the centerline CL interposed therebetween, and the other end section 452 of the second score line 450 is arranged in the other one of the two regions. Further, the second score line 450 includes a linear section 453 heading toward the protruding section 420 from the other end section 452. Moreover, the second score line 450 includes a curved section 454 that is connected to the linear section 453 and arranged to have a distance with the protruding section 420 formed into a circular-cylindrical shape, and is formed along the outer peripheral edge of the protruding section 420.

The curved section 454 of the second score line 450 is formed between the protruding section 420 and the U-shaped section 430A. In detail, the curved section 454 is formed between the vertex section 433A of the U-shaped section 430A and the protruding section 420. To additionally describe, on the center line CL, the curved section 454 of the second score line 450 is arranged between the protruding section 420 and the U-shaped section 430A.

Moreover, the curved section 454 is provided to pass between the region RA, of the panel 400, pressed by the tab 500 and the protruding section 420. To additionally describe, in the exemplary embodiment, the second score line 450 is provided to pass through closer to a side where the protruding section 420 (the rivet 900) is provided than the above-described region RA, and also the second score line 450 is provided to pass between the region RA and the protruding section 420.

Moreover, the curved section 454 of the second score line 450 is provided to cross the center line CL. To describe further, the second score line 450 in the exemplary embodiment, after passing between the region RA and the protruding section 420, proceeds along the direction crossing the center line CL, and is connected to the U-shaped section 430 A of the first score line 430.

To describe further, the second score line 450, which proceeds along the direction intersecting the center line CL and toward the U-shaped section 430A, passes beside the region RA. Moreover, the second score line 450, after passing between the region RA and the protruding section 420, proceeds to be gradually separated from the first virtual line KL1, and is connected to the U-shaped section 430A.

Further, in the exemplary embodiment, embossing process to form a recess by pressing a mold is performed on the panel 400, and thereby, on the panel 400, a recessed groove 70 as an example of a recess processing section is formed. Note that, in the exemplary embodiment, the mold is pressed from the first surface 401 side of the panel 400.

The recessed groove 70 is formed within the region, of the panel 400, enclosed by the first score line 430. Moreover, in the exemplary embodiment, as described above, since the mold is pressed from the first surface 401 side of the panel 400, as shown in FIG. 12-1B, the recessed groove 70 is formed so that part of the panel 400 protrudes toward the reverse side of the can lid 300 (on the second surface 402 side of the panel 400, and inside of the beverage can 100).

Note that, in the case where the recessed groove 70 is formed to protrude toward the reverse side of the can lid 300 (inside of the beverage can 300) in this manner, there is a possibility that grit and dust accumulate in the recessed groove 70. Consequently, in the exemplary embodiment, as shown in FIG. 10, the entire recessed groove 70 is positioned behind the tab 500, to thereby cover the recessed groove 70 with the tab 500.

To additionally describe, in the exemplary embodiment, in a case where the panel 400 is viewed from the first surface 401 side of the panel 400, the recessed groove 70 is positioned behind the tab 500 to be hidden, as shown in FIG. 10. To describe further, in the exemplary embodiment, in the case where the panel 400 is viewed from the first surface 401 side of the panel 400, the recessed groove 70 is configured to be positioned inside the outer peripheral edge 501 of the tab 500, as shown in FIG. 10.

This results in suppressing accumulation of grit and dust in the recessed groove 70 as compared to a case in which the recessed groove 70 is exposed. Note that, in the exemplary embodiment, the entire recessed groove 70 is positioned behind the tab 500; however, it may be possible to allow a part of the recessed groove 70 to be positioned behind the tab 500, and the other part thereof to be exposed. In this case, also, accumulation of the grit and dust in the recessed groove 70 is suppressed in this part.

Moreover, as shown in FIG. 12-1A, the recessed groove 70 is formed to enclose the protruding section 420 (the rivet 900). To additionally describe, the recessed groove 70 is formed to enclose an attaching section at which the tab 500 is attached to the panel 400. Further, the recessed groove 70 is formed to enclose the one end section 451, which is a trailing end of the second score line 450. To additionally describe, the recessed groove 70 of the exemplary embodiment is formed into substantially an annular shape, and the protruding section 420 and the one end section 451 of the second score line 450 are arranged inside the recessed groove 70 formed into the annular shape in this manner.

Here, the recessed groove 70 will be described further in detail.

The recessed groove 70 includes, as shown in FIG. 12-1A, one end 71 and the other end 72.

Further, though description has been omitted above, in the exemplary embodiment, the region enclosed by the first score line 430 is divided by the second score line 450; accordingly, a first region 81 is positioned on a lower left side of the second score line 450 in the figure, and a second region 82 is positioned on an upper right side of the second score line 450 in the figure. To additionally describe, in the exemplary embodiment, by dividing the region enclosed by the first score line 430 with the second score line 450, the region enclosed by the first score line 430 results in a configuration provided with the first region 81 and the second region 82 facing each other with the second score line 450 being interposed therebetween. Then, the exemplary embodiment has a configuration in which the one end 71 of the recessed groove 70 is positioned within the first region 81 and the other end 72 of the recessed groove 70 is positioned within the second region 82.

Further, in the exemplary embodiment, with respect to the second score line 450, though the other end section 452 is connected to the first score line 430, the one end section 451 is not connected to the first score line 430; therefore, a non-formation region NE, in which the score line is not formed, is provided between the one end section 451 and the first score line 430. Then, in the exemplary embodiment, the recessed groove 70 is provided to pass through the non-formation region NE. To additionally describe, the recessed groove 70 is formed to proceed toward the other end 72 in a case where the one end 71 is regarded as a starting point, and on that occasion, the recessed groove 70 passes through the above-described non-formation region NE. To additionally describe, when proceeding toward the other end 72 from the one end 71 as the starting point, the recessed groove 70 does not cross the second score line 450, but passes aside the one end section 451 of the second score line 450.

To further describe the recessed groove 70, in the recessed groove 70, there is provided a first linear section 73 that extends in a direction orthogonal to the direction in which the center line CL of the tab 500 extends, and passes between the linear section 430B of the first score line 430 and the protruding section 420. There is further provided a second linear section 74 that is connected to a right end section, in the figure, of the first linear section 73 and extends from a connecting section with this right end section toward the lower side in the figure (toward the second score line 450).

Further, there is provided a third linear section 75 that is connected to a left end section, in the figure, of the first linear section 73 and extends from a connecting section with the left end section toward the lower side in the figure (toward the curved section 433 of the U-shaped section 430A). Further, there is provided a curving line 76 that is connected to a lower end section, in the figure, of the third linear section 75 and extends from a connecting section with the third linear section 75 toward a lower end section, in the figure, of the second linear section 74. The curving line 76 is formed to have curvature and to swell toward the outer peripheral edge 410 side of the panel 400.

FIGS. 12-2A, 12-2B, 12-3A and 12-3B are diagrams showing other configuration examples of the can lid 300.

Figures 1, 14:
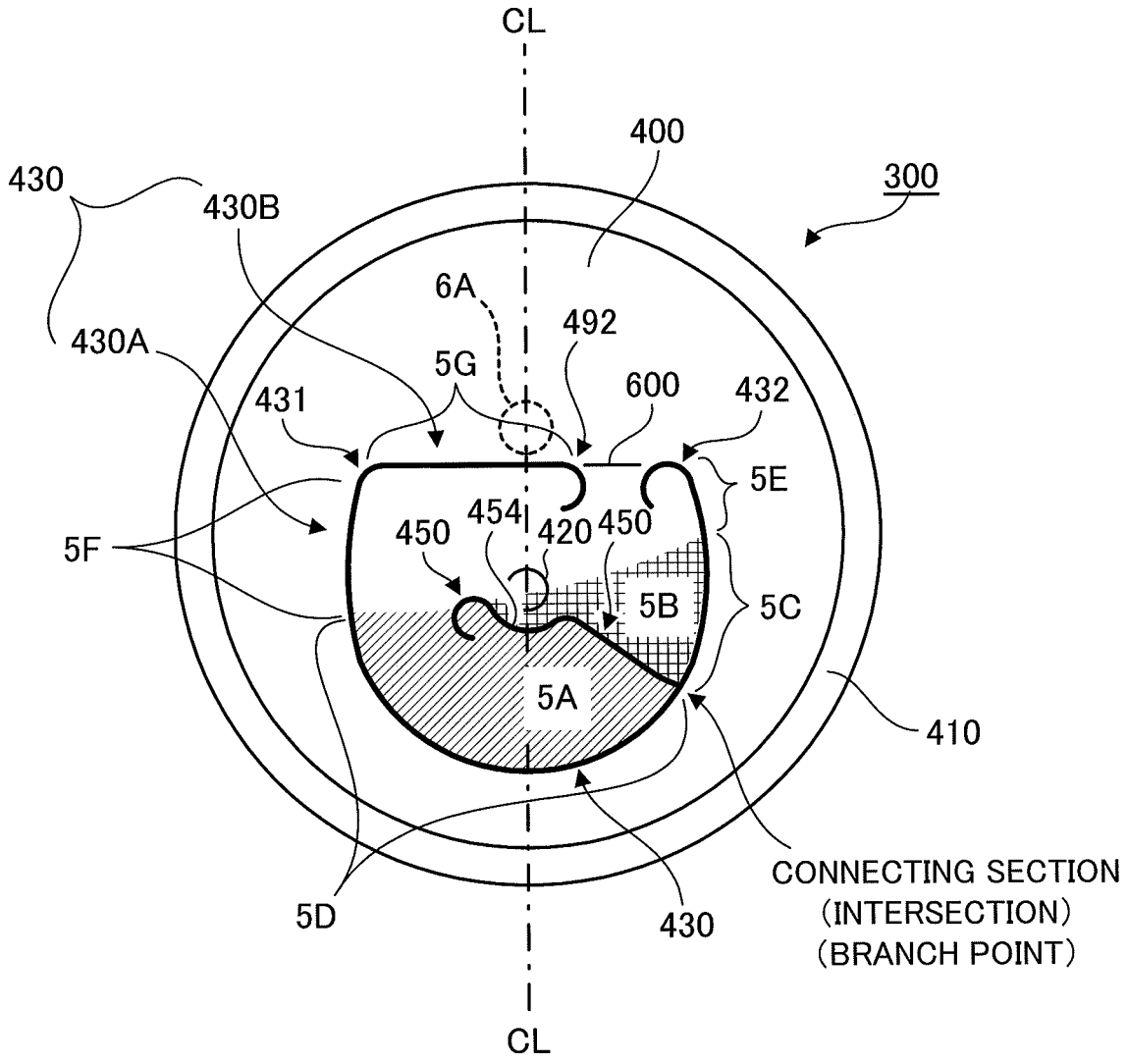
Figures 2, 14:
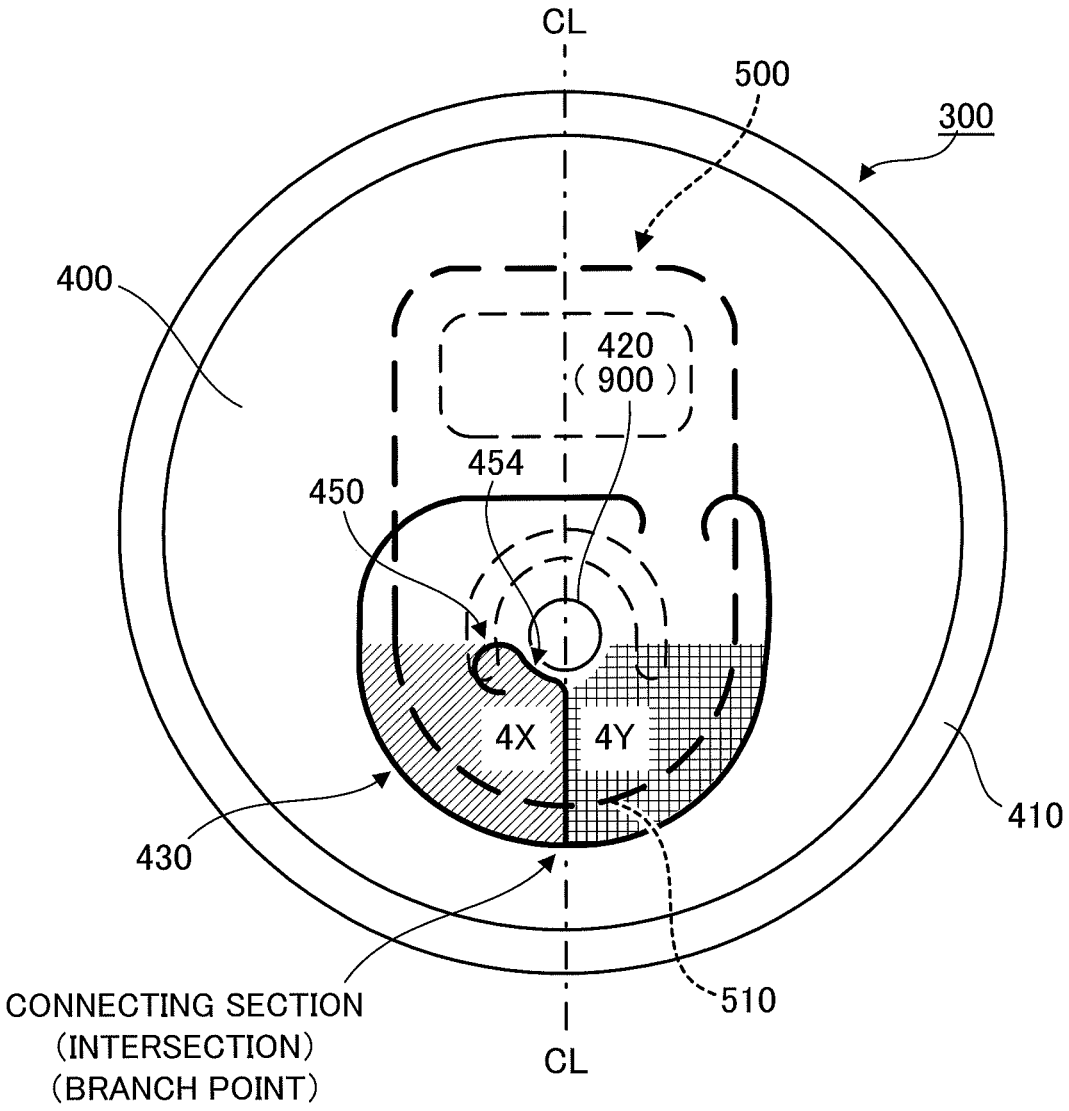

In the configuration example shown in FIG. 12-2, an embodiment of the can lid 300 is shown, in which the above-described recessed groove 70 is annularly provided, and a recessed groove 70 is further provided to the outside of the recessed groove 70. Note that, in the figure, the tab 500 to be arranged is indicated by dotted lines. FIG. 12-2A is a front view, and FIG. 12-2B shows a cross section as viewed from the VII2B direction in FIG. 12-2A. As shown in FIGS. 12-2A and 12-2B, the recessed grooves 70 protrude toward the reverse side of the panel 400 (the second surface 402 side), and further, the tab 500 is arranged to cover the recessed grooves 70.

Figures 3A, 12:
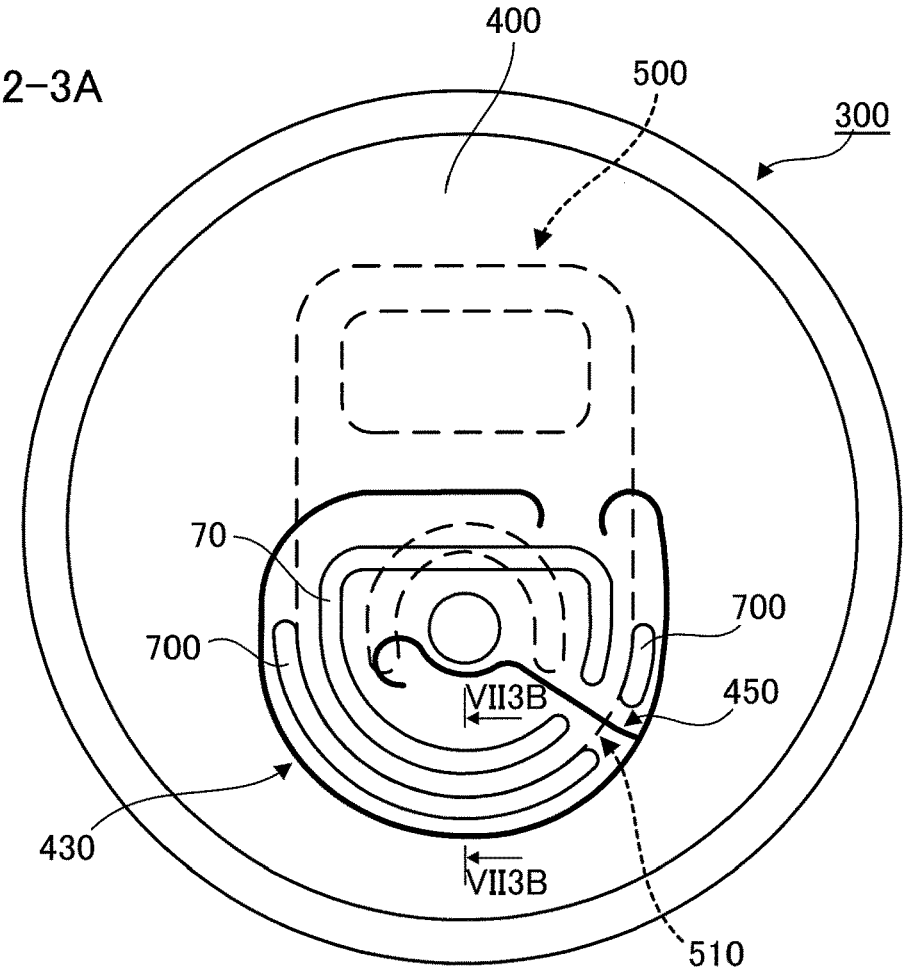
Figures 3B, 12:
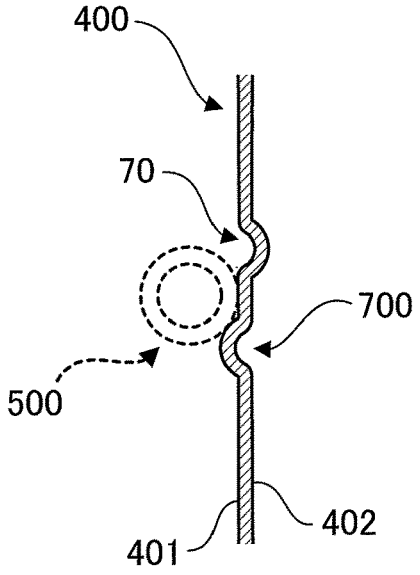

In the configuration example shown in FIG. 12-3, another embodiment of the can lid 300 is shown, in which a recessed groove 700 is further provided to the outside of the recessed groove 70. FIG. 12-3A is a front view, and FIG. 12-3B shows a cross section as viewed from the VII3B direction in FIG. 12-3A. As shown in FIGS. 12-3A and 12-3B, the recessed groove 70 protrudes toward the reverse side of the panel 400 (the second surface 402 side), and further, the tab 500 is arranged to cover the recessed groove 70.

Moreover, the recessed groove 700 is provided to the outside of the recessed groove 70 and an inside of the first score line 430, and further provided to follow the tip end section of the tab 500. Moreover, the recessed groove 700 protrudes toward the front surface side of the panel 400 (toward the first surface 401 side), and accordingly, a side surface of the protruding section generated by formation of the recessed groove 700 and a side surface of the tip end section of the tab 500 are in a state of being in contact with each other. Further, the recessed groove 700 is formed not to cross the second score line 450.

Here, with reference to FIGS. 13A to 13F (the diagrams showing states of the can lid 300 when the tab 500 is operated), the state of the can lid 300 when the tab 500 is operated will be described. Note that, in each of FIGS. 13A to 13F, there are shown two states, namely, a state of the can lid 300 when the can lid 300 is viewed from the front side and a state of the can lid 300 when the can lid 300 is viewed from the lateral side. Moreover, in each of FIGS. 13A to 13F, illustration of the recessed groove 70 and the recessed groove 700 is omitted.

In the exemplary embodiment, when the operated section 505 (the rear end section) of the tab 500 is pulled up by a user, the tip end section 510 of the tab 500 presses the region RA (refer to FIG. 12-1) positioned between the curved section 454 of the second score line 450 and the vertex section 433A of the first score line 430 (the U-shaped section 430A). To additionally describe, in the exemplary embodiment, when the operated section 505 (the rear end section) of the tab 500 is pulled up by a user, the region RA positioned closer to the vertex section 433A than the rivet 900 is pressed by the tab 500. Then, when the region RA is pressed by the tab 500, first, breakage of the panel 400 occurs on the curved section 454 of the second score line 450 provided to pass between the region RA and the rivet 900 (the protruding section 420) (refer to FIG. 13B).

Figure 13A:
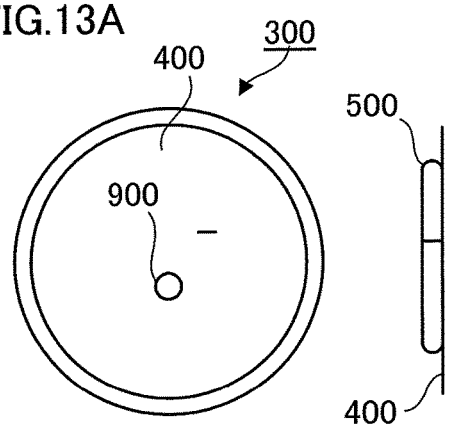
FIGS. 13A to 13F are diagrams showing states of the can lid when the tab is operated.
Figure 13B:
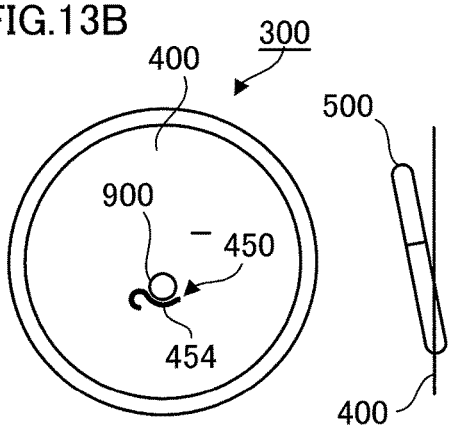
Figure 13C:
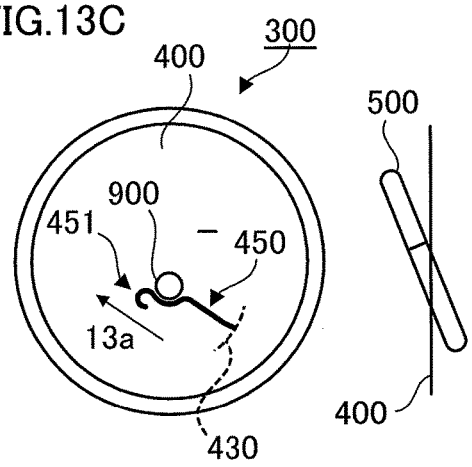

Thereafter, breakage of the panel 400 proceeds along the second score line 450, and, as shown in FIG. 13C, the panel 400 is broken to the connecting section of the first score line 430 and the second score line 450.

Note that, in the exemplary embodiment, when breakage of the panel 400 proceeds along the second score line 450, breakage of the panel 400 proceeds not only in the direction heading toward the connecting section of the first score line 430 and the second score line 450, but also in the direction opposite to the direction heading toward the connecting section. To additionally describe, breakage of the panel 400 also proceeds in the direction indicated by arrow 13*a* in FIG. 13C.

Incidentally, in the exemplary embodiment, as shown in FIG. 13C, the one end section 451 of the second score line 450 is provided with curling, and accordingly, breakage of the panel 400 beyond the one end section 451 is suppressed, and breakage of the panel 400 is stopped at the one end section 451.

Note that, even supposing that the panel 400 breaks beyond the one end section 451, in the exemplary embodiment, the recessed groove 70 is positioned at an extension of the second score line 450 (at a location where the non-formation region NE is positioned) as shown in FIG. 12-1A, and accordingly, proceeding of breakage of the panel 400 is suppressed by the recessed groove 70. To additionally describe, in the exemplary embodiment, as shown in FIG. 12-1A, the recessed groove 70 is positioned around the one end section 451 of the second score line 450; therefore, even if breakage of the panel 400 is generated beyond the one end section 451, proceeding of the breakage is suppressed by the recessed groove 70.

Figure 13D:
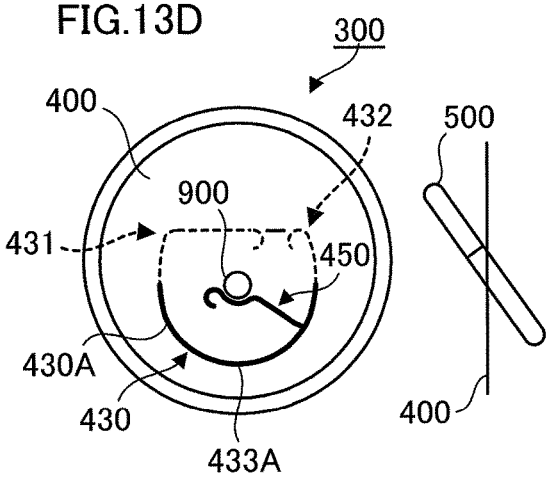

With reference to FIG. 13D, the state of the panel 400 will be described further.

When breakage of the panel 400 proceeds to the connecting section between the first score line 430 and the second score line 450, in the exemplary embodiment, as shown in FIG. 13D, breakage of the panel 400 from the connecting section toward the one end section 431 of the U-shaped section 430A and breakage of the panel 400 from the connecting section toward the other end section 432 of the U-shaped section 430A further proceed.

Figure 13E:
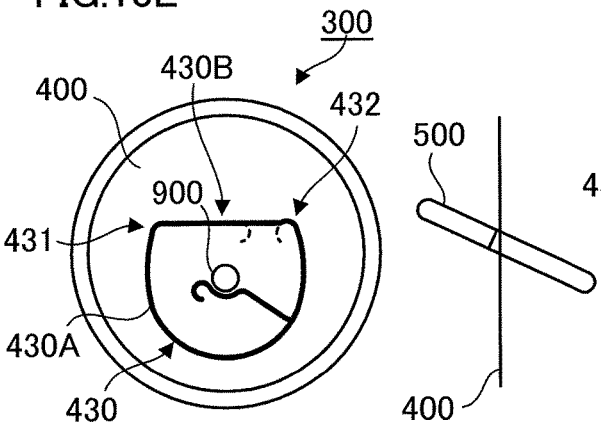

Thereafter, in the exemplary embodiment, the tab 500 is pressed into an inward direction of the beverage can 100 by the user. Consequently, as shown in FIG. 13E, breakage of the panel 400 further proceeds to the one end section 431 and the other end section 432 of the U-shaped section 430A. Further, breakage of the panel 400 along the linear section 430B proceeds.

This causes the region enclosed by the first score line 430 to become the tongue section. In addition, the tongue section is bent at a basal part of the tongue section (the location positioned between the right end section 492 of the linear section 430B (refer to FIG. 12-1A) and the other end section 432 of the U-shaped section 430A), and the tongue section enters into the inside of the beverage can 100. Consequently, the can lid 300 is brought into a state in which an opening that functions as a place a person drinks from is formed.

Note that the exemplary embodiment has a configuration in which the rivet 900 (the protruding section 420) is provided to the tongue section, and thereby it becomes possible to make the opening (the place a person drinks from) to be formed larger. In an ordinary can lid, the opening is formed at a location other than the location where the rivet is provided; therefore, if there is a rivet, it is required to make the opening small for the rivet. In the exemplary embodiment, the location where the rivet is provided is also formed as the opening, and accordingly, it is possible to make the opening larger.

Figure 13F:
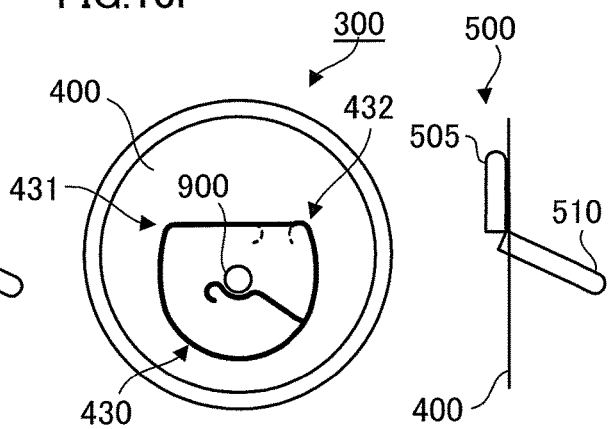

With reference to FIG. 13F, the state of the can lid 300 will be described.

After the opening is formed, the tab 500 is further operated by the user. Specifically, operation of returning the tab 500 is carried out, and, as shown in FIG. 13F, the operated section 505 side of the tab 500 is bent. This causes the operated section 505 side of the tab 500 to follow the panel 400 of the can lid 300. In this case, there is no protrusion on the operated section 505 side, and accordingly, it becomes easy for the user to drink the inside beverage, as compared to a case where the operated section 505 protrudes.

Here, in the exemplary embodiment, by bending the tab 500 in this manner, a state in which the tip end section 510 of the tab 500 is inserted into the inside of the beverage can 100 is maintained. To additionally describe, even if the tab 500 that has been pulled up is laid down to follow the panel 400, since only the operated section 505 side of the tab 500 is bent, the state in which the tip end section 510 of the tab 500 is inserted into the inside of the beverage can 100 is maintained. This prevents the opening having been formed from being blocked by the tip end section 510 of the tab 500, and accordingly, the opening grows wider.

Note that, in the exemplary embodiment, description has been given by taking the bendable tab 500 as an example; however, it is possible to use an unbending tab 500 as a matter of course. Note that, in the case where the unbending tab 500 is used, it is desirable to reduce a protruding amount of the operated section 505 of the tab 500. To additionally describe, it is preferable to make the portion indicated by the reference sign 1A in FIG. 10 small.

In the case where the unbending tab 500 is used, it is assumed that the inside beverage is drunk in the state where the operated section 505 of the tab 500 protrudes from the surface of the panel 400; however, by reducing the protruding amount of the operated section 505, the user is allowed to drink the inside beverage with ease, as compared to the case where the protruding amount is large.

Alternatively, in FIG. 12-1A, by making a distance between the first virtual line KL1 passing through the protruding section 420 (the rivet 900) and the linear section 430B larger, the tab 500 deeply enters into the can, to thereby make it possible to reduce the protruding amount of the operated section 505.

Here, breakage of the panel 400 caused on the first score line 430 and the second score line 450 will be further described with reference to FIG. 14-1 (a diagram for illustrating breakage of the panel 400).

In the exemplary embodiment, as described above, when the operated section 505 of the tab 500 is pulled up by a user, the region RA (refer to FIG. 12-1A) positioned between the curved section 454 of the second score line 450 and the vertex section 433A of the first score line 430 (the U-shaped section 430A) is pressed by the tab 500. This causes, first, breakage of the panel 400 at the curved section 454 of the second score line 450.

Thereafter, breakage of the panel 400 proceeds along the second score line 450, and the panel 400 is broken to the connecting section of the first score line 430 and the second score line 450. After that, the panel 400 is broken on the first score line 430. Specifically, as shown in FIG. 14-1, of the first score line 430, breakage of the panel 400 is generated in a region indicated by the reference sign 5C.

To describe in detail, in the exemplary embodiment, the tab 500 is pressed against the region RA, and thereby the region RA is pressed into the inward direction of the beverage can 100; at this time, the protruding section 420 is pulled by the tab 500 to an outward direction of the beverage can 100 (to the frontward direction in FIG. 14-1). This pulls the portion indicated by the reference sign 5B in FIG. 14-1 to the outward direction of the beverage can 100. Note that, hereinafter in the present specification, the portion indicated by the reference sign 5B is referred to as "pulled portion 5B".

As a result, a shearing force acts on the region indicated by the reference sign 5C, and thereby the panel 400 is broken in the region indicated by the reference sign 5C. To additionally describe, the panel 400 is broken in the portion, of the first score line 430, positioned closer to the other end section 432 side than the connecting section. Note that, if the panel 400 is broken at a portion positioned closer to the other end section 432 side than the connecting section in this manner, the pulled portion 5B floats from the panel 400, and with this, the tab 500 also comes to move upwardly (in the direction apart from the panel 400) from an initial position.

Moreover, in the exemplary embodiment, pressing of the tab 500 against the region RA is continued, and by the pressing, a portion, of the panel 400, indicated by the reference sign 5A (hereinafter, this portion is referred to as "pressed portion 5A") is pressed toward the inward direction of the beverage can 100. Consequently, a shearing force acts on the region indicated by the reference sign 5D, and thereby the panel 400 is broken in the region indicated by the reference sign 5D. To additionally describe, the panel 400 is broken in the portion, of the U-shaped section 430A, positioned closer to the one end section 431 side than the connecting section.

Note that, in the exemplary embodiment, as described above, the recessed groove 70 (not shown in FIG. 14-1) is provided; accordingly, as compared to a case where the recessed groove 70 is not provided, pressing against the region RA (the pressed portion 5A) by the tab 500 is performed with more reliability. To additionally describe, in the exemplary embodiment, when the region indicated by the reference sign 5D is acted upon by the shearing force, pressing against the region RA by the tab 500 is performed with more reliability.

Here, in the exemplary embodiment, as described above, when the panel 400 is broken at the region indicated by the reference sign 5C, the pulled portion 5B comes to float; however, if the recessed groove 70 is provided, the floating amount of the pulled portion 5B from the panel 400 is reduced. To additionally describe, since, if the recessed groove 70 is provided, the bending stiffness in the region, of the panel 400, enclosed by the first score line 430 is increased, the enclosed region becomes less likely to be deformed, and therefore, the floating amount of the pulled portion 5B from the panel 400 is reduced.

Then, in this case, pressing against the region RA by the tab 500 is performed with more reliability. To additionally describe, if the floating amount of the pulled portion 5B from the panel 400 is reduced, the tip end section 510 of the tab 500 is prevented from largely separating from the region RA, and thereby reduction of load acting on the region RA from the tip end section 510 is suppressed. Then, in this case, breakage of the panel 400 is generated in a region indicated by the reference sign 5D with more reliability.

In the case of viewing FIG. 10, when the operated section 505 of the tab 500 is pulled up by the user, the tip end section 510 presses the region RA of the panel 400 with the rivet 900 as a fulcrum, to thereby form an opening. If this is viewed in FIG. 14-1, the protruding section 420, which is the rivet 900, exists within the region of the pulled portion 5B, and the region RA is within the region of the pressed portion 5A.

When the operated section 505 is pulled up for forming the opening, the tip end section 510 comes to press down the pressed portion 5A, and the rivet 900 comes to float the pulled portion 5B. Consequently, in the process of forming the opening, the pressed portion 5A and the pulled portion 5B move in the directions different from each other.

On the other hand, since opening proceeds by pressing by the tip end section 510, the proceeding amount (the pressing amount) of the tip end section 510 against the panel 400 stays within the distance between the rivet 900 and the tip end section 510 as a limit. Accordingly, if the floating amount of the pulled portion 5B is increased, the rivet 900 largely floats when the tab 500 is pulled up, and there occurs a possibility that the tip end section 510 of the tab 500 becomes unable to press the region RA. For this reason, it is desirable that the floating amount of the pulled portion 5B is small.

Here, if the recessed groove 70 is not formed and the pulled portion 5B is more likely to float, the tip end section 510 of the tab 500 is separated from the panel 400, and in this case, the load from the tab 500 is less likely to act on the panel 400. Then, in this case, breakage of the panel 400 in the region indicated by the reference sign 5D is hardly generated.

Note that, in the exemplary embodiment, as described above, the recessed groove 70 is formed in a state in which a part of the panel 400 protrudes toward the reverse side of the can lid 300 (toward the inside of the beverage can 100). Here, for example, if the recessed groove 70 is formed in a state in which a part of the panel 400 protrudes toward the front side of the can lid 300 (toward the outside of the beverage can 100), there is a possibility that the opening is apt to be formed in transporting the beverage can 100.

Here, in transportation, beverage cans 100 filled with contents are stacked in some cases, and in this case, there is a possibility that a tab 500 of a beverage can 100 positioned below is pressed by a beverage can 100 positioned above. In such a case, if the recessed groove 70 is formed in a state in which a part of the panel 400 protrudes toward the front side of the can lid 300, there is a possibility that the recessed groove 70 is pressed by the tab 500, and with this, breakage of the panel 400 is generated.

Moreover, in the above, the mode in which the recessed groove 70 is formed behind the tab 500 (the opposite position) has been described; however, a mode in which the recessed groove 70 is not positioned behind the tab 500, but exposed can be considered. By the way, also in this mode, if the recessed groove 70 is formed in a state in which a part of the panel 400 protrudes on the front surface side of the can lid 300, there is a strong possibility that the surface of the can lid 300 is pressed by other members or the like, and breakage of the panel 400 is likely to be generated.

On the other hand, as in the exemplary embodiment, if the recessed groove 70 is formed in a state in which a part of the panel 400 protrudes on the reverse side of the can lid 300, the panel 400 is less likely to be pressed even though the user does not intend, and along this, formation of opening on the can lid 300 without the user's intention is less likely to occur.

In addition, the exemplary embodiment has a configuration omitting an embossed bead by a similar reason. Here, the embossed bead means a convex portion that protrudes on the front surface side of the can lid 300 (the outside of the beverage can 100) formed by the embossing process. Then, the embossed bead is usually provided at a location pressed by the tip end portion 510 of the tab 500.

Here, in the case where the embossed bead is provided, pressing of the panel 400 by the tab 500 is started in a state in which an angle which the tab 500 forms with the panel 400 is smaller. Then, in this case, it becomes possible to press the tongue portion into the beverage can 100 deeper, and accordingly, the opening to be formed becomes larger.

By the way, in the case where such an embossed bead is provided, similar to the case where the recessed groove 70 is formed to be convex on the front surface side of the can lid 300, the opening is likely to be formed in transporting the beverage cans 100. On the other hand, as in the exemplary embodiment, in the case of the configuration omitting the embossed bead, unintended formation of the opening like this is less likely to occur.

With reference to FIG. 14-1 again, breakage of the panel 400 will be described further.

After breakage is generated to the region indicated by the reference sign 5D, in the exemplary embodiment, the tab 500 is pressed into an inward direction of the beverage can 100 by the user. This further causes breakage of the panel 400 on the first score line 430. Specifically, the panel 400 is broken in two regions, namely, a region indicated by the reference sign 5E and a region indicated by the reference sign 5F in the figure. Further, breakage of the panel 400 is generated also in a region indicated by the reference sign 5G in the figure (the location where the linear section 430B is provided).

Further, in the exemplary embodiment, the tongue section is bent at a basal part of the tongue section (the location positioned between the right end section 492 of the linear section 430B and the other end section 432 of the U-shaped section 430A). Consequently, the tongue section enters into the inside of the beverage can 100, and thereby the opening is formed in the beverage can 100.

Here, in the exemplary embodiment, since the linear section 430B is provided to be connected to the U-shaped section 430A, breakage of the panel 400 from the U-shaped section 430A is continued to breakage of the panel 400 at the linear section 430B, to thereby make it easy to form the tongue section, and accordingly, further, operation load of the tab 500 when the tongue section is bent is reduced.

Here, in the case where the linear section 430B is not provided but only the U-shaped section 430A is formed, a region of the panel 400 that requires bending becomes large, and accordingly, the operation load of the tab 500 is apt to be large.

Particularly, in the configuration of the exemplary embodiment, the location where the tab 500 is attached is the tongue section, and therefore, it is difficult to press the tongue section by use of the principle of leverage. To additionally describe, in a case where the location where the tab 500 is attached exists on the outer side of the first score line 430, such as the location indicated by the reference sign 6A in FIG. 14-1, the principle of leverage can be applied; however, as in the exemplary embodiment, if the tab 500 is attached to the tongue section, it becomes impossible to use the principle of leverage. Then, in the case where the principle of leverage is unable to be used like this, the operation load of the tab 500 is apt to be large. On the other hand, in the exemplary embodiment, since there is provided the linear section 430B, parts required to be bent is reduced; accordingly, the operation load of the tab 500 is prevented from becoming large.

Note that, though description has been omitted above, the linear section 430B of the exemplary embodiment is, as shown in FIG. 12-1A, provided to reach a location beyond the center line CL of the tab 500 in a case where the connecting location with the one end section 431 of the U-shaped section 430A is regarded as the starting point. To additionally describe, the linear section 430B is formed so that a part thereof reach a location beyond a straight line that passes through the vertex section 433A of the U-shaped section 430A and the protruding section 420 (the location where the tab 500 is attached) and extends.

In this case, as compared to a configuration in which the linear section 430B does not reach the location beyond the center line CL of the tab 500, the region of the tongue section that requires to be bent can be reduced, and therefore, it becomes possible to reduce the operation load of the tab 500.

Moreover, in the exemplary embodiment, as shown in FIG. 12-1A, description has been given by taking the case in which the linear section 430B is provided to be parallel with the first virtual line KL1 or the second virtual line KL2 as an example; however, the linear section 430B may be provided to be inclined with respect to the first virtual line KL1 or the second virtual line KL2. In addition, in the exemplary embodiment, description has been given by taking the case in which the linear section 430B is formed linearly as an example; however, the linear section 430B is partially or entirely provided with curvature.

Moreover, in the exemplary embodiment, when breakage of the panel 400 is generated on the first score line 430, as described above and as shown in FIG. 14-1, first, breakage of the panel 400 is generated on the side closer to the other end section 432 than the connecting section (the region indicated by the reference sign 5C), and subsequently, breakage of the panel 400 is generated on the side closer to the one end section 431 than the connecting section (the region indicated by the reference sign 5D). Consequently, in the exemplary embodiment, an operation load when the user operates the tab 500 is reduced.

Here, for example, in a case where breakage of the panel 400 is generated simultaneously on both sides, namely, on the side closer to the one end section 431 than the connecting section and on the side closer to the other end section 432 than the connecting section, breakage of the panel 400 comes to be generated simultaneously in two locations. In such a case, with respect to the tab 500, it becomes necessary to apply the operation load required for breakage in two locations, and accordingly, the operation load on the tab 500 is increased.

On the other hand, in the exemplary embodiment, first, breakage of the panel 400 is generated on the side closer to the other end section 432 than the connecting section, and subsequently, breakage of the panel 400 is generated on the side closer to the one end section 431 than the connecting section. In this case, it is sufficient to apply the operation load required for breakage in one location on the tab 500, and the operation load on the tab 500 is reduced, as compared to the case in which the panel 400 is broken in two locations simultaneously.

Further, in the exemplary embodiment, the above-described connecting section is provided at a location deviated from the center line CL, to thereby reduce the operation load of the tab 500. Here, for example, in a case where the above-described connecting section is positioned on the center line CL, breakage of the panel 400 from the connecting section toward the one end section 431 and breakage of the panel 400 from the connecting section toward the other end section 432 are likely to occur at the same timing. In such a case, there occurs a state in which breakage of the panel 400 is generated at two locations and simultaneously, and thereby the operation load of the tab 500 is increased as compared to the case where breakage of the panel 400 is generated at a single location.

Moreover, in the exemplary embodiment, since the connecting section between the first score line 430 and the second score line 450 is not on the center line CL, the pressed portion 5A and the pulled portion 5B move in the directions different from each other, to thereby form the opening. In contrast thereto, in the case where the connecting section between the first score line 430 and the second score line 450 is on the center line CL as shown in FIG. 14-2 (the diagram showing another mode of the can lid 300), two regions on the panel 400 are simultaneously pressed by the tip end section 510 of the tab 500.

Here, as shown in FIG. 14-2, it is assumed that the regions within the first score line 430 to be divided by the second score line 450 are 4X and 4Y. At this time, since the longitudinal direction of the tab 500 (the dotted line) is provided to follow the center line CL, the portions 4X and 4Y are configured to be positioned on the reverse side of the tip end section 510 of the tab 500. Accordingly, the portions on the panel 400 to be pressed by the tip end section 510 by the operation of the tab 500 are 4X and 4Y. Note that, hereinafter, these portions will be referred to as a pressed portion 4X and a pressed portion 4Y.

In the mode shown in FIG. 14-2, when the tab 500 is operated, first, breakage of the panel 400 is started from the curved section 454. Thereafter, breakage of the panel 400 reaches the connecting section on the first score line 430 by way of the second score line 450. After reaching the connecting section, breakage of the panel 400 by the first score line 430 proceeds at the two locations of the pressed portion 4X and the pressed portion 4Y simultaneously. In other words, breakage of the panel 400 at the portions subsequent to the connecting section proceeds by pressing of the two locations of the pressed portion 4X and the pressed portion 4Y simultaneously by the tip end section 510. Consequently, as compared to the case where one location is pressed, the operation load of the tab 500 is increased.

On the other hand, in the exemplary embodiment, the portion to be pressed by the tip end section 510 of the tab 500 is only one location, namely, the pressed portion 5A. At this time, the load applied to the pulled portion 5B is the load received by the protruding section 420 (the rivet 900) as a reaction force of the load to press the panel 400 by the tip end section 510, and accordingly, there is no need to have a new external force for the pulled portion 5B. Consequently, in the exemplary embodiment, it is sufficient to apply the operation load required for breakage in one location, namely, the pressed portion 5A on the tab 500, and the operation load on the tab 500 is reduced, as compared to the case in which the connecting section exists on the center line CL.

Here, the recessed groove 70 and the recessed groove 700 formed on the panel 400 will be studied.

In FIG. 12-1, the portion of the panel 400 that enters into the can by forming the opening is the region enclosed by the first score line 430. At this time, the region enclosed by the first score line 430 is divided into the pressed portion 5A and the pulled portion 5B (refer to FIG. 14-1) by the second score line 450, which move in the directions opposite to each other, to thereby form the opening. At this time, it is desirable that the moving amount of the pulled portion 5B is small. Therefore, as compared to the case where no recessed groove 70 is provided, the bending stiffness of the pressed portion 5A and the pulled portion 5B is increased in the case where the recessed groove 70 is provided; accordingly, it is desirable to provide the recessed groove 70. In FIG. 12-2, the recessed groove 70 is increased, and therefore the bending stiffness of the pressed portion 5A and the pulled portion 5B is further increased, as compared to the case shown in FIG. 12-1.

In FIG. 12-3, similar to the case shown in FIG. 12-2, there are provided plural recessed grooves 70; however, as shown in FIG. 12-3A, the recessed groove 700 is not formed on the reverse side of the tab 500, but is formed to enclose the periphery of the tip end section 510 at the outside of the tip end section 510 of the tab 500. Moreover, as shown in FIG. 12-3B, the protruding direction of the recessed groove 700 is the front surface side of the panel 400, although the protruding direction of the recessed groove 70 is the reverse side of the panel 400.

In this case, since the tab 500 is arranged on the front surface of the panel 400 of the recessed groove 70, in the sense of avoiding contact of the recessed groove 70 with the tab 500, this direction is desirable (it is desirable that the protruding direction of the recessed groove 70 is the reverse side of the panel 400).

On the other hand, the protruding direction of the recessed groove 700 is the front surface side of the panel 400, and on the same front surface side of the panel 400, the tab 500 is arranged. Further, the side surface of the tab 500 and the side surface of the recessed groove 700 (the side surface of a protrusion generated by formation of the recessed groove 700) are in the close state to each other.

Here, as compared to the case where the recessed groove 70 and the recessed groove 700 are not provided, the bending stiffness of the pressed portion 5A and the pulled portion 5B is improved in the case where the recessed groove 70 and the recessed groove 700 are provided. Further, since the recessed groove 700 is formed to enclose the tab 500, and thereby the side surfaces thereof are in a state of being close in distance to each other, there is an effect of keeping the position of the tab 500 and preventing the tab 500 from rotating around the rivet 900. In the manufacturing process of the can lid 300, the tab 500 is arranged on the panel 400, and thereafter, an upper section of the rivet 900 is flattened to fasten the tab 500 onto the can lid 300.

At this time, in the case of the exemplary embodiment, a center position of the tab 500 is determined by the protruding section 420 (the rivet 900), orientation of the tab 500 is determined by the recessed groove 700, and thereby the tab 500 is precisely arranged on the panel 400. Moreover, during the period when the tip end section 510 of the tab 500 is in contact with the recessed groove 700, there is provided an effect of suppressing rotation of the tab 500 even in the middle of the process of forming the opening. Therefore, rotation of the tab 500 is suppressed even in the middle of the process of forming the opening.

Here, in a case where the side surface of the recessed groove 700 and the side surface of the tip end section 510 of the tab 500 are in contact with each other, there is no possibility of forming the opening on the panel 400 by the tab 500. This is because, since side surfaces are in contact with each other, a force in the horizontal direction is mainly applied to the panel 400, but a force in the vertical direction that encourages formation of opening is less likely to be applied to the panel 400, and even supposing a case in which the side surfaces are brought into contact, a reactive force from the side surface owing to the contact is mainly a force in the horizontal direction applied to the panel 400, which becomes a force applied to escape from the contact with each other, to be thereby resolved by rotation of the tab 500 around the rivet 900.

Note that the recessed groove 700 and the tab 500 may be arranged to bring them into a state in which the side surface of the recessed groove 700 and the side surface of the tip end section 510 of the tab 500 are always in contact with each other, or the recessed groove 700 and the tab 500 may be arranged in a state in which a gap is formed between the side surface of the recessed groove 700 and the side surface of the tip end section 510 of the tab 500. Even though the gap is formed in this manner, when the tab 500 is rotated, the tab 500 bumps into the side surface of the recessed groove 700, and accordingly, rotation of the tab 500 is restricted. Moreover, even though the gap is formed, if the gap is small, the recessed groove 700 sufficiently functions as a positioning section.

Note that, though description thereof was omitted above, in the exemplary embodiment, as shown in FIGS. 12-1 and 14-1, the groove 600 (not a groove that encourages breakage like the score line, but a groove that facilitates bending (a groove that is shallower and wider than the score line)) is provided in the region positioned between the right end section 492 of the linear section 430B and the other end section 432 of the U-shaped section 430A (at a basal part of the tongue section).

The groove 600 is formed to head from the side on which the right end section 492 is provided toward the side on which the other end section 432 is provided. Consequently, in the exemplary embodiment, bending of the tongue section is more likely to occur. Note that the groove 600 is not necessarily required and the groove 600 may be omitted. Moreover, the groove 600 is not limited to be linearly formed, but may be formed with curvature.

Note that a mode, in which the groove 600 is extended without providing the linear section 430B, to provide the groove 600 between the one end section 431 and the other end section 432, can be considered. By the way, in this case, breakage of the panel 400, which has proceeded along the first score line 430 up to the one end section 431 and the other end section 432, stops when reaching the one end section 431 and the other end section 432, and accordingly, breakage of the panel 400 is not generated between the one end section 431 and the other end section 432. In such a case, as compared to the case in which the groove 600 is not at all provided, the operation load of the tab 500 is reduced; however, as compared to the case in which the linear section 430B is provided, the operation load of the tab 500 is increased.

Figure 15:
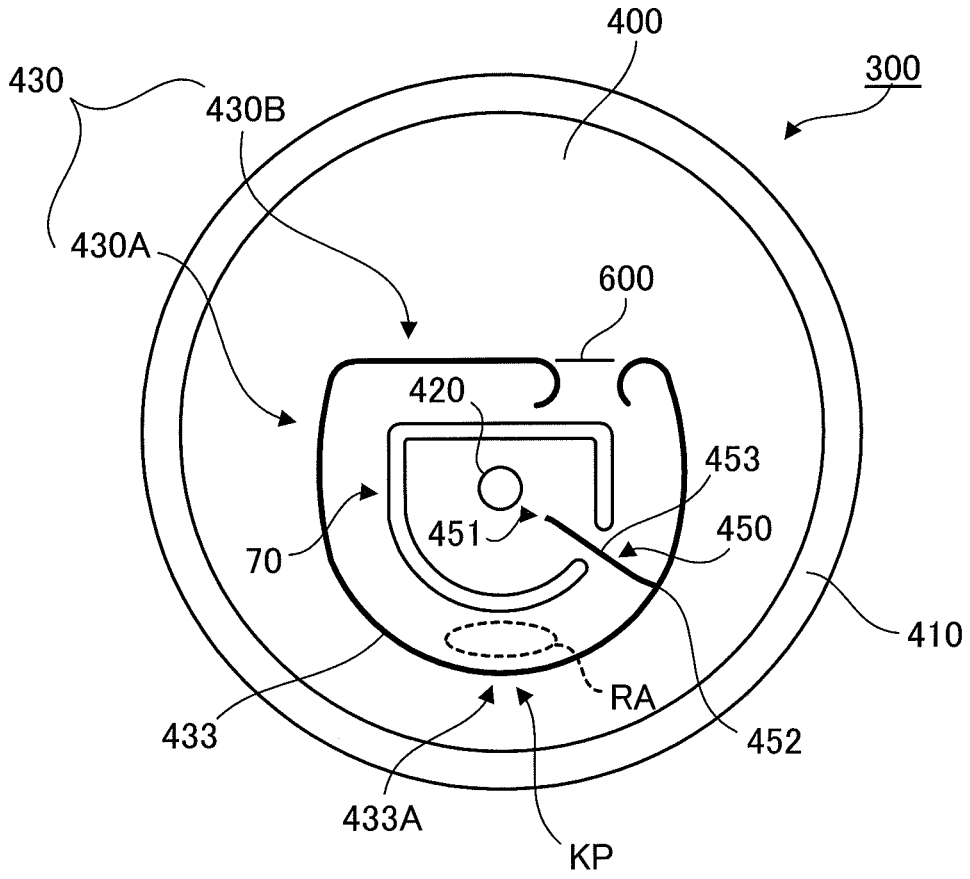
FIG. 15 is a diagram showing another configuration example of the can lid.

Moreover, in the exemplary embodiment, as described above, a case in which the second score line 450 is provided to pass between the region RA and the protruding section 420 has been exemplified; however, the mode of arranging the second score line 450 is not limited to the mode like this. For example, as shown in FIG. 15 (a diagram showing another configuration example of the can lid 300), a second score line 450 that does not pass between the region RA and the protruding section 420 may be provided. Further, the form of the second score line 450 is not particularly limited, too, and the second score line 450 may be provided with curvature.

Figure 16:
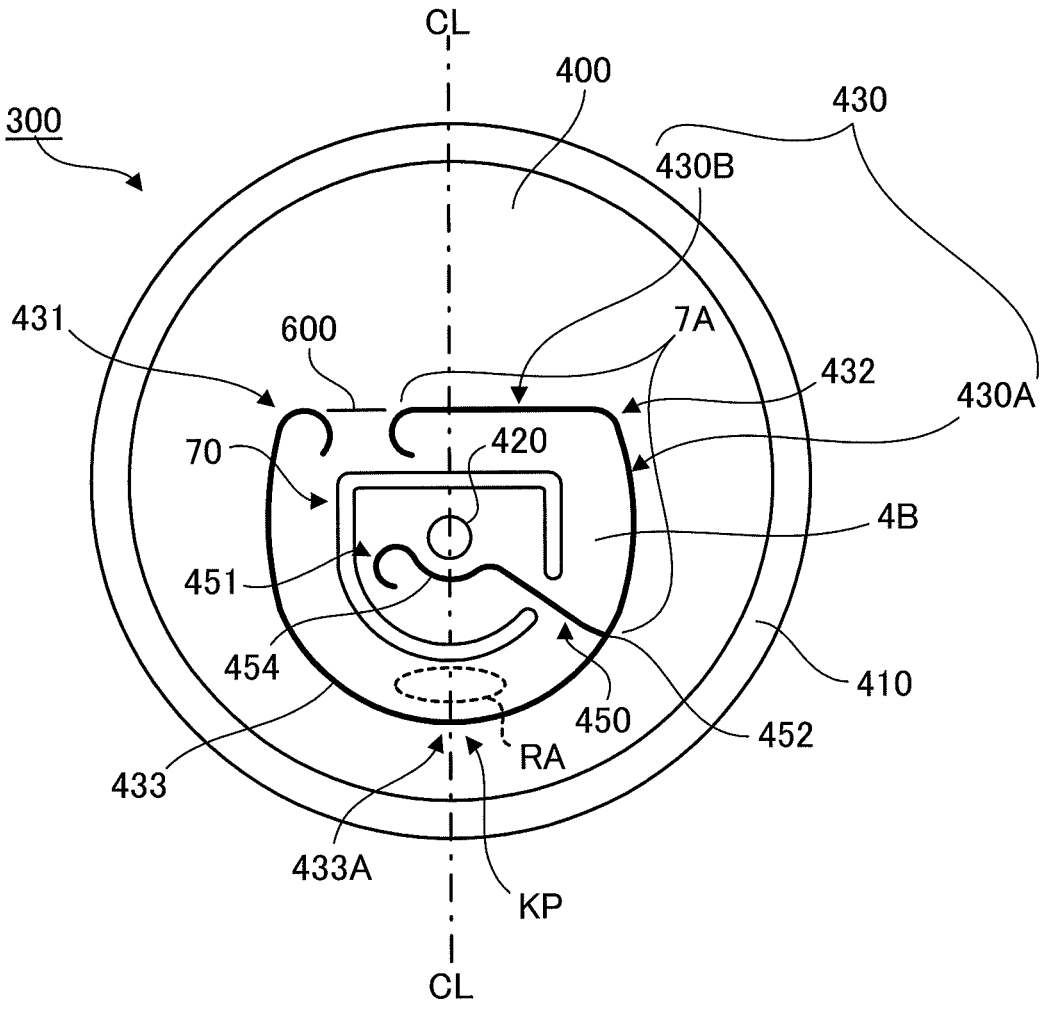
FIG. 16 is a diagram showing still another configuration example of the can lid.

FIG. 16 is a diagram showing still another configuration example of the can lid 300.

In the above-described exemplary embodiment, description has been given by taking a case, in which the linear section 430B is connected to the one end section 431 of the U-shaped section 430A and the linear section 430B is formed to head toward the other end section 432 from the one end section 431 of the U-shaped section 430A, as an example. Incidentally, as shown in FIG. 16, the linear section 430B may be connected to the other end section 432, to thereby form the linear section 430B to head toward the one end section 431 side from the other end section 432. In this case, also, it is possible to reduce the bending region in bending the tongue section, and accordingly, the operation load of the tab 500 is reduced.

Note that, in the above-described mode shown in FIG. 12-1 or the like, rather than in the mode shown in this figure, movement of the tip end section 510 of the tab 500 in the direction away from the surface of the panel 400 is suppressed, and in the above-described mode shown in FIG. 12-1 or the like, rather than in the mode shown in this figure, breakage of the panel 400 in the above-described region indicated by the reference sign 5D (refer to FIG. 14-1) is more likely to be generated.

Here, in the exemplary embodiment, as described above, the pulled portion 5B (refer to FIG. 14-1) comes to float from the surface of the panel 400 when the opening is formed; however, in the mode shown in FIG. 16, on that occasion, there is a possibility of occurrence of breakage of the panel 400 in the region indicated by the reference sign 7A, for example, and, in this case, the floating amount of the pulled portion 5B from the panel 400 is extremely increased. Then, in this case, the tip end section 510 of the tab 500 is separated from the panel 400, and therefore, there occurs a possibility that breakage of the panel 400 becomes difficult in the above-described region indicated by the reference sign 5D (refer to FIG. 14-1).

On the other hand, in the above-described mode shown in FIG. 12-1 or the like, the floating amount of the pulled portion 5B is reduced, and thereby, the tip end section 510 of the tab 500 is positioned at a location closer to the panel 400, as compared to the mode shown in FIG. 16. Then, in this case, as compared to the mode shown in FIG. 16, breakage of the panel 400 in the above-described region indicated by the reference sign 5D is more likely to be generated.

Figure 17:
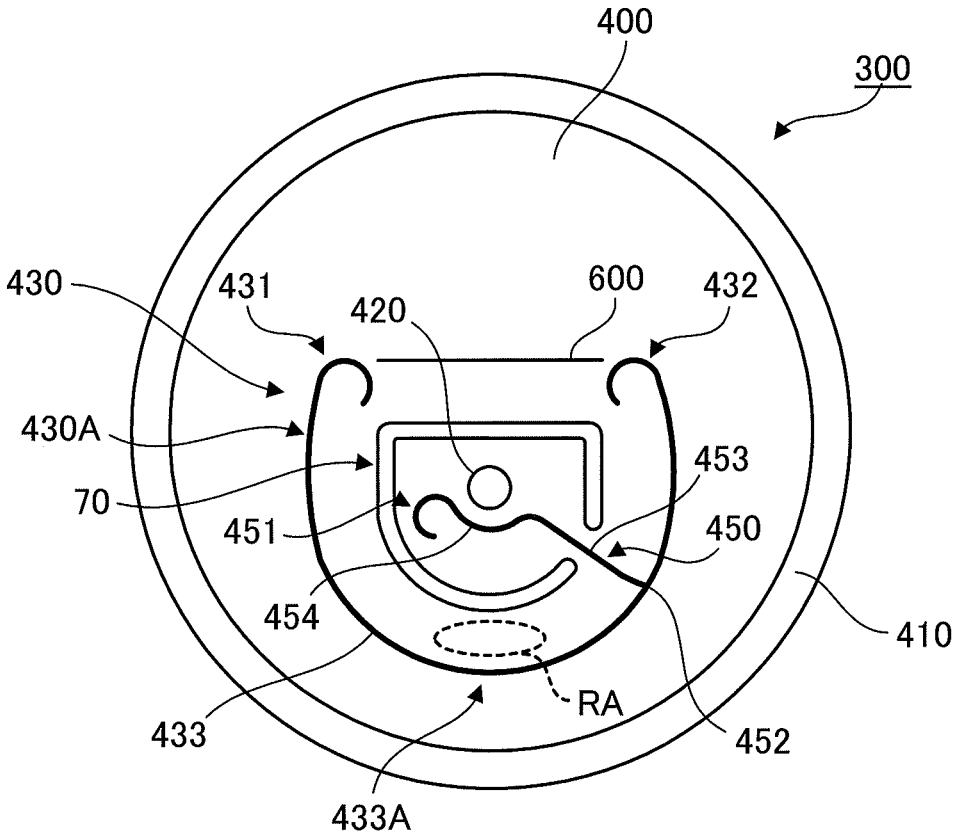
FIG. 17 is a diagram showing still another configuration example of the can lid.

Note that, in the above, description has been given by taking the case, in which the first score line 430 is configured with the U-shaped section 430A and the linear section 430B, as an example; however, as shown in FIG. 17 (a diagram showing still another configuration example of the can lid 300), the linear section 430B may be omitted and the first score line 430 may be configured only with the U-shaped section 430A. However, in this configuration example, as described above, breakage of the panel 400 that has proceeded is stopped at the one end section 431 and the other end section 432, and therefore, as compared to the case in which the linear section 430B is provided, the operation load of the tab 500 is increased.

Third Exemplary Embodiment

Hereinafter, an exemplary embodiment according to the present invention will be described in detail with reference to attached drawings.

Figure 18:
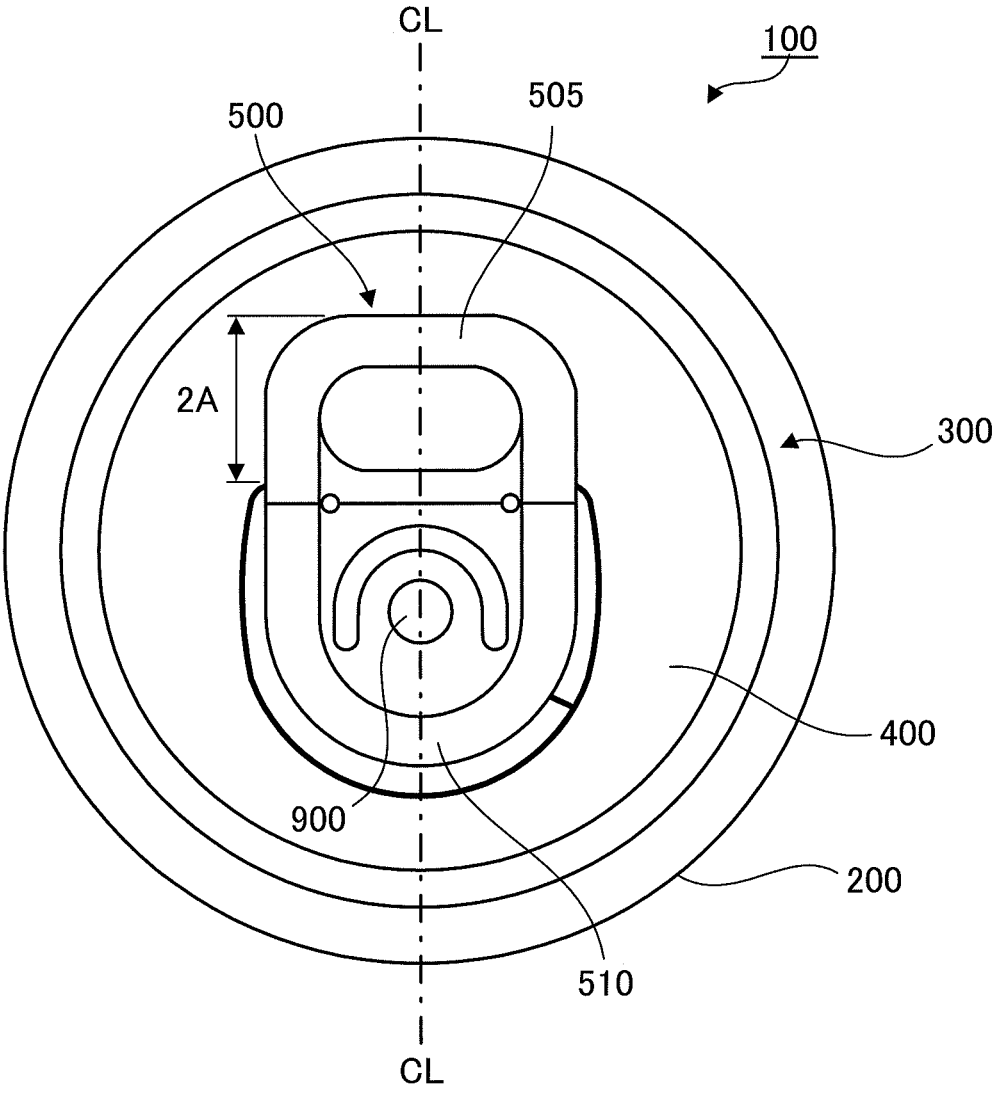
FIG. 18 is a top view of a beverage can.

FIG. 18 is a top view of a beverage can 100 to which the exemplary embodiment is applied. As shown in the figure, the beverage can 100 includes a container body (can barrel) 200 that is formed in a cylindrical shape and has an opening at an upper portion and a bottom section at a lower portion, and a can lid 300 that is attached to the opening of the container body 200 to block the opening. Note that the beverage can 100 contains a drink, such as a soft drink, a carbonated drink or an alcoholic beverage.

The can lid 300 includes a disk-shaped panel 400 that functions as a substrate and is attached to the container body 200. Moreover, a tab 500 to be operated by a user is attached to the can lid 300. The tab 500 is operated (lifted up) by the user at one end portion (in the figure, an upper end portion), and thereby the other end portion thereof (a tip end portion) is pressed against a predetermined location of the panel 400 (to be described in detail later), to thereby press the panel 400. Note that, in the present specification, the upper end portion of the tab 500 in the figure is referred to as an operated section 505, and a lower end portion of the tab 500 in the figure is referred to as a tip end section 510.

The tab 500 is fastened to the panel 400 by a rivet 900 provided at a position deviated from a center portion of the panel 400. To additionally describe, the tab 500 is fastened to the panel 400 by the rivet 900 provided in a decentered state with respect to the panel 400. Further, in the tab 500, a portion positioned between the operated section 505 and the tip end section 510 is fastened to the panel 400 by the rivet 900.

Note that, in the exemplary embodiment, description is given by taking a case in which the tab 500 is fastened to the panel 400 by the rivet 900 provided at the position deviated from the center portion of the panel 400 as an example; however, the tab 500 can be fastened to the panel 400 by a rivet 900 provided at the center portion of the panel 400. Moreover, in the exemplary embodiment, a tab 500 in which the tip end section 510 is formed into an arc shape is exemplified; however, the tab 500 can be formed into a rectangular shape, and in this case, the tab 500 includes a linear-shaped tip end section 510.

With reference to FIGS. 19A to 19D (the diagrams for illustrating the tab 500), the tab 500 will be described further.

Figure 19A:
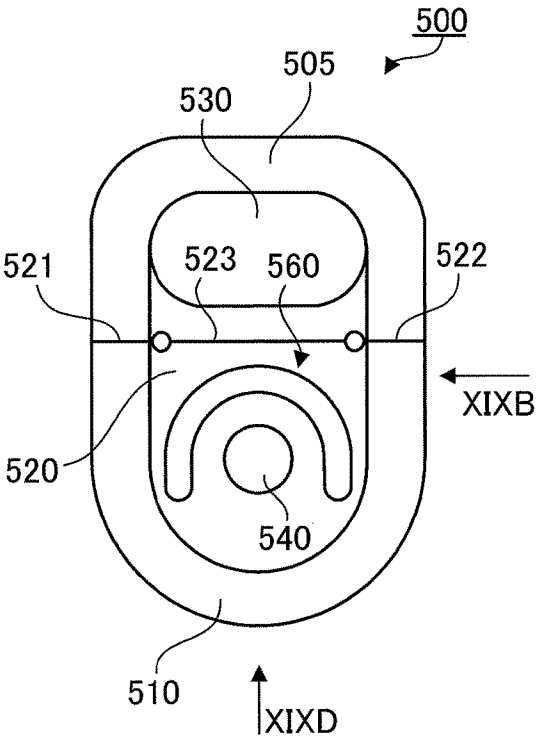
FIGS. 19A to 19D are diagrams for illustrating a tab.
Figure 19B:
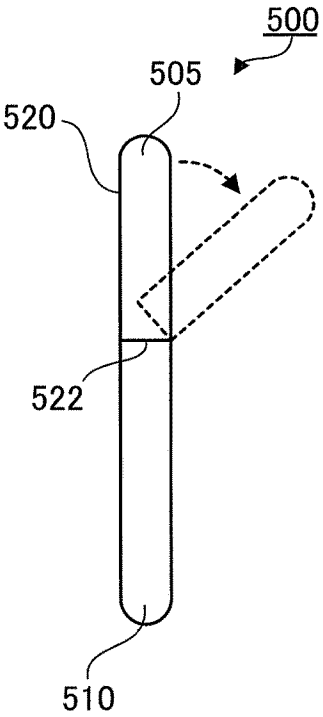
Figure 19C:
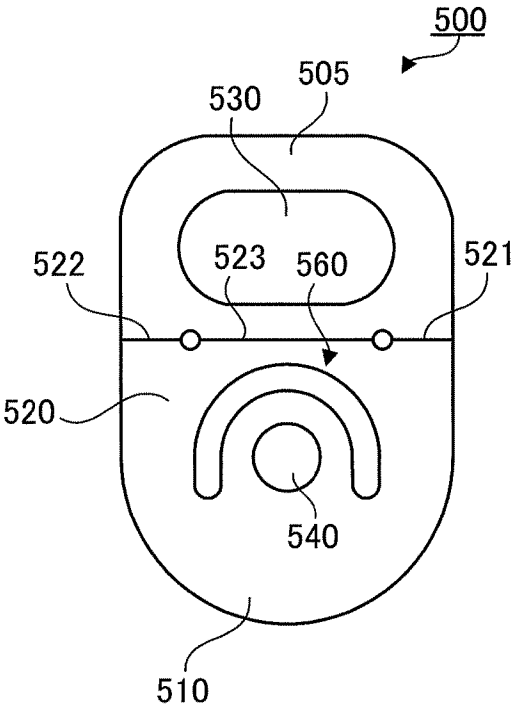
Figure 19D:
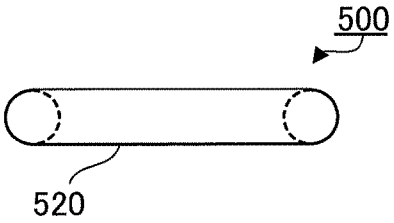

Note that FIG. 19A is a front view of the tab 500 and FIG. 19B is a diagram showing the tab 500 as viewed from the direction of arrow XIXB in FIG. 19A. Moreover, FIG. 19C is a diagram showing a reverse side of the tab 500. FIG. 19D is a diagram showing the tab 500 as viewed from the direction of arrow XIXD in FIG. 19A.

The tab 500 includes, as shown in FIG. 19A, a tab main body section 520 that is formed into a plate-like shape and into substantially a rectangular shape. Note that, in the exemplary embodiment, as shown in FIG. 19D, bending processing (curling processing) is applied to an outer peripheral edge of the tab main body section 520, and accordingly, the outer peripheral edge of the tab main body section 520 is in a state of curling into the inside. To additionally describe, at the edge section provided all around the tab main body section 520, curling sections are formed.

Consequently, in the exemplary embodiment, bending stiffness of the tab 500 is increased. Further, in the tab 500, as shown in FIG. 19A, a through hole (a finger hole) 530 in which user's finger is caught is formed on a side (the operated section 505 side) opposite to the side on which the tip end section 510 is provided. Moreover, in the tab 500, an insertion hole 540 into which a protruding section 420 (to be described later) provided in the panel 400 is inserted is formed on the tip end section 510 side. Further, round the insertion hole 540, a penetrating section 560 that is formed into a U-shape and penetrates through the tab main body section 520 is provided.

Further, of the four curling sections provided all around the tab main body section 520, in the curling section provided along the longitudinal direction of the tab 500, a first slit 521 is formed. Moreover, of the four curling sections, in another curling section provided along the longitudinal direction of the tab 500, a second slit 522 is formed. Further, of the tab main body section 520, in the portion positioned between the first slit 521 and the second slit 522, a groove 523 along the short direction of the tab 500 is formed.

Here, the first slit 521, the second slit 522 and the groove 523 are provided on the same straight line. Moreover, the first slit 521, the second slit 522 and the groove 523 are provided along the width direction of the tab 500. In addition, the first slit 521, the second slit 522 and the groove 523 are arranged between the insertion hole 540 and the through hole 530. Here, in the exemplary embodiment, the first slit 521, the second slit 522 and the groove 523 are formed in this manner, and accordingly, stiffness (bending stiffness) in the portions where these are formed is decreased.

Consequently, as shown in FIG. 19B, if a load is applied to the operated section 505 side of the tab 500, the tab 500 is bent. Note that, in the exemplary embodiment, the groove 523 is formed between the first slit 521 and the second slit 522 to decrease the stiffness in the portion; however, the stiffness is able to be decreased not only by forming such a groove, but also by applying the bending processing. Moreover, the groove 523 is not necessarily required, and the groove 523 may be omitted.

Note that, in a case where a load that acts on a direction opposite to the direction of the arrow indicated in FIG. 19B is applied to the operated section 505 (in a case where a load that acts on the left direction in the figure is applied to the operated section 505), two portions facing each other, which have been formed by dividing the tab 500 by the first slit 521 or the like (of the tab 500, portions positioned at both sides of the first slit 521 or the like) bump into each other, to thereby prevent the tab 500 from bending.

Figure 20A:
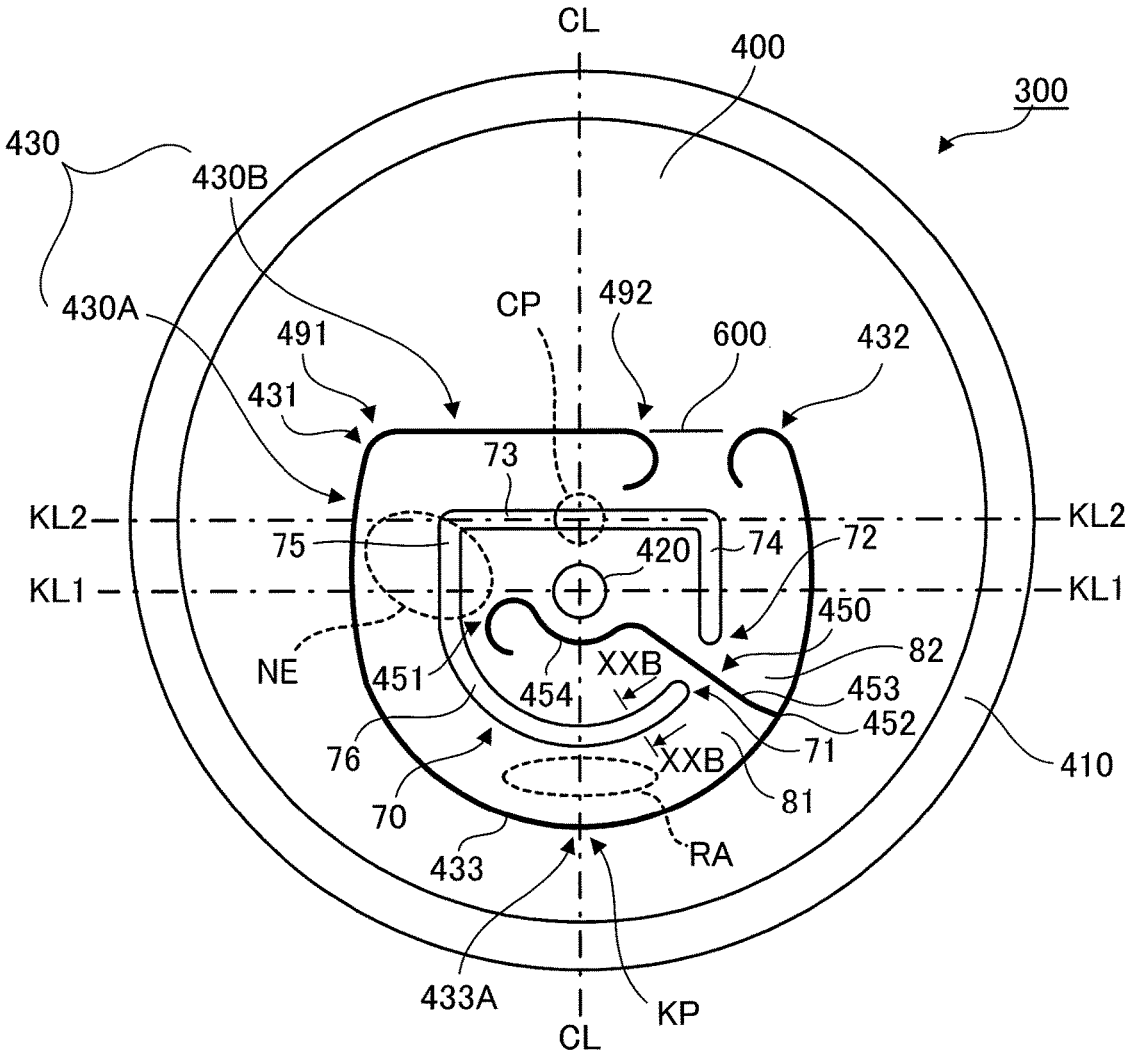
FIGS. 20A and 20B are diagrams showing a can lid before the tab is attached.
Figure 20B:
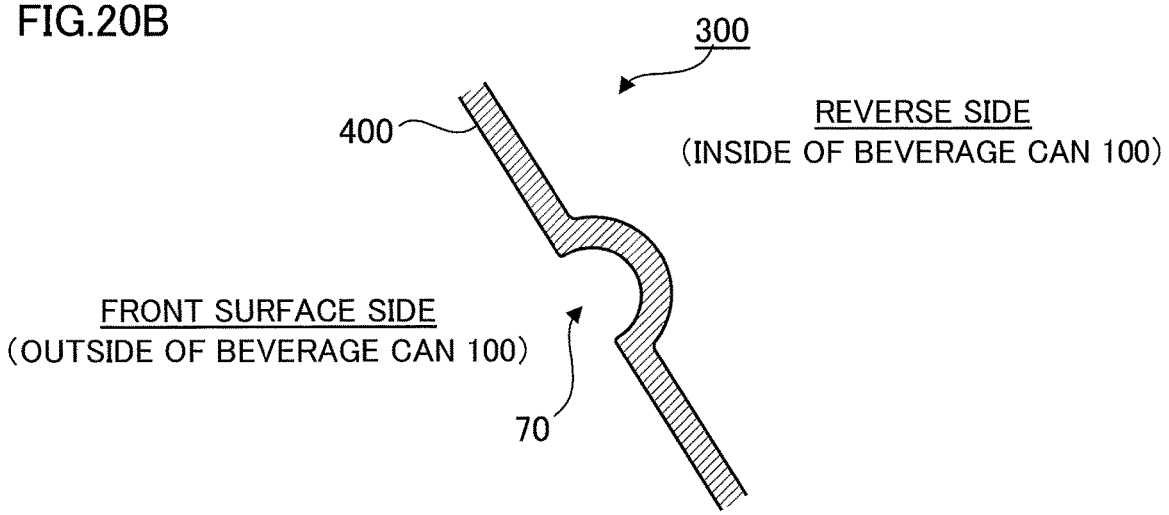

FIGS. 20A and 20B are diagrams showing the can lid 300 before the tab 500 is attached. Note that FIG. 20A is a front view, and FIG. 20B is a cross-sectional view along the XXB-XXB line in FIG. 20A.

As shown in FIG. 20A, the can lid 300 of the exemplary embodiment includes a panel 400 that is formed into a disk shape. The panel 400 has an outer peripheral edge 410 in which bending processing has applied. In the exemplary embodiment, in a state where the outer peripheral edge 410 and an upper edge section (not shown) of the container body 200 (refer to FIG. 18) are brought into contact with each other, so-called seaming processing is applied to the outer peripheral edge 410 and the upper edge section. This fastens the can lid 300 (the panel 400) to the upper edge section of the container body 200.

Further, in the can lid 300, a protruding section (nipple) 420, which will be crushed when the tab 500 is fastened to the panel 400 to become the above-described rivet 900 (refer to FIG. 18), is formed. The protruding section 420 is provided at a location deviated from the center portion CP of the panel 400. Note that, in the exemplary embodiment, the location where the protruding section 420 is provided is able to be captured as an attached section where attachment of the tab 500 is carried out. Further, in the exemplary embodiment, on the surface of the panel 400, the first score line 430 is formed.

The first score line 430 is configured with a groove formed on the surface of the panel 400 and plays a role of inducing breakage of the panel 400 (to be described later). To additionally describe, the first score line 430 is able to be grasped as a breakage prediction line on which breakage of the panel 400 is predicted. To describe further, the first score line 430 has a role of facilitating breakage of the panel 400, which is caused by being pressed by the tab 500, so as to be generated at a predetermined location of the panel 400.

Here, in the first score line 430, a U-shaped section 430A that is formed into a U-shape and a linear section 430B that is connected to the U-shaped section 430A are provided.

The U-shaped section 430A is formed to curve toward the outer peripheral edge 410 of the panel 400 from the center portion side of the panel 400, and is formed into a U-shape when the panel 400 is viewed from the front. Further, the U-shaped section 430A includes one end section 431 and the other end section 432 on the center portion CP side of the panel 400, and a vertex section 433A on the outer peripheral edge 410 side of the panel 400.

The linear section 430B is connected to the one end section 431 of the U-shaped section 430A, and is formed to extend toward the other end section 432 of the U-shaped section 430A from a connecting section with the one end section 431 as a starting point. To additionally describe, the linear section 430B is formed to head toward the other section 432 side of the U-shaped section 430A regarding the connecting section with the one end section 431 as the starting point. Further, the linear section 430B includes a left end section 491 that is positioned on the left side of the figure and connected to the one end section 431 and a right end section 492 that is positioned on the right side of the figure and arranged near the other end section 432.

Note that, in the exemplary embodiment, the other end section 432 of the U-shaped section 430A and the right end section 492 of the linear section 430B are curled, and thereby breakage of the panel 400 beyond the other end section 432 and breakage of the panel 400 beyond the right end section 492 are suppressed. In a case where these sections are not curled and formed linearly, there is a possibility that the panel 400 is split at the location beyond the other end section 432 and at the location beyond the right end section 492, and thereby breakage of the panel 400 is generated. To additionally describe, above the other end section 432 in the figure, and on the right side of the right end section 492 in the figure, there is a possibility that breakage of the panel 400 is generated.

The one end section 431 of the U-shaped section 430A is arranged on one side (in the figure, the region on the left side) of two regions that face each other with the center line CL (the center line along the longitudinal direction of the tab 500, also refer to FIG. 18) of the tab 500 interposed therebetween. On the other hand, the other end section 432 is arranged on the other side (in the figure, the region on the right side) of two regions that face each other with the center line CL interposed therebetween. Moreover, in the exemplary embodiment, the U-shaped section 430A is formed to be linearly symmetric with respect to the center line CL of the tab 500 as a symmetrical axis.

Further, in the exemplary embodiment, the one end section 492 of the linear section 430B and the other end section 432 of the U-shaped section 430A are provided in a state of being separated from each other, and accordingly, between the one end section 492 and the other end section 432, there is provided a discontinuous section where the first score line 430 is not formed. By providing the discontinuous section, a later-described tongue section is not separated from the panel 400, and the tongue section is kept in a state of attaching to the panel 400. Note that, in the exemplary embodiment, as shown in FIG. 20, the center line CL of the tab 500 passes through the center portion CP of the panel 400 and the protruding section 420 formed on the panel 400.

In addition, in the exemplary embodiment, in a case where a first virtual line KL1, which is a virtual line that is orthogonal to the above-described center line CL (a virtual line orthogonal to one direction in which the tab 500 extends) and passes through the protruding section 420 (rivet 900), is assumed, the above-described one end section 431 and the other end section 432 are positioned closer to the center portion CP side of the panel 400 than the first virtual line KL1.

Moreover, in the exemplary embodiment, as shown in FIG. 20, the vertex section 433A is positioned in one of two regions that face each other with a second virtual line KL2, which is a virtual line that is orthogonal to the center line CL and passes through the center portion CP of the panel 400, interposed therebetween, and the one end section 431 and the other end section 432 are positioned in the other region.

Further, the protruding section 420 that will become the rivet 900 is provided in a portion, of the panel 400, enclosed by the first score line 430. Moreover, in the U-shaped section 430A, the curved section 433 is provided, as shown in FIG. 20. The curved section 433 swells toward the outer peripheral edge 410 side of the panel 400, and passes through a side closer to the outer peripheral edge 410 side of the panel 400 than the protruding section 420. Moreover, the curved section 433 has the vertex section 433A at a location crossing the center line CL.

In the exemplary embodiment, by operation of the tab 500 by a user, the region enclosed by the first score line 430 is pressed by the tab 500, and accordingly, the panel 400 is broken on the location where the first score line 430 is formed (to be described in detail later). This causes the region on which the first score line 430 is formed to be in the tongue shape, and also causes the region to be bent toward the inside of the beverage can 100. Consequently, an opening that plays a role of a place a person drinks from is formed in the beverage can 100.

Note that, in the present specification, hereinafter, the above-described tongue-shaped portion formed by breakage caused on the first score line 430 is referred to as a tongue section, in some cases.

Further, in the exemplary embodiment, on the surface of the panel 400, the second score line 450 is formed. The second score line 450 is also configured with a groove formed on the surface of the panel 400 and plays a role of inducing breakage of the panel 400. Of the two regions facing each other with the first virtual line KL1 interposed therebetween, the second score line 450 is provided in the region where the vertex section 433A (the vertex section 433A of the U-shaped section 430A) is provided.

Moreover, the second score line 450 includes one end section 451 and the other end section 452. Here, the other end section 452 of the second score line 450 is connected to the curved section 433 provided to the first score line 430. Accordingly, in the exemplary embodiment, the score line branches at a location where the first score line 430 and the second score line 450 are connected.

The other end section 452 of the second score line 450 is connected to a portion positioned between the center line CL and the first virtual line KL1 in the curved section 433 of the first score line 430. To describe further, the other end section 452 of the second score line 450 is connected to a portion positioned between the vertex section 433A and the other end section 432 of the first score line 430. Moreover, the other end section 452 of the second score line 450 is connected to, of the first score line 430, a location other than the location where the vertex section 433A is provided.

To describe further, the connecting section of the first score line 430 and the second score line 450 is provided at a location other than a crossing location KP where the center line CL and the U-shaped section 430A cross each other. Moreover, in the exemplary embodiment, the second score line 450 is provided to head toward the inside of the region enclosed by the first score line 430 from the connecting section with the first score line 430.

Moreover, in the exemplary embodiment, the connecting section of the first score line 430 and the second score line 450 is provided closer to a side where the above-described crossing location KP is provided than the first virtual line KL1 arranged in a relation orthogonal to the center line CL. In addition, in the exemplary embodiment, the connecting section of the first score line 430 and the second score line 450 is provided closer to a side where the region RA is positioned than the first virtual line KL1 arranged in a relation orthogonal to the center line CL. To additionally describe, in the exemplary embodiment, the portion of the region RA, of the panel 400, is pressed by the tab 500, and the connecting section of the first score line 430 and the second score line 450 is provided closer to a side where the pressed portion is positioned than the first virtual line KL1.

Moreover, in the exemplary embodiment, the distance between the connecting section of the first score line 430 and the second score line 450 and the one end section 431 of the U-shaped section 430A is larger than the distance between the connecting section and the other end section 432 of the U-shaped section 430A. To describe further, the length of the portion positioned between the one end section 431 of the U-shaped section 430A and the above-described connecting section is longer than the length of the portion positioned between the other end section 432 of the U-shaped section 430A and the above-described connecting section.

Note that, in the exemplary embodiment, the description has been given of a case where the second score line 450 is formed to head in the lower right direction in the figure from the center portion side of the panel 400; however, the second score line 450 may be formed to head in the lower left direction in the figure. In this case, the second score line 450 is connected to a portion positioned between the vertex section 433A and the one end section 431 of the U-shaped section 430A.

Further, the one end section 451 of the second score line 450 is provided in proximity to the protruding section 420. Moreover, the one end section 451 of the second score line 450 is arranged in one of the two regions facing with the centerline CL interposed therebetween, and the other end section 452 of the second score line 450 is arranged in the other one of the two regions. Further, the second score line 450 includes a linear section 453 heading toward the protruding section 420 from the other end section 452. Moreover, the second score line 450 includes a curved section 454 that is connected to the linear section 453 and arranged to have a distance with the protruding section 420 formed into a circular-cylindrical shape, and is formed along the outer peripheral edge of the protruding section 420.

The curved section 454 of the second score line 450 is formed between the protruding section 420 and the U-shaped section 430A. In detail, the curved section 454 is formed between the vertex section 433A of the U-shaped section 430A and the protruding section 420. To additionally describe, on the center line CL, the curved section 454 of the second score line 450 is arranged between the protruding section 420 and the U-shaped section 430A.

Moreover, the curved section 454 is provided to pass between the region RA, of the panel 400, pressed by the tab 500 and the protruding section 420. To additionally describe, in the exemplary embodiment, the second score line 450 is provided to pass through closer to a side where the protruding section 420 (the rivet 900) is provided than the above-described region RA, and also the second score line 450 is provided to pass between the region RA and the protruding section 420.

Moreover, the curved section 454 of the second score line 450 is provided to cross the center line CL. To describe further, the second score line 450 in the exemplary embodiment, after passing between the region RA and the protruding section 420, proceeds along the direction crossing the center line CL, and is connected to the U-shaped section 430A of the first score line 430.

To describe further, the second score line 450, which proceeds along the direction intersecting the center line CL and toward the U-shaped section 430A, passes beside the region RA. Moreover, the second score line 450, after passing between the region RA and the protruding section 420, proceeds to be gradually separated from the first virtual line KL1, and is connected to the U-shaped section 430A.

Further, in the exemplary embodiment, embossing process to form a recess by pressing a mold is performed on the panel 400, and thereby, on the panel 400, a recessed groove 70 is formed. Here, as shown in FIG. 20B, the recessed groove 70 is formed so that a part of the panel 400 protrudes on the reverse side of the can lid 300 (inside the beverage can 100).

Note that, in the case where the recessed groove 70 is formed to protrude toward the reverse side of the can lid 300 (inside of the beverage can 300) in this manner, there is a possibility that grit and dust accumulate in the recessed groove 70. Consequently, in the exemplary embodiment, as shown in FIG. 18, the recessed groove 70 is positioned behind the tab 500, to thereby cover the recessed groove 70 with the tab 500. This results in suppressing accumulation of grit and dust in the recessed groove 70 as compared to a case in which the recessed groove 70 is exposed.

Moreover, as shown in FIG. 20A, the recessed groove 70 is formed to enclose the protruding section 420 (the rivet 900). Further, the recessed groove 70 is formed to enclose the one end section 451, which is a trailing end of the second score line 450. To additionally describe, the recessed groove 70 of the exemplary embodiment is formed into substantially an annular shape, and the protruding section 420 and the one end section 451 of the second score line 450 are arranged inside the recessed groove 70 formed into the annular shape in this manner.

Here, the recessed groove 70 will be described further in detail.

The recessed groove 70 includes, as shown in FIG. 20A, on end 71 and the other end 72.

Further, though description has been omitted above, in the exemplary embodiment, the region enclosed by the first score line 430 is divided by the second score line 450; accordingly, a first region 81 is positioned on a lower left side of the second score line 450 in the figure, and a second region 82 is positioned on an upper right side of the second score line 450 in the figure. Then, the exemplary embodiment has a configuration in which the one end 71 of the recessed groove 70 is positioned within the first region 81 and the other end 72 of the recessed groove 70 is positioned within the second region 82.

Further, in the exemplary embodiment, with respect to the second score line 450, though the other end section 452 is connected to the first score line 430, the one end section 451 is not connected to the first score line 430; therefore, a non-formation region NE, in which the score line is not formed, is provided between the one end section 451 and the first score line 430. Then, in the exemplary embodiment, the recessed groove 70 is provided to pass through the non-formation region NE. To additionally describe, the recessed groove 70 is formed, in the case where the one end 71 is regarded as a starting point, to head toward the other end 72, and, on that occasion, the recessed groove 70 passes through the above-described non-formation region NE.

To further describe the recessed groove 70, in the recessed groove 70, there is provided a first linear section 73 that extends in a direction orthogonal to the direction in which the center line CL of the tab 500 extends, and passes between the linear section 430B of the first score line 430 and the protruding section 420. There is further provided a second linear section 74 that is connected to a right end section, in the figure, of the first linear section 73 and extends from a connecting section with this right end section toward the lower side in the figure (toward the second score line 450).

Further, there is provided a third linear section 75 that is connected to a left end section, in the figure, of the first linear section 73 and extends from a connecting section with the left end section toward the lower side in the figure (toward the curved section 433 of the U-shaped section 430A). Further, there is provided a curving line 76 that is connected to a lower end section, in the figure, of the third linear section 75 and extends from a connecting section with the third linear section 75 toward a lower end section, in the figure, of the second linear section 74. The curving line 76 is formed to have curvature and to swell toward the outer peripheral edge 410 side of the panel 400.

Here, with reference to FIGS. 21A to 21F (the diagrams showing states of the can lid 300 when the tab 500 is operated), the state of the can lid 300 when the tab 500 is operated will be described. Note that, in each of FIGS. 21A to 21F, there are shown two states, namely, a state of the can lid 300 when the can lid 300 is viewed from the front side and a state of the can lid 300 when the can lid 300 is viewed from the lateral side. Moreover, in each of FIGS. 21A to 21F, illustration of the recessed groove 70 is omitted.

In the exemplary embodiment, when the operated section 505 (the rear end section) of the tab 500 is pulled up by a user, the tip end section 510 of the tab 500 presses the region RA (refer to FIG. 20) positioned between the curved section 454 of the second score line 450 and the vertex section 433A of the first score line 430 (the U-shaped section 430A). To additionally describe, in the exemplary embodiment, when the operated section 505 (the rear end section) of the tab 500 is pulled up by a user, the region RA positioned closer to the vertex section 433A than the rivet 900 is pressed by the tab 500. Then, when the region RA is pressed by the tab 500, first, breakage of the panel 400 occurs on the curved section 454 of the second score line 450 provided to pass between the region RA and the rivet 900 (the protruding section 420) (refer to FIG. 21B).

Figure 21A:
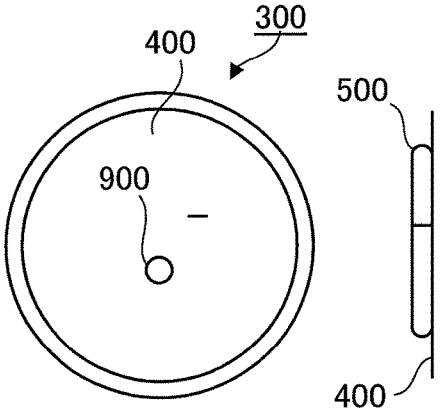
FIGS. 21A to 21F are diagrams showing states of the can lid when the tab is operated.
Figure 21B:
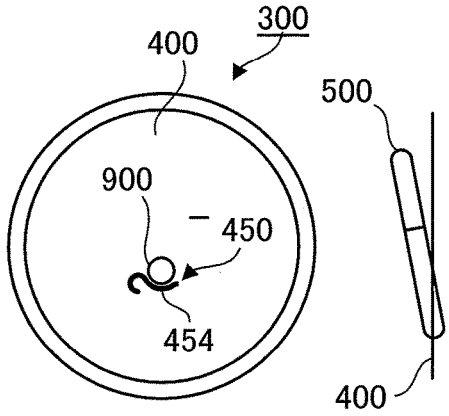
Figure 21C:
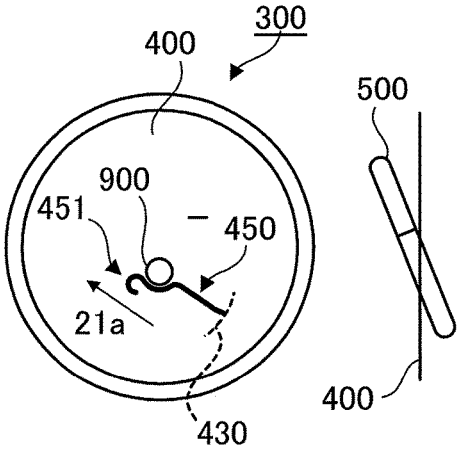

Thereafter, breakage of the panel 400 proceeds along the second score line 450, and, as shown in FIG. 21C, the panel 400 is broken to the connecting section of the first score line 430 and the second score line 450.

Note that, in the exemplary embodiment, when breakage of the panel 400 proceeds along the second score line 450, breakage of the panel 400 proceeds not only in the direction heading toward the connecting section of the first score line 430 and the second score line 450, but also in the direction opposite to the direction heading toward the connecting section. To additionally describe, breakage of the panel 400 proceeds also in the direction indicated by arrow 21*a* in FIG. 21C.

By the way, in the exemplary embodiment, as shown in FIG. 21C, the one end section 451 of the second score line 450 is curled, and thereby, breakage of the panel 400 beyond the one end section 451 is suppressed, and breakage of the panel 400 is stopped at the one end section 451.

Note that, though it is assumed that the panel 400 is broken beyond the one end section 451, in the exemplary embodiment, the recessed groove 70 is positioned on the extension of the second score line 450 (at the location where the non-formation region NE is positioned) as shown in FIG. 20A, and proceeding of breakage of the panel 400 is suppressed by the recessed groove 70. To additionally describe, in the exemplary embodiment, as shown in FIG. 20A, the recessed groove 70 is positioned around the one end section 451 of the second score line 450, and therefore, even if breakage of the panel 400 is generated beyond the one end section 451, proceeding of breakage is suppressed by the recessed groove 70.

Figure 21D:
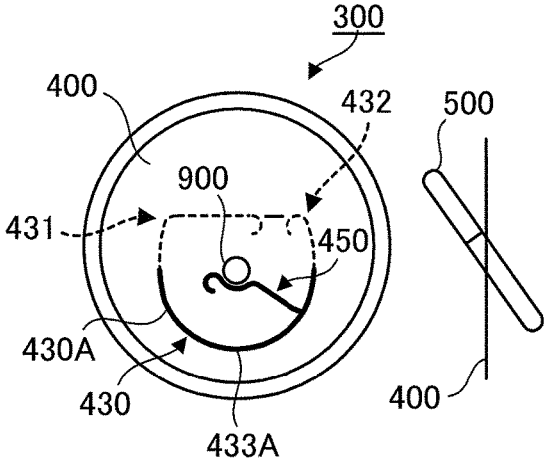

With reference to FIG. 21D, the state of the panel 400 will be described further.

When breakage of the panel 400 proceeds to the connecting section between the first score line 430 and the second score line 450, in the exemplary embodiment, as shown in FIG. 21D, breakage of the panel 400 from the connecting section toward the one end section 431 of the U-shaped section 430A and breakage of the panel 400 from the connecting section toward the other end section 432 of the U-shaped section 430A further proceed.

Figure 21E:
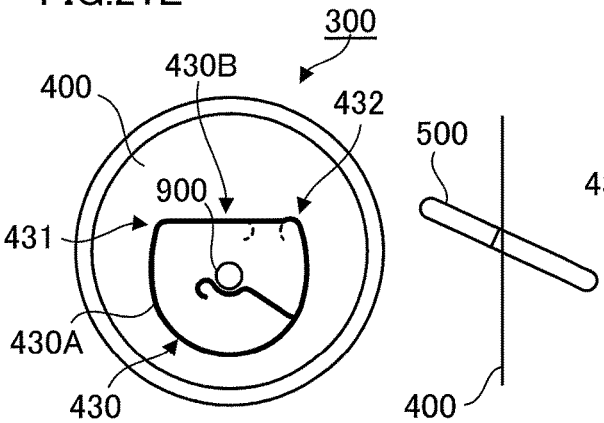

Thereafter, in the exemplary embodiment, the tab 500 is pressed into an inward direction of the beverage can 100 by the user. Consequently, as shown in FIG. 21E, breakage of the panel 400 further proceeds to the one end section 431 and the other end section 432 of the U-shaped section 430A. Further, breakage of the panel 400 along the linear section 430B proceeds.

This causes the region enclosed by the first score line 430 to become the tongue section. In addition, the tongue section is bent at a basal part of the tongue section (the location positioned between the right end section 492 of the linear section 430B (refer to FIG. 20A) and the other end section 432 of the U-shaped section 430A), and the tongue section enters into the inside of the beverage can 100. Consequently, the can lid 300 is brought into a state in which an opening that functions as a place a person drinks from is formed.

Note that the exemplary embodiment has a configuration in which the rivet 900 (the protruding section 420) is provided to the tongue section, and thereby it becomes possible to make the opening (the place a person drinks from) to be formed larger. In an ordinary can lid, the opening is formed at a location other than the location where the rivet is provided; therefore, if there is a rivet, it is required to make the opening small for the rivet. In the exemplary embodiment, the location where the rivet is provided is also formed as the opening, and accordingly, it is possible to make the opening larger.

Figure 21F:
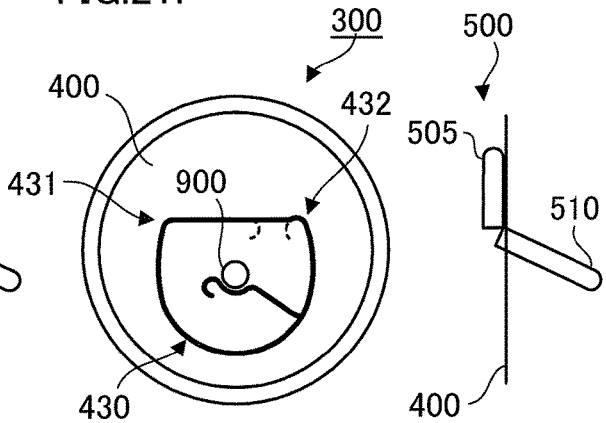

With reference to FIG. 21F, the state of the can lid 300 will be described.

After the opening is formed, the tab 500 is further operated by the user. Specifically, operation of returning the tab 500 is carried out by the user, and, as shown in FIG. 21F, an operated section 505 side of the tab 500 is bent. This causes the operated section 505 side of the tab 500 to follow the panel 400 of the can lid 300. In this case, there is no protrusion on the operated section 505 side, and accordingly, it becomes easy for the user to drink the inside beverage, as compared to a case where the operated section 505 protrudes.

Here, in the exemplary embodiment, by bending the tab 500 in this manner, a state in which the tip end section 510 of the tab 500 is inserted into the inside of the beverage can 100 is maintained. To additionally describe, even if the tab 500 that has been pulled up is laid down to follow the panel 400, since only the operated section 505 side of the tab 500 is bent, the state in which the tip end section 510 of the tab 500 is inserted into the inside of the beverage can 100 is maintained. This prevents the opening having been formed from being blocked by the tip end section 510 of the tab 500, and accordingly, the opening grows wider.

Note that, in the exemplary embodiment, description has been given by taking the bendable tab 500 as an example; however, it is possible to use an unbending tab 500 as a matter of course. Note that, in the case where the unbending tab 500 is used, it is desirable to reduce a protruding amount of the operated section 505 of the tab 500. To additionally describe, it is preferable to reduce the portion indicated by the reference sign 2A in FIG. 18.

In the case where the unbending tab 500 is used, it is assumed that the inside beverage is drunk in the state where the operated section 505 of the tab 500 protrudes from the surface of the panel 400; however, by reducing the protruding amount of the operated section 505, the user is allowed to drink the inside beverage with ease, as compared to the case where the protruding amount is large.

Alternatively, in FIG. 20A, by making a distance between the first virtual line KL1 passing through the protruding section 420 (the rivet 900) and the linear section 430B larger, the tab 500 deeply enters into the can, to thereby make it possible to reduce the protruding amount of the operated section 505.

Here, breakage of the panel 400 caused on the first score line 430 and the second score line 450 will be further described with reference to FIG. 22-1 (a diagram for illustrating breakage of the panel 400).

In the exemplary embodiment, as described above, when the operated section 505 of the tab 500 is pulled up by a user, the region RA (refer to FIG. 20A) positioned between the curved section 454 of the second score line 450 and the vertex section 433A of the first score line 430 (the U-shaped section 430A) is pressed by the tab 500. This causes, first, breakage of the panel 400 at the curved section 454 of the second score line 450.

Thereafter, breakage of the panel 400 proceeds along the second score line 450, and the panel 400 is broken to the connecting section of the first score line 430 and the second score line 450. After that, the panel 400 is broken on the first score line 430. Specifically, as shown in FIG. 22-1, of the first score line 430, breakage of the panel 400 is generated in a region indicated by the reference sign 8C.

Figures 1, 22:
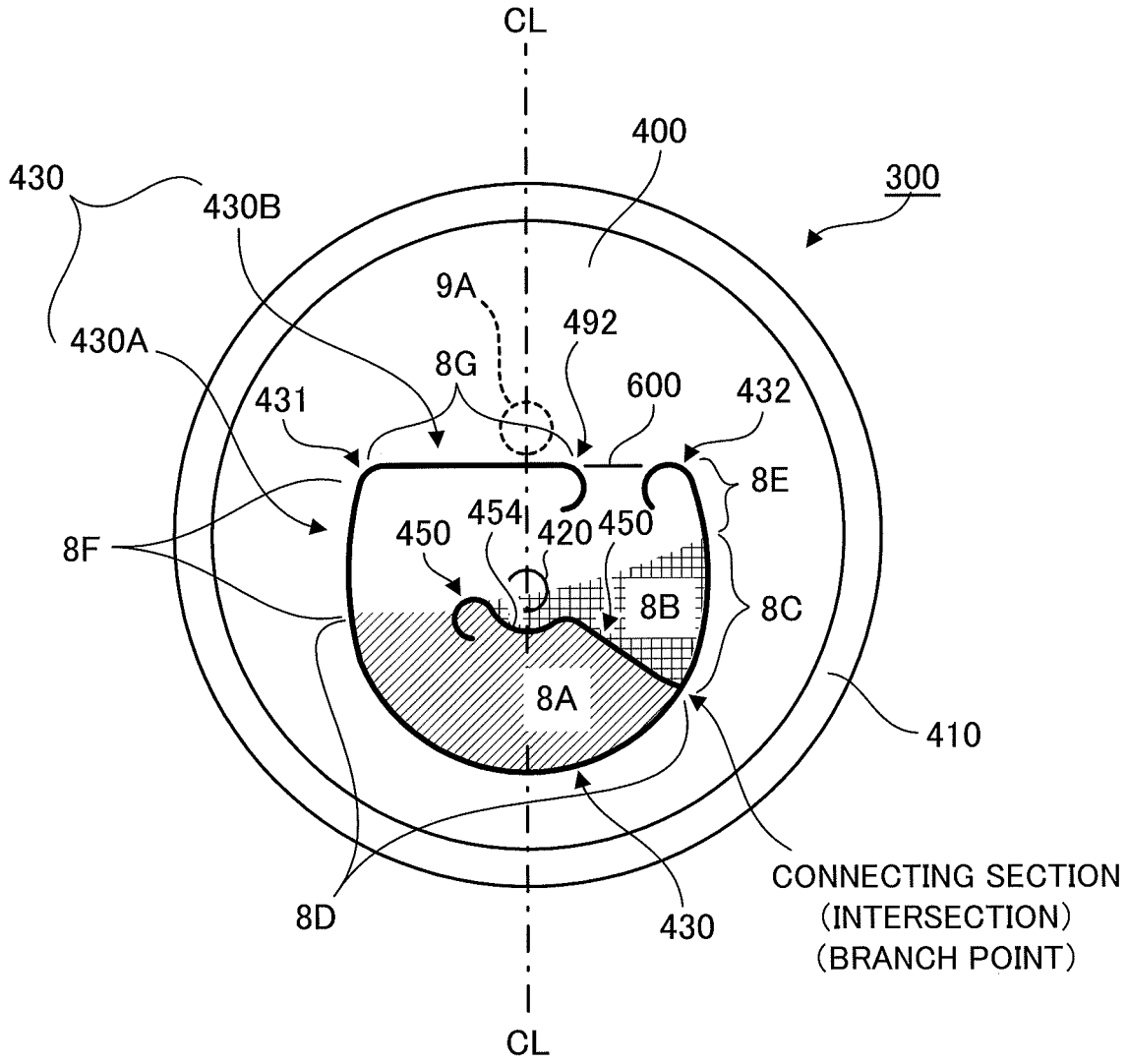
Figures 2, 22:
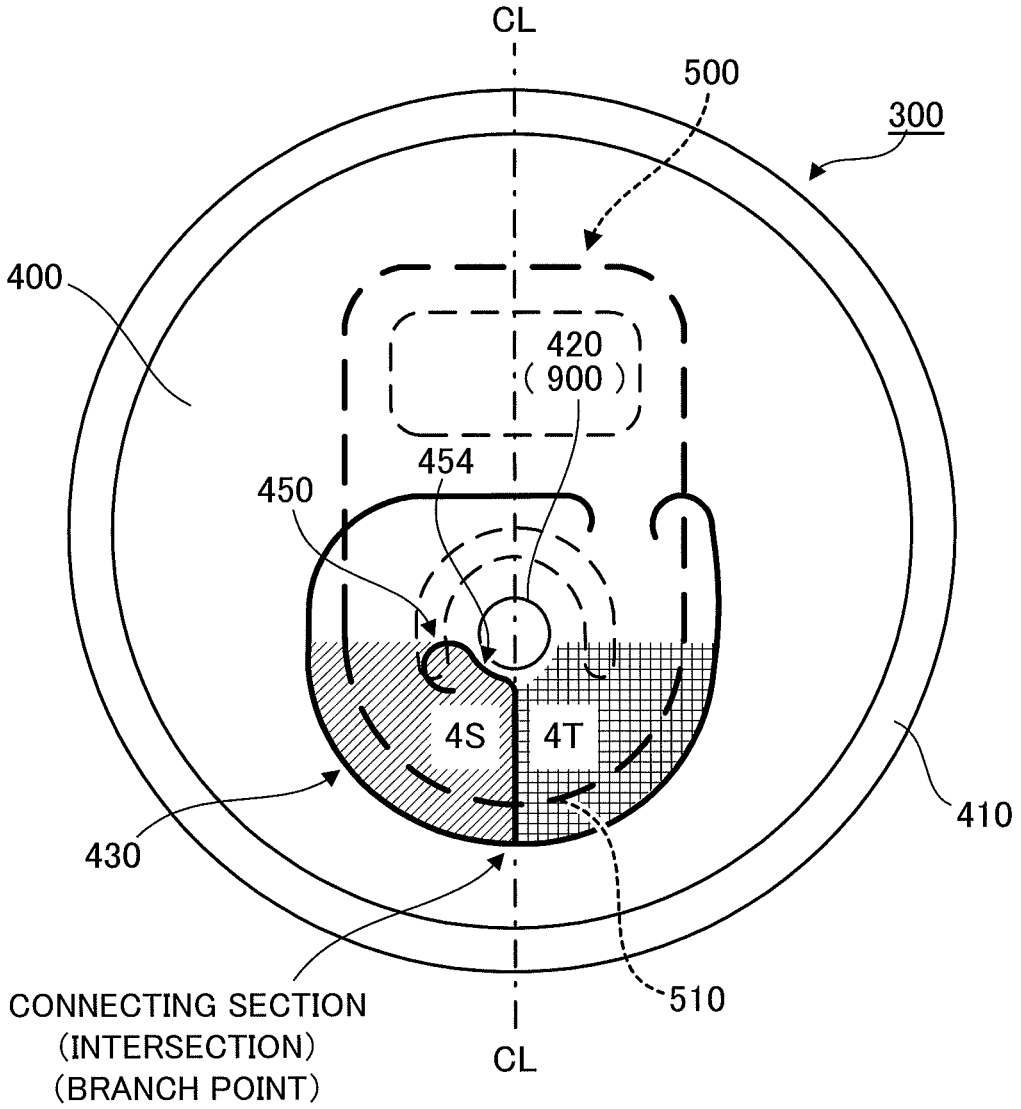

To describe in detail, in the exemplary embodiment, the tab 500 is pressed against the region RA, and thereby the region RA is pressed into the inward direction of the beverage can 100; at this time, the protruding section 420 is pulled by the tab 500 to an outward direction of the beverage can 100 (to the frontward direction in FIG. 22-1). This pulls the portion indicated by the reference sign 8B in FIG. 22-1 to the outward direction of the beverage can 100. Note that, hereinafter in the present specification, the portion indicated by the reference sign 8B is referred to as "pulled portion 8B".

As a result, a shearing force acts on the region indicated by the reference sign 8C, and thereby the panel 400 is broken in the region indicated by the reference sign 8C. To additionally describe, the panel 400 is broken in the portion, of the first score line 430, positioned closer to the other end section 432 side than the connecting section. Note that, if the panel 400 is broken at a portion positioned closer to the other end section 432 side than the connecting section in this manner, the pulled portion 8B floats from the panel 400, and with this, the tab 500 also comes to move upwardly (in the direction apart from the panel 400) from an initial position.

Moreover, in the exemplary embodiment, pressing of the tab 500 against the region RA is continued, and by the pressing, a portion, of the panel 400, indicated by the reference sign 8A (hereinafter, the portion is referred to as "pressed portion 8A") is pressed in the inward direction of the beverage can 100. Consequently, a shearing force acts on the region indicated by the reference sign 8D, and thereby the panel 400 is broken in the region indicated by the reference sign 8D. To additionally describe, the panel 400 is broken in the portion, of the U-shaped section 430A, positioned closer to the one end section 431 side than the connecting section.

Note that, in the exemplary embodiment, as described above, the recessed groove 70 (not shown in FIG. 22-1) is provided; accordingly, as compared to a case where the recessed groove 70 is not provided, pressing against the region RA (the pressed portion 8A) by the tab 500 is performed with more reliability. To additionally describe, in the exemplary embodiment, when the region indicated by the reference sign 8D is acted upon by the shearing force, pressing against the region RA by the tab 500 is performed with more reliability.

Here, in the exemplary embodiment, as described above, when the panel 400 is broken at the region indicated by the reference sign 6C, the pulled portion 8B comes to float; however, if the recessed groove 70 is provided, the floating amount of the pulled portion 8B from the panel 400 is reduced. To additionally describe, since, if the recessed groove 70 is provided, the bending stiffness in the region, of the panel 400, enclosed by the first score line 430 is increased, the enclosed region becomes less likely to be deformed, and therefore, the floating amount of the pulled portion 8B from the panel 400 is reduced.

Then, in this case, pressing against the region RA by the tab 500 is performed with more reliability. To additionally describe, if the floating amount of the pulled portion 8B from the panel 400 is reduced, the tip end section 510 of the tab 500 is prevented from largely separating from the region RA, and thereby reduction of the load acting on the region RA from the tip end section 510 is suppressed. Then, in this case, breakage of the panel 400 is generated in a region indicated by the reference sign 8D with more reliability.

In the case of viewing FIG. 18, when the operated section 505 of the tab 500 is pulled up by the user, the tip end section 510 presses the region RA of the panel 400 with the rivet 900 as a fulcrum, to thereby form an opening. If this is viewed in FIG. 22-1, the protruding section 420, which is the rivet 900, exists within the region of the pulled portion 8B, and the region RA is within the region of the pressed portion 8A.

When the operated section 505 is pulled up for forming the opening, the tip end section 510 comes to press down the pressed portion 8A, and the rivet 900 comes to float the pulled portion 8B. Consequently, in the process of forming the opening, the pressed portion 8A and the pulled portion 8B move in the directions different from each other.

On the other hand, since opening proceeds by pressing by the tip end section 510, the proceeding amount (the pressing amount) of the tip end section 510 against the panel 400 stays within the distance between the rivet 900 and the tip end section 510 as a limit. Accordingly, if the floating amount of the pulled portion 8B is increased, the rivet 900 largely floats when the tab 500 is pulled up, and there occurs a possibility that the tip end section 510 of the tab 500 becomes unable to press the region RA. For this reason, it is desirable that the floating amount of the pulled portion 8B is small.

Here, if the recessed groove 70 is not formed and the pulled portion 8B is more likely to float, the tip end section 510 of the tab 500 is separated from the panel 400, and in this case, the load from the tab 500 is less likely to act on the panel 400. Then, in this case, breakage of the panel 400 in the region indicated by the reference sign 8D is hardly generated.

Note that, in the exemplary embodiment, as described above, the recessed groove 70 is formed in a state in which a part of the panel 400 protrudes toward the reverse side of the can lid 300 (toward the inside of the beverage can 100). Here, for example, if the recessed groove 70 is formed in a state in which a part of the panel 400 protrudes toward the front side of the can lid 300 (toward the outside of the beverage can 100), there is a possibility that the opening is apt to be formed in transporting the beverage can 100.

Here, in transportation, beverage cans 100 filled with contents are stacked in some cases, and in this case, there is a possibility that a tab 500 of a beverage can 100 positioned below is pressed by a beverage can 100 positioned above. In such a case, if the recessed groove 70 is formed in a state in which a part of the panel 400 protrudes toward the front side of the can lid 300, there is a possibility that the recessed groove 70 is pressed by the tab 500, and with this, breakage of the panel 400 is generated.

On the other hand, as in the exemplary embodiment, if the recessed groove 70 is formed in a state in which a part of the panel 400 protrudes on the reverse side of the can lid 300, pressing against the recessed groove 70 by the tab 500 is not performed, and accordingly, breakage of the panel 400 is less likely to occur.

In addition, the exemplary embodiment has a configuration omitting an embossed bead by a similar reason. Here, the embossed bead means a convex portion that protrudes on the front surface side of the can lid 300 (the outside of the beverage can 100) formed by the embossing process. Then, the embossed bead is usually provided at a location pressed by the tip end portion 510 of the tab 500.

Here, in the case where the embossed bead is provided, pressing of the panel 400 by the tab 500 is started in a state in which an angle which the tab 500 forms with the panel 400 is smaller. Then, in this case, it becomes possible to press the tongue portion into the beverage can 100 deeper, and accordingly, the opening to be formed becomes larger.

By the way, in the case where such an embossed bead is provided, similar to the case where the recessed groove 70 is formed to be convex on the front surface side of the can lid 300, the opening is likely to be formed in transporting the beverage cans 100. On the other hand, as in the exemplary embodiment, in the case of the configuration omitting the embossed bead, unintended formation of the opening like this is less likely to occur.

With reference to FIG. 22-1 again, breakage of the panel 400 will be described further.

After breakage of the panel 400 is generated to the region indicated by the reference sign 8D, in the exemplary embodiment, the tab 500 is pressed in an inward direction of the beverage can 100 by the user. This further causes breakage of the panel 400 on the first score line 430. Specifically, the panel 400 is broken in two regions, namely, a region indicated by the reference sign 8E and a region indicated by the reference sign 8F in the figure. Further, breakage of the panel 400 is generated also in a region indicated by the reference sign 8G in the figure (the location where the linear section 430B is provided).

Further, in the exemplary embodiment, the tongue section is bent at a basal part of the tongue section (the location positioned between the right end section 492 of the linear section 430B and the other end section 432 of the U-shaped section 430A). Consequently, the tongue section enters into the inside of the beverage can 100, and thereby the opening is formed in the beverage can 100.

Here, in the exemplary embodiment, since the linear section 430B is provided to be connected to the U-shaped section 430A, breakage of the panel 400 from the U-shaped section 430A is continued to breakage of the panel 400 at the linear section 430B, to thereby make it easy to form the tongue section, and accordingly, further, operation load of the tab 500 when the tongue section is bent is reduced.

Here, in the case where the linear section 430B is not provided but only the U-shaped section 430A is formed, a region of the panel 400 that requires bending becomes large, and accordingly, the operation load of the tab 500 is apt to be large.

Particularly, in the configuration of the exemplary embodiment, the location where the tab 500 is attached is the tongue section, and therefore, it is difficult to press the tongue section by use of the principle of leverage. To additionally describe, in a case where the location where the tab 500 is attached exists on the outer side of the first score line 430, such as the location indicated by the reference sign 9A in FIG. 22-1, the principle of leverage can be applied; however, as in the exemplary embodiment, if the tab 500 is attached to the tongue section, it becomes impossible to use the principle of leverage. Then, in the case where the principle of leverage is unable to be used like this, the operation load of the tab 500 is apt to be large. On the other hand, in the exemplary embodiment, since there is provided the linear section 430B, parts required to be bent is reduced; accordingly, the operation load of the tab 500 is prevented from becoming large.

Note that, though description has been omitted above, the linear section 430B of the exemplary embodiment is, as shown in FIG. 20A, provided to reach a location beyond the center line CL of the tab 500 in a case where the connecting location with the one end section 431 of the U-shaped section 430A is regarded as the starting point. To additionally describe, the linear section 430B is formed so that a part thereof reach a location beyond a straight line that passes through the vertex section 433A of the U-shaped section 430A and the protruding section 420 (the location where the tab 500 is attached) and extends.

In this case, as compared to a configuration in which the linear section 430B does not reach the location beyond the center line CL of the tab 500, the region of the tongue section that requires to be bent can be reduced, and therefore, it becomes possible to reduce the operation load of the tab 500.

Moreover, in the exemplary embodiment, as shown in FIG. 20A, description has been given by taking the case in which the linear section 430B is provided to be parallel with the first virtual line KL1 or the second virtual line KL2 as an example; however, the linear section 430B may be provided to be inclined with respect to the first virtual line KL1 or the second virtual line KL2. In addition, in the exemplary embodiment, description has been given by taking the case in which the linear section 430B is formed linearly as an example; however, the linear section 430B is partially or entirely provided with curvature.

Moreover, in the exemplary embodiment, when breakage of the panel 400 is generated on the first score line 430, as described above and as shown in FIG. 22-1, first, breakage of the panel 400 is generated on the side closer to the other end section 432 than the connecting section (the region indicated by the reference sign 8C), and subsequently, breakage of the panel 400 is generated on the side closer to the one end section 431 than the connecting section (the region indicated by the reference sign 8D). Consequently, in the exemplary embodiment, an operation load when the user operates the tab 500 is reduced.

Here, for example, in a case where breakage of the panel 400 is generated simultaneously on both sides, namely, on the side closer to the one end section 431 than the connecting section and on the side closer to the other end section 432 than the connecting section, breakage of the panel 400 comes to be generated simultaneously in two locations. In such a case, with respect to the tab 500, it becomes necessary to apply the operation load required for breakage in two locations, and accordingly, the operation load on the tab 500 is increased.

On the other hand, in the exemplary embodiment, first, breakage of the panel 400 is generated on the side closer to the other end section 432 than the connecting section, and subsequently, breakage of the panel 400 is generated on the side closer to the one end section 431 than the connecting section. In this case, it is sufficient to apply the operation load required for breakage in one location on the tab 500, and the operation load on the tab 500 is reduced, as compared to the case in which the panel 400 is broken in two locations simultaneously.

Further, in the exemplary embodiment, the above-described connecting section is provided at a location deviated from the center line CL, to thereby reduce the operation load of the tab 500. Here, for example, in a case where the above-described connecting section is positioned on the center line CL, breakage of the panel 400 from the connecting section toward the one end section 431 and breakage of the panel 400 from the connecting section toward the other end section 432 are likely to occur at the same timing. In such a case, there occurs a state in which breakage of the panel 400 is generated at two locations and simultaneously, and thereby the operation load of the tab 500 is increased as compared to the case where breakage of the panel 400 is generated at a single location.

Moreover, in the exemplary embodiment, since the connecting section between the first score line 430 and the second score line 450 is not on the center line CL, the pressed portion 8A and the pulled portion 8B move in the directions different from each other, to thereby form the opening. In contrast thereto, in the case where the connecting section between the first score line 430 and the second score line 450 is on the center line CL as shown in FIG. 22-2 (the diagram showing another mode of the can lid 300), two regions on the panel 400 are simultaneously pressed by the tip end section 510 of the tab 500.

Here, as shown in FIG. 22-2, it is assumed that regions inside the first score line 430 divided by the second score line 450 are 4S and 4T. At this time, since the longitudinal direction of the tab 500 (dotted line) is provided along the center line CL, the portions 4S and 4T are positioned on the reverse side of the tip end section 510 of the tab 500. Consequently, the portions on the panel 400 to be pressed by the tip end section 510 by operation of the tab 500 are 4S and 4T. Note that, hereinafter, these portions will be referred to as a pressed portion 4S and a pressed portion 4T.

In the mode shown in FIG. 22-2, when the tab 500 is operated, first, breakage of the panel 400 is started from the curved section 454. Thereafter, breakage of the panel 400 reaches the connecting section on the first score line 430 by way of the second score line 450. After reaching the connecting section, breakage of the panel 400 by the first score line 430 proceeds at the two locations of the pressed portion 4S and the pressed portion 4T simultaneously. In other words, breakage of the panel 400 at the portions subsequent to the connecting section proceeds by pressing of the two locations of the pressed portion 4S and the pressed portion 4T simultaneously by the tip end section 510. Consequently, as compared to the case where one location is pressed, the operation load of the tab 500 is increased.

On the other hand, in the exemplary embodiment, the portion to be pressed by the tip end section 510 of the tab 500 is only one location, namely, the pressed portion 8A. At this time, the load applied to the pulled portion 8B is the load received by the protruding section 420 (the rivet 900) as a reaction force of the load to press the panel 400 by the tip end section 510, and accordingly, there is no need to have a new external force for the pulled portion 8B. Consequently, in the exemplary embodiment, it is sufficient to apply the operation load required for breakage in one location, namely, the pressed portion 8A on the tab 500, and the operation load on the tab 500 is reduced, as compared to the case in which the connecting section exists on the center line CL.

Here, the recessed groove 70 formed on the panel 400 will be studied.

In FIG. 20, the portion of the panel 400 that enters into the can by forming the opening is the region enclosed by the first score line 430. At this time, the region enclosed by the first score line 430 is divided into the pressed portion 8A and the pulled portion 8B (refer to FIG. 22-1) by the second score line 450, which move in the directions opposite to each other, to thereby form the opening. At this time, it is desirable that the moving amount of the pulled portion 8B is small. Therefore, as compared to the case where no recessed groove 70 is provided, the bending stiffness of the pressed portion 8A and the pulled portion 8B is increased in the case where the recessed groove 70 is provided; accordingly, it is desirable to provide the recessed groove 70.

Note that, though description thereof was omitted above, in the exemplary embodiment, as shown in FIGS. 20 and 22-1, the groove 600 (not a groove that encourages breakage like the score line, but a groove that facilitates bending (a groove that is shallower and wider than the score line)) is provided in the region positioned between the right end section 492 of the linear section 430B and the other end section 432 of the U-shaped section 430A (at a basal part of the tongue section).

The groove 600 is formed to head from the side on which the right end section 492 is provided toward the side on which the other end section 432 is provided. Consequently, in the exemplary embodiment, bending of the tongue section is more likely to occur. Note that the groove 600 is not necessarily required and the groove 600 may be omitted. Moreover, the groove 600 is not limited to be linearly formed, but may be formed with curvature.

Note that a mode, in which the groove 600 is extended without providing the linear section 430B, to provide the groove 600 between the one end section 431 and the other end section 432, can be considered. By the way, in this case, breakage of the panel 400, which has proceeded along the first score line 430 up to the one end section 431 and the other end section 432, stops when reaching the one end section 431 and the other end section 432, and accordingly, breakage of the panel 400 is not generated between the one end section 431 and the other end section 432. In such a case, as compared to the case in which the groove 600 is not at all provided, the operation load of the tab 500 is reduced; however, as compared to the case in which the linear section 430B is provided, the operation load of the tab 500 is increased.

Figure 23:
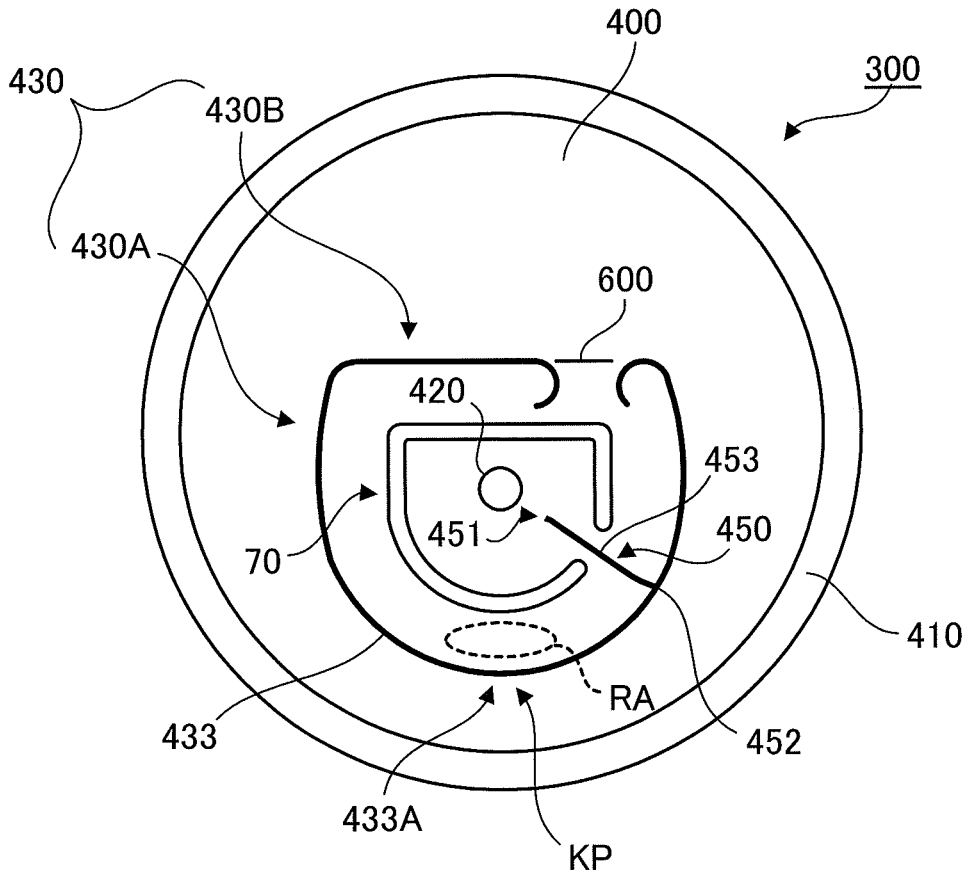
FIG. 23 is a diagram showing another configuration example of the can lid.

Moreover, in the exemplary embodiment, as described above, a case in which the second score line 450 is provided to pass between the region RA and the protruding section 420 has been exemplified; however, the mode of arranging the second score line 450 is not limited to the mode like this. For example, as shown in FIG. 23 (a diagram showing another configuration example of the can lid 300), a second score line 450 that does not pass between the region RA and the protruding section 420 may be provided. Further, the form of the second score line 450 is not particularly limited, too, and the second score line 450 may be provided with curvature.

Figure 24:
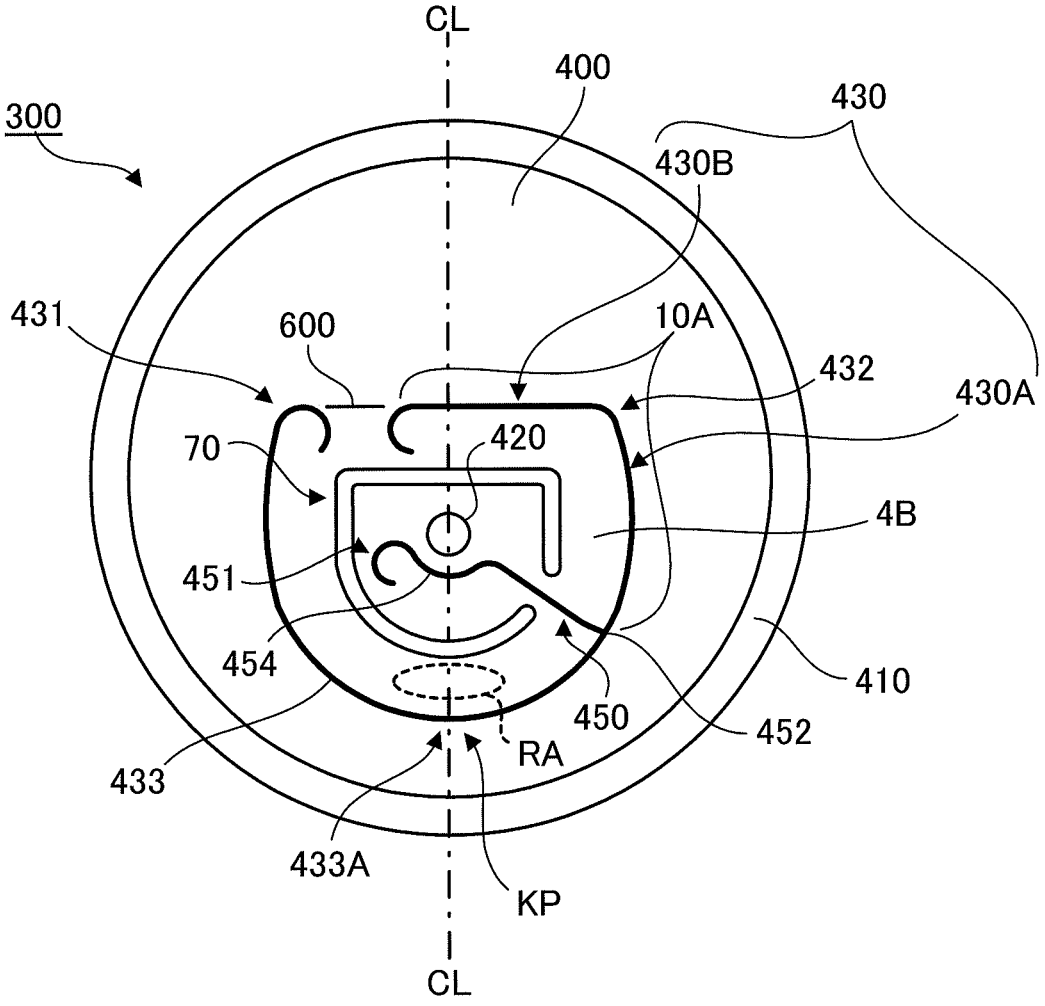
FIG. 24 is a diagram showing still another configuration example of the can lid.

FIG. 24 is a diagram showing still another configuration example of the can lid 300.

In the above-described exemplary embodiment, description has been given by taking a case, in which the linear section 430B is connected to the one end section 431 of the U-shaped section 430A and the linear section 430B is formed to head toward the other end section 432 from the one end section 431 of the U-shaped section 430A, as an example. Incidentally, as shown in FIG. 24, the linear section 430B may be connected to the other end section 432, to thereby form the linear section 430B to head toward the one end section 431 side from the other end section 432. In this case, also, it is possible to reduce the bending region in bending the tongue section, and accordingly, the operation load of the tab 500 is reduced.

Note that, in the above-described mode shown in FIG. 20 or the like, rather than in the mode shown in this figure, movement of the tip end section 510 of the tab 500 in the direction away from the surface of the panel 400 is suppressed, and in the above-described mode shown in FIG. 20 or the like, rather than in the mode shown in this figure, breakage of the panel 400 in the above-described region indicated by the reference sign 8D (refer to FIG. 22-1) is more likely to be generated.

Here, in the exemplary embodiment, as described above, the pulled portion 8B (refer to FIG. 22-1) comes to float from the surface of the panel 400 when the opening is formed; however, in the mode shown in FIG. 24, on that occasion, there is a possibility of occurrence of breakage of the panel 400 in the region indicated by the reference sign 10A, for example, and, in this case, the floating amount of the pulled portion 8B from the panel 400 is extremely increased. Then, in this case, the tip end section 510 of the tab 500 is separated from the panel 400, and therefore, there occurs a possibility that breakage of the panel 400 becomes difficult in the above-described region indicated by the reference sign 8D (refer to FIG. 22-1).

On the other hand, in the above-described mode shown in FIG. 20 or the like, the floating amount of the pulled portion 8B is reduced, and thereby, the tip end section 510 of the tab 500 is positioned at a location closer to the panel 400, as compared to the mode shown in FIG. 24. Then, in this case, as compared to the mode shown in FIG. 24, breakage of the panel 400 in the above-described region indicated by the reference sign 8D is more likely to be generated.

Fourth Exemplary Embodiment

Hereinafter, an exemplary embodiment according to the present invention will be described in detail with reference to attached drawings.

Figure 25A:
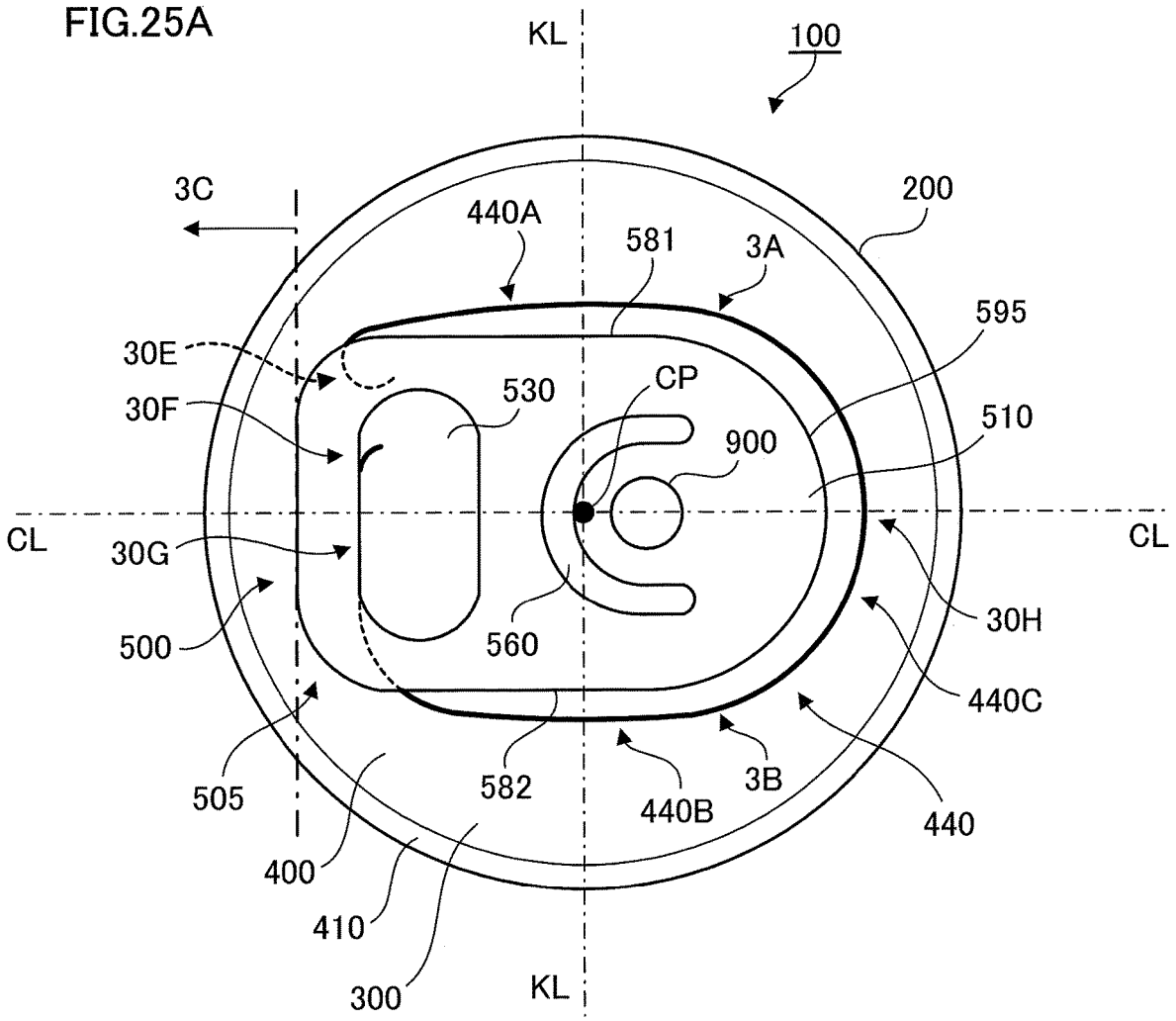
FIGS. 25A and 25B show a top view and a side view of a beverage can to which an exemplary embodiment is applied.
Figure 25B:
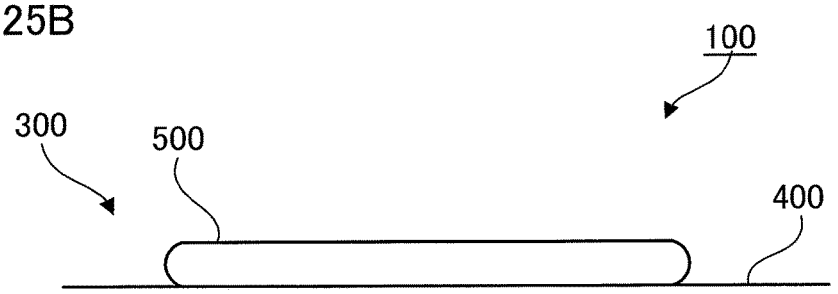

FIG. 25 shows a top view and a side view of a beverage can 100 to which the exemplary embodiment is applied. Note that FIG. 25A is a top view, and FIG. 25B is a side view of an upper portion of the beverage can 100.

As shown in FIG. 25A, the beverage can 100 in the exemplary embodiment includes a container body (can barrel) 200 that is formed in a cylindrical shape and has an opening at an upper portion and a bottom section at a lower portion, and a can lid 300 that is attached to the opening of the container body 200 to block the opening. Note that the beverage can 100 contains a drink, such as a soft drink, a carbonated drink or an alcoholic beverage.

The can lid 300 includes a disk-shaped panel 400 that functions as a substrate and is attached to the container body 200. Moreover, a tab 500 to be operated by an operator is attached to the can lid 300. The tab 500 is operated (lifted up) by the operator at one end portion (in the figure, a left end portion), and thereby the other end portion thereof (a right end portion, a tip end portion) is pressed against a predetermined location of the panel 400 (to be described later), to thereby press the panel 400. Note that, in the present specification, the left end portion of the tab 500 in the figure is referred to as the operated section 505, and the right end portion of the tab 500 in the figure is referred to as the tip end section 510.

The tab 500 is fastened to the panel 400 by a rivet 900 provided at a position deviated from a center portion of the panel 400. To additionally describe, the tab 500 is fastened to the panel 400 by the rivet 900 provided in a decentered state with respect to the panel 400. Further, in the tab 500, a portion positioned between the operated section 505 and the tip end section 510 is fastened to the panel 400 by the rivet 900.

Moreover, in the tab 500, bending processing (curling processing) is applied to an outer peripheral edge of the tab 500, and accordingly, the outer peripheral edge of the tab 500 is in a state of curling into the inside. To additionally describe, at the outer peripheral edge of the tab 500, a curling section is formed. Consequently, in the exemplary embodiment, bending stiffness of the tab 500 is increased.

Further, in the tab 500, a through hole (a finger hole) 530 in which the operator's finger is caught is formed on a side (the operated section 505 side) opposite to the side on which the tip end section 510 is provided. Moreover, in the tab 500, a penetrating section 560 that penetrates through the tab 500 in the thickness direction thereof is provided. In the exemplary embodiment, by providing the penetrating section 560, the operator's finger enters between the tab 500 and the panel 400 with ease when pulling up the tab 500. The penetrating section 560 is formed into the U-shape, to thereby enclose the rivet 900.

Further, in the tab 500, there is provided a first side 581 that is formed along the longitudinal direction of the tab 500 and connects the operated section 505 side and the tip end section 510 side. In addition, on the side opposite to the first side 581, a second side 582 is provided. The second side 582 is, similar to the first side 581, formed along the longitudinal direction of the tab 500, and connects the operated section 505 side and the tip end section 510 side.

Note that, in the exemplary embodiment, a tab 500 in which the tip end section 510 is formed into an arc shape is exemplified; however, the tab 500 can be formed into a rectangular shape, and in this case, the tab 500 includes a linear-shaped tip end section 510.

Figure 26:
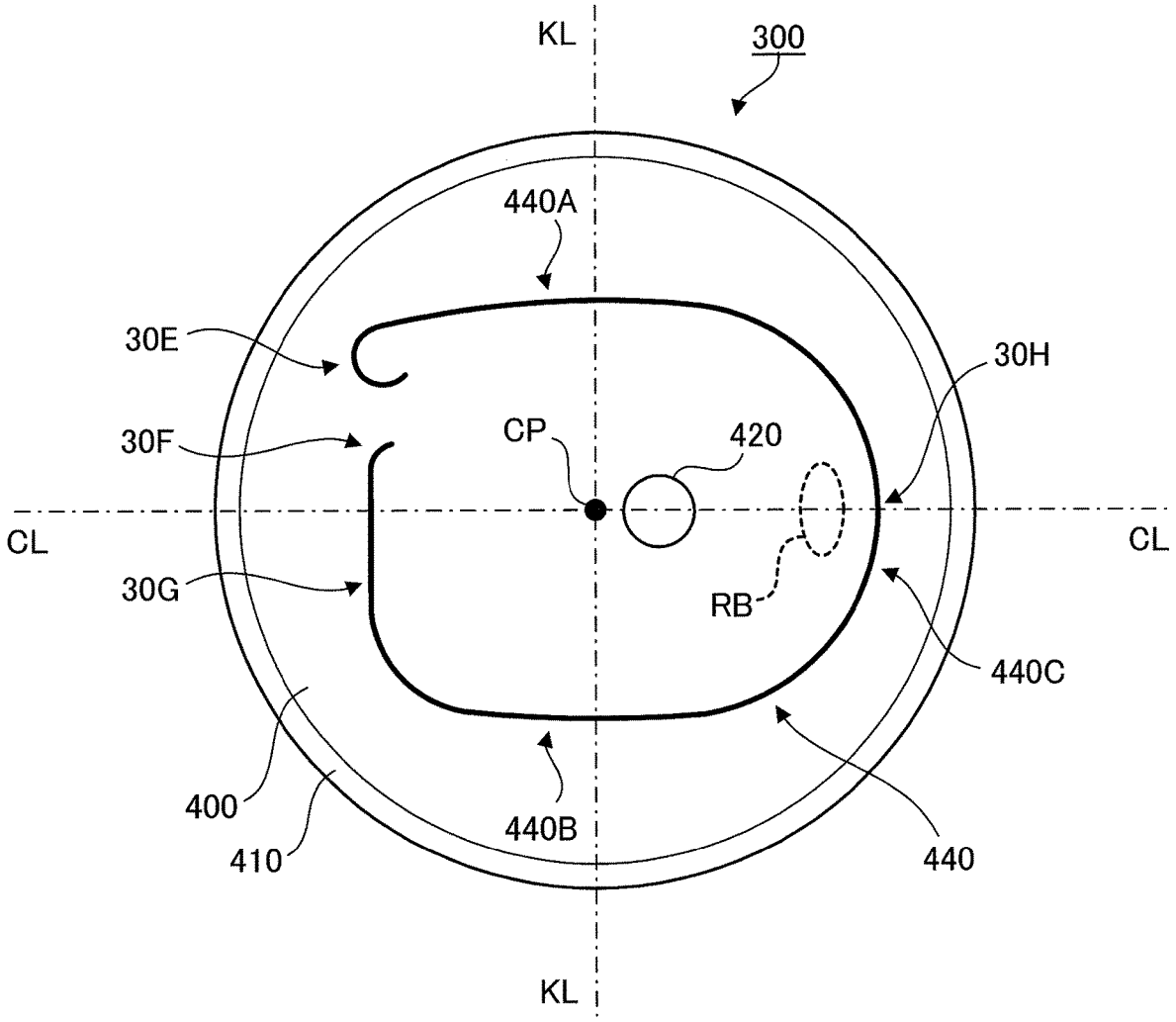
FIG. 26 is a front view showing a can lid before the tab is attached.

FIG. 26 is a front view of the can lid 300 before the tab 500 is attached.

The can lid 300 of the exemplary embodiment includes a panel 400 that is formed into a disk shape. The panel 400 has an outer peripheral edge 410 in which bending processing has applied. In the exemplary embodiment, in a state where the outer peripheral edge 410 and an upper edge section (not shown) of the container body 200 (refer to FIG. 25) are brought into contact with each other, so-called seaming processing is applied to the outer peripheral edge 410 and the upper edge section. This fastens the can lid 300 (the panel 400) to the upper edge section of the container body 200.

Further, in the can lid 300, a protruding section (nipple) 420, which will be crushed when the tab 500 is fastened to the panel 400 to become the above-described rivet 900 (refer to FIG. 25), is formed. The protruding section 420 is provided at a location deviated from the center portion CP of the panel 400. Moreover, on a surface of the panel 400, a score line 440 is formed.

The score line 440 is configured with a groove formed on the surface of the panel 400 and plays a role of inducing breakage of the panel 400 (to be described later). To additionally describe, the score line 440 is able to be grasped as a breakage prediction line on which breakage of the panel 400 is predicted. To describe further, the score line 440 has a role of facilitating breakage of the panel 400, which is caused by being pressed by the tab 500, so as to be generated at a predetermined location of the panel 400.

In the score line 440, there are provided a first portion 440A, a second portion 440B and a third portion 440C.

The first portion 440A is, as shown in FIG. 25, arranged on an upper side than the tab 500 in the figure. Further, the first portion 440A is formed to pass beside one side of the tab 500. More specifically, the first portion 440A is formed to pass beside the first side 581 of the tab 500.

To describe further, the first portion 440A proceeds from right to left in the figure when passing beside the first side 581, and further, includes a trailing end 30E on a downstream side in the proceeding direction. To additionally describe, the first portion 440A proceeds from the tip end section 510 side toward the operated section 505 side of the tab 500 when passing beside the first side 581, and further, includes the trailing end 30E on the downstream side in the proceeding direction.

The second portion 440B is arranged on a lower side than the tab 500 in the figure. Further, the second portion 440B is formed to pass beside the other side of the tab 500. More specifically, the second portion 440B is formed to pass beside the second side 582 of the tab 500. Further, the second portion 440B proceeds from right to left in the figure when passing beside the second side 582, and further, includes a trailing end 30F on a downstream side in the proceeding direction. To additionally describe, the second portion 440B proceeds from the tip end section 510 side toward the operated section 505 side of the tab 500 when passing beside the second side 582, and further, includes the trailing end 30F on the downstream side in the proceeding direction.

Further, the second portion 440B changes the proceeding direction thereof on the way from right to left in the figure, to thereby head toward the trailing end 30E of the first portion 440A in midstream. Consequently, the exemplary embodiment includes a configuration in which the second portion 440B is provided with an approaching section 30G that approaches the trailing end 30E of the first portion 440A.

The trailing end 30E and the trailing end 30F come close to each other in this manner, and thereby the score line 440 is broken to be bent and entered into the inside of the can as an opening piece to form the opening; however, at this time, in a case where the trailing ends 30E and 30F are not close to each other, it becomes difficult to bend and enter the opening piece into the can. Therefore, it is desirable that the trailing ends 30E and 30F come close to each other. Moreover, the second portion 440B has a curvature and changes the proceeding direction thereof in midstream, and is terminated at the trailing end 30F by way of the approaching section 30G. To form a large opening as in the exemplary embodiment, the score line to be broken becomes long; and accordingly, it is desirable to proceed breakage of the score line to the trailing end at a breath. In the exemplary embodiment, breakage of the score line heading toward the trailing end 30F is, without losing the momentum from the second portion 440B by the curvature, continued to the approaching section 30G, to thereby reach the trailing end 30F at a breath.

Note that, in FIG. 26, the second portion 440B is provided with the approaching section 30G, and thereby the second portion 440B has the curvature in midstream and changes the proceeding direction thereof to head toward the first portion 440A; however, not limited to such a mode, the curvature may be imparted to both of the first portion 440A and the second portion 440B. In this case, one of the first portion 440A and the second portion 440B has the curvature and changes the proceeding direction thereof in midstream to head toward the other portion, and the other also has the curvature and changes the proceeding direction thereof in midstream to head toward the one portion. Note that, in this case, in FIG. 26, the trailing end 30E and the trailing end 30F are positioned closer to the center line CL. To additionally describe, in FIG. 26, the trailing ends 30E and 30F are positioned above the center line CL; however, in the case where the curvature is imparted to both of the first portion 440A and the second portion 440B, for example, the trailing end 30E is positioned above the center line CL, whereas the trailing end 30F is positioned below the center line CL.

The third portion 440C is, as shown in FIG. 25, formed to connect the first portion 440A and the second portion 440B. Specifically, the third portion 440C is formed to connect a right end section 3A, in the figure, of the first portion 440A and a right end section 3B, in the figure, of the second portion 440B. To additionally describe, the third portion 440C is formed to connect the first portion 440A and the second portion 440B on the tip end section 510 side of the tab 500.

To describe further, each of the first portion 440A and the second portion 440B includes an end section at each of the operated section 505 side and the tip end section 510 side; however, in the exemplary embodiment, the respective end sections (the right end section 3A and the right end section 3B) on the tip end section 510 side included by the first portion 440A and the second portion 440B are connected by the third portion 440C.

Moreover, the third portion 440C is provided with a curvature, and is formed to swell toward the right side in the figure. Further, the third portion 440C is formed to pass through the outer side than the outer peripheral edge 595 of the tab 500. To describe further, the third portion 440C is formed to pass between the tip end section 510 of the tab 500 and the outer peripheral edge 410 of the panel 400.

Here, in the exemplary embodiment, as shown in FIG. 25, the trailing end 30E of the first portion 440A and the trailing end 30F of the second portion 440B are arranged on one side of two regions facing each other with the virtual line KL, which passes through the center portion CP of the panel 400, being interposed therebetween (in the figure, the region on the left side).

To additionally describe, the trailing ends 30E and 30F are arranged on one side of two regions that face each other with the virtual line KL, which is orthogonal to the center line CL of the tab 500 (the center line CL along the longitudinal direction of the tab 500) and passes through the center portion CP of the panel 400, being interposed therebetween.

Further, the third portion 440C of the exemplary embodiment is formed into a U-shape and swells toward the right direction in the figure, to thereby have a vertex section 30H at the right end in the figure. The vertex section 30 is arranged on the other side (in the figure, the region on the right side) of two regions that face each other with the virtual line KL being interposed therebetween.

To describe further, in the exemplary embodiment, as shown in FIG. 25, the two trailing ends 30E and 30F are positioned at a location where the operated section 505 of the tab 500 is positioned (positioned behind (on the reverse side of) the operated section 505 of the tab 500). To additionally describe, each of the first portion 440A and the second portion 440B proceeds from the tip end section 510 side toward the operated section 510 side of the tab 500, and finally reaches the reverse side of the operated section 505.

Note that, though description has been omitted above, in the exemplary embodiment as shown in FIG. 26, the location indicated by the reference sign RB in the figure (hereinafter, referred to as "pressed location RB"), of the panel 400, is pressed by the tip end section 510 of the tab 500. Here, the pressed location RB is positioned inside the third portion 440C formed into the U-shape. Further, the pressed location RB is positioned in the proximity of the vertex section 30H of the third portion 440C.

Note that, in the exemplary embodiment, as shown in FIG. 26, the trailing end 30E of the first portion 440A and the trailing end 30F of the second portion 440B are curled, and thereby breakage of the panel 400 beyond the trailing ends 30E and 30F is suppressed. In a case where the trailing ends 30E and 30F are not curled like this and are linearly formed, there is a possibility that the panel 400 is broken at some location beyond the trailing ends 30E and 30F, to thereby cause breakage of the panel 400.

Further, in the exemplary embodiment, as shown in FIG. 26, the trailing end 30E of the first portion 440A and the trailing end 30F of the second portion 440B are provided in a state of being separated from each other, and accordingly, there is provided a discontinuous section between the trailing ends 30E and 30F, in which the score line 40 is not formed. By providing the discontinuous section, a later-described tongue section is not separated from the panel 400, and the tongue section is kept in a state of attaching to the panel 400.

Note that, in the exemplary embodiment, as shown in FIG. 26, the center line CL of the tab 500 (also refer to FIG. 25) passes through the center portion CP of the panel 400 and the protruding section 420 formed on the panel 400. Further, though description has been omitted above, in the exemplary embodiment, the trailing end 30E of the first portion 440A and the trailing end 30F of the second portion 440B are positioned in a region on the upper side of the center line CL in the figure.

Figure 27A:
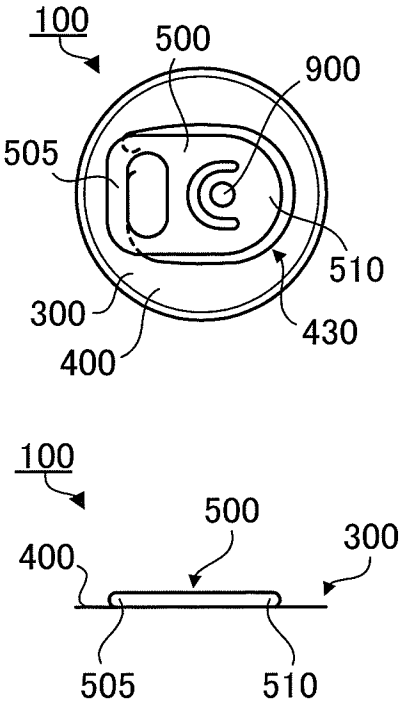
FIGS. 27A to 27C are diagrams showing movement of each component when the tab is operated by an operator.
Figure 27B:
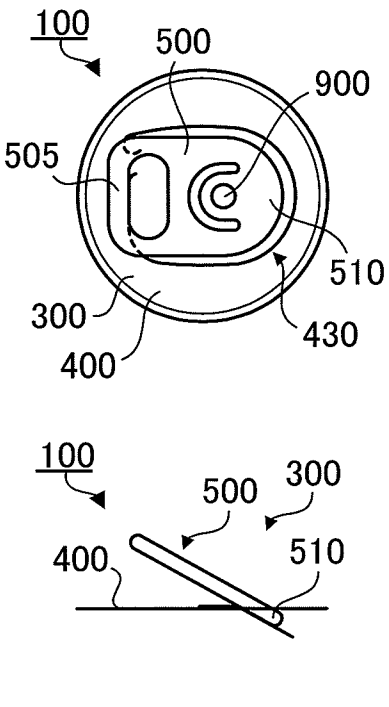
Figure 27C:
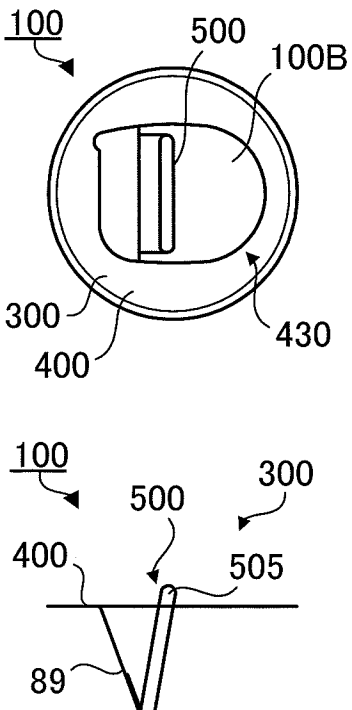

FIGS. 27A to 27C are diagrams showing movement of each component when the tab 500 is operated by the operator. Note that, in each of FIGS. 27A to 27C, a state in the case of viewing the beverage can 100 from above is illustrated on the upper side in the figure, and a case of viewing the state of the upper portion and the inner portion of the beverage can 100 from the lateral side of the beverage can 100 is illustrated on the lower side in the figure.

When the operator operates the tab 500, the operator's finger is inserted between the tab 500 in a lying state (refer to FIG. 27A) and the surface of the panel 400, and the operated section 505 side of the tab 500 is lifted up, to thereby start pulling up of the tab 500.

When pulling up of the tab 500 is started, the tab 500 is rotated around the rivet 900 as a fulcrum point, and the tip end section 510 of the tab 500 presses the panel 400. Specifically, the pressed location RB shown in FIG. 26 is pressed. Consequently, breakage of the panel 400 is started around the place, of the third portion 440C provided to the score line 440 (refer to FIG. 26), where the vertex section 30H is positioned. This makes a portion, of the panel 400, positioned inside the third portion 440C, which is also a portion positioned in the proximity of the vertex section 30H, enter into the inside of the beverage can 100, as shown in FIG. 27B.

Thereafter, pressing the tab 500 into the inside of the beverage can 100 is carried out by the operator. This causes, as shown in FIG. 27C, breakage of the panel 400 in almost all the regions of the score line 440, and thereby a tongue-shaped portion (hereinafter, referred to as "tongue section 89") is formed, and further, the tongue section 89 is pressed into the inside of the beverage can 100 (bent toward the reverse side of the panel 400). Then, when the tongue section 89 is pressed into the inside of the beverage can 100, an opening 100B is formed in the beverage can 100, as shown in FIG. 27C.

Here, in the configuration of the exemplary embodiment, as described above, the first portion 440A and the second portion 440B of the score line 440 are provided to reach the operated section 505 of the tab 500. Therefore, in the exemplary embodiment, the opening 100B to be formed becomes large. To additionally describe, in the exemplary embodiment, the region about half of the panel 400 becomes the opening 100B.

Here, for example, in a case where the diameter of the beverage can 100 is reduced, ordinarily, each of the tab 500 and the opening 100B is reduced, operability of the tab 500 is degraded, and further, the beverage inside becomes difficult to drink. In the exemplary embodiment, even in the case where the diameter of the beverage can 100 is small, reduction of the tab 500 and the opening 100B is suppressed, and thereby the tab 500 is operated with ease, and the beverage inside is drunk with ease. Note that the configuration of the exemplary embodiment can be applied not only to the beverage can 100 with small diameter, but also to existing beverage cans of 350 ml, 500 ml or the like; in this case, the opening 100B can be enlarged as compared to the existing beverage cans.

Enlargement of the opening 100B in the can lid provides the following effects.

First, by enlarging the opening 100B, it becomes possible to drink beverage with no resistance. This does not simply mean that large amount ejection is available by enlarging the opening 100B. For example, in the case where the size of the opening 100B is small, a phenomenon of pulsing ejection, in which ejection of beverage to the outside of the can and replenishment of air into the can are carried out alternately, sometimes occurs. This makes a person who drinks feel difficulty in drinking in some cases. However, by enlarging the opening 100B, a space for intake of air from the outside into the can be secured in a part of the opening 100B, and it becomes possible to eject beverage to the outside of the can at the same time to replenish air into the can. Therefore, it becomes possible for a person who drinks to experience natural drinking as if drinking beverage that runs down.

Moreover, depending on the beverage, there are some cases in which it is important factor to enjoy not only tastes but also flavor. In the case of the exemplary embodiment, since the opening is extended to a tip of a nose when drinking, it is possible to enjoy taste of the beverage with a tongue, and at the same time, enjoy flavor of the beverage in the can with a nose while drinking, and accordingly, with the beverage can, two features of the beverage, the taste and the flavor can be enjoyed at the same time.

Moreover, in the exemplary embodiment, a single motion of pulling up operation of the tab 500 forms the opening 100B, and it is unnecessary to press the tab 500 to be returned. Accordingly, it becomes possible to simplify the operation of the tab 500 required to form the opening 100B. In an existing beverage can, usually, after the tab 500 is pulled up to form an opening, it is necessary to lay down the tab 500 again to return thereof to an original state. On the other hand, in the exemplary embodiment, a single motion of pulling up operation of the tab 500 forms the opening 100B.

Note that, though description has been omitted above, in the exemplary embodiment, when the operation of the tab 500 by the operator is finished (formation of the opening 100B is finished), as shown in FIG. 27C (figure on the loser side), the operated section 505 of the tab 500 protrudes from the surface of the panel 400. Accordingly, the operator's finger is prevented from entering into the inside of the beverage can 100 through the opening 100B, and thereby the finger is prevented from touching the beverage inside. To additionally describe, in the exemplary embodiment, along with bending of the tongue section 89 to the reverse side of the panel 400, the tab 500 positioned on the front surface side of the panel 400 also moves to the reverse side of the panel 400; however, the operated section 505 of the tab 500 does not move to the reverse side of the panel 400, to stay on the front surface side of the panel 400.

Here, in a final stage of the operation of the tab 500, it is assumed that pressing of the tab 500 is carried out by pressing the operated section 505 of the tab 500 by the operator, and on that occasion, if the operated section 505 enters into the inside of the beverage can 100, the finger is likely to enter into the inside of the beverage can 100 together with the operated section 505. As in the exemplary embodiment, if there is provided a configuration in which the operated section 505 of the tab 500 protrudes from the surface of the panel 400, entry of the finger into the inside of the beverage can 100 is less likely to occur. Note that, if the operated section 505 of the tab 500 protrudes from the surface of the panel 400, as compared to the case where the operated section 505 does not protrude, there is a possibility to have difficulty in drinking the beverage inside; however, in the configuration of the exemplary embodiment, the protruding amount is small, and effects thereof is small.

Moreover, as another configuration, the entire tab 500 may enter into the inside of the beverage can 100. In this case, the operator's finger is likely to enter into the inside of the beverage can 100, however, on the other hand, in this case, there is no protrusion of the tab 500 from the panel 400, and accordingly, it becomes easy for the operator to drink the beverage inside.

Note that, in the case where the entire tab 500 enters into the inside of the beverage can 100, in FIG. 25, the trailing ends 30E and 30F are arranged in a region on the left side of the operated section 505 in the figure (in a region indicated by arrow 3C in the figure). To additionally describe, the first portion 440A and the second portion 440B are extended to a location beyond the operated section 505, and at the location beyond, the trailing ends 30E and 30F of the score line 440 are positioned.

Here, in the case of the existing beverage can, the operator pulls up the operated section 505 of the tab 500, presses the tip end section 510 of the tab 500 into the inside of the beverage can 100 to form an opening in the panel 400, and after the tab 500 is returned to the original position, the operator touches the opening with his/her mouth to drink. At this time, a lip or a mustache of the operator touches the tip end section 510 of the tab 500 in some cases, and in a case where edge treatment of the material of the tip end section 510 is insufficient, there is a possibility that the operator feels pain in the mouth or the mustache becomes entangled. However, as in the exemplary embodiment, in the case where the tip end section 510 of the tab 500 enters into the inside of the beverage can 100, the tip end section 510 of the tab 500 is less likely to be touched by the mouth of the operator. Here, in the tip end section 510 of the tab 500, there is a protrusion caused by the manufacturing process of the tab 500, and, in the case where the tip end section 510 of the tab 500 does not enter into the inside of the beverage can 100, the protrusion sometimes touches the mouth of the operator. On the other hand, in the configuration of the exemplary embodiment, the protrusion enters into the inside of the beverage can 100, and accordingly, the protrusion is less likely to touch the mouth of the operator.

Moreover, in the case of the existing beverage can, as described above, the tab 500 is returned to the original position in drinking; however, at this time, peripheral sections of the rivet 900 of the tab 500 are deformed in some cases, and even though the tab 500 is returned to the original position, the tab 500 is separated from the panel 400 due to the above-described deformation, the tab 500 floats from the panel 400, the floating tab 500 touches the tip of the nose when drinking, and therefore, the operator feels bothersome in some cases. On the other hand, in the case of the exemplary embodiment, since the tab 500 is contained inside the beverage can 100, there is nothing on the panel 400 that touches the nose, such as the tab 500, and therefore, it is possible to drink without bothersome feeling on the tip of the nose when drinking.

Figure 28:
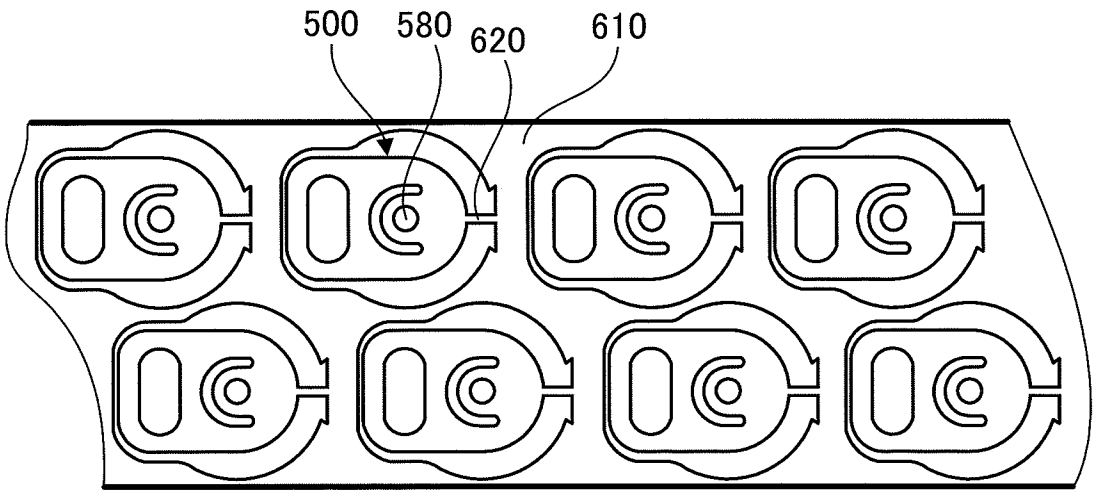
FIG. 28 is a diagram illustrating an example of a manufacturing process of a tab.
Figure 29:
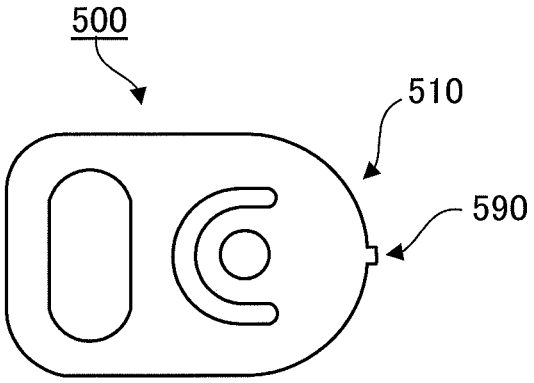
FIG. 29 is a diagram illustrating another example of the manufacturing process of the tab.

FIGS. 28 and 29 are diagrams illustrating an example of the manufacturing process of the tab 500.

In the final stage of the manufacturing process of the tab 500, as shown in FIG. 28, the tab 500 is in a state of being connected to a tab skeleton 610, which will be a frame, via a coupling section 620 referred to as "blanking". Then, when processing of the tab 500 is finished, the protruding section 420 formed on the panel 400 (refer to FIG. 26) is inserted into a through hole 580 formed on the tab 500, and subsequently, the protruding section 420 is crushed. This fastens the tab 500 onto the panel 400. At the same time, a cutting process is carried out at a boundary of the tab 500 and the coupling section 620, and thereby the tab 500 is separated from the tab skeleton 610.

Here, by carrying out the above-described cutting process, part of the coupling section 620 (refer to FIG. 28) is left on the tip end section 510 of the tab 500, as shown in FIG. 29, to thereby form a protrusion 590 on the tip end section 510 of the tab 500. The protrusion 590 is to be bent; however, when the operator drink a beverage, part of the protrusion 590 touches the mouth of the operator only occasionally. On the other hand, as in the exemplary embodiment, in the configuration in which the tab 500 enters into the inside of the beverage can 100, the protrusion 590 enters into the inside of the beverage can 100, and accordingly, the protrusion 590 is less likely to touch the operator's mouth.

To describe further, in an ordinary manufacturing process of the tab 500, there is provided a process of crushing the above-described protrusion 590 by a mold or the like in many cases; however, as in the exemplary embodiment, in the configuration in which the tab 500 enters into the inside of the beverage can 100, there is a possibility that the crushing process can be omitted.

Figure 30A:
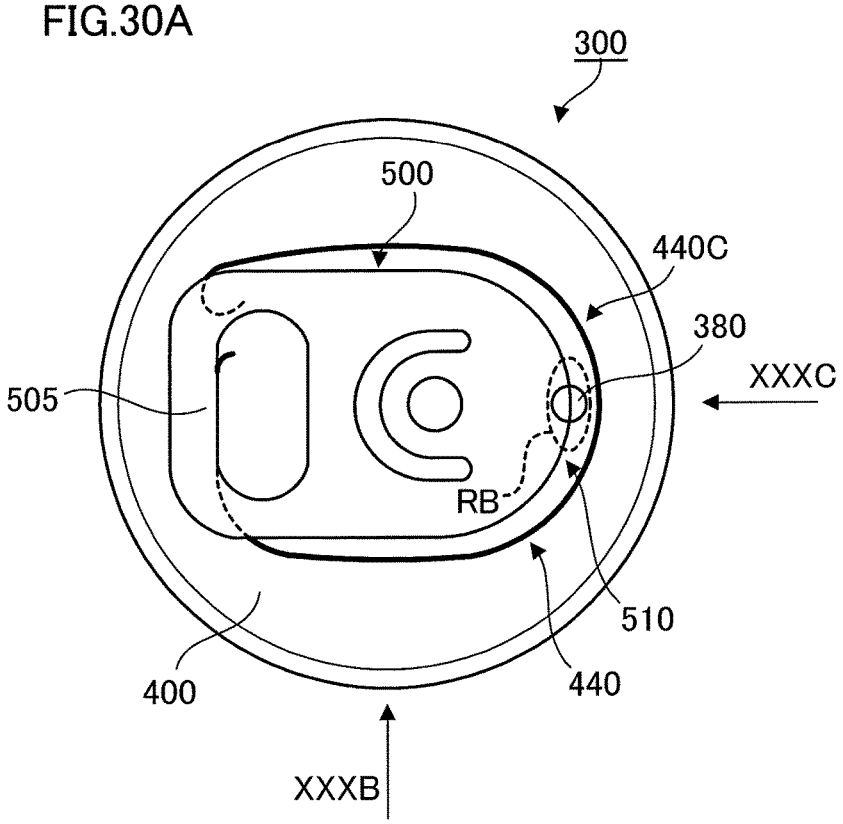
FIG. 30A to 30C are diagrams showing another configuration example of the can lid.
Figure 30C:
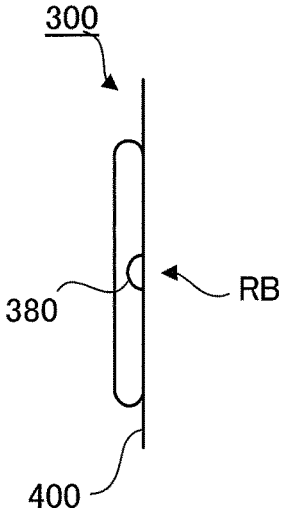
Figure 30B:
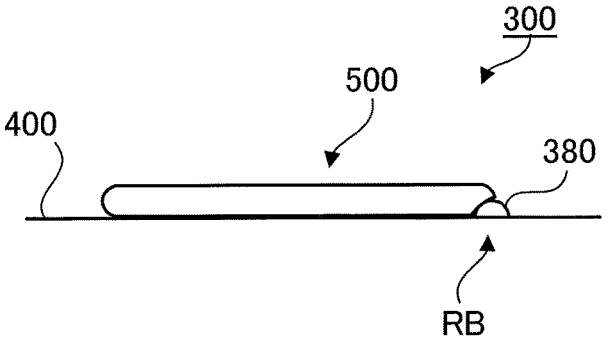

FIG. 30 is a diagram showing still another configuration example of the can lid 300. Note that FIG. 30A is a front view of the can lid 300, FIG. 30B is a diagram showing the can lid 300 as viewed from the direction of arrow XXXB in FIG. 30A, and FIG. 30C is a diagram showing the can lid 300 as viewed from the direction of arrow XXXC in FIG. 30A.

In this configuration example, at the pressed location RB, of the panel 400, to be pressed by the tab 500, a protrusion 380 protruding toward the tab 500 is provided. In this configuration example, when the pressed location RB is pressed by the tab 500, the protrusion 380 is pressed.

Accordingly, as compared to a case where the protrusion 380 is not provided, it becomes possible to apply a load intensively to a narrower region within the third portion 440C of the score line 440. Then, in this case, breakage of the panel 400 in the third portion 440C is more likely to occur.

Figure 31A:
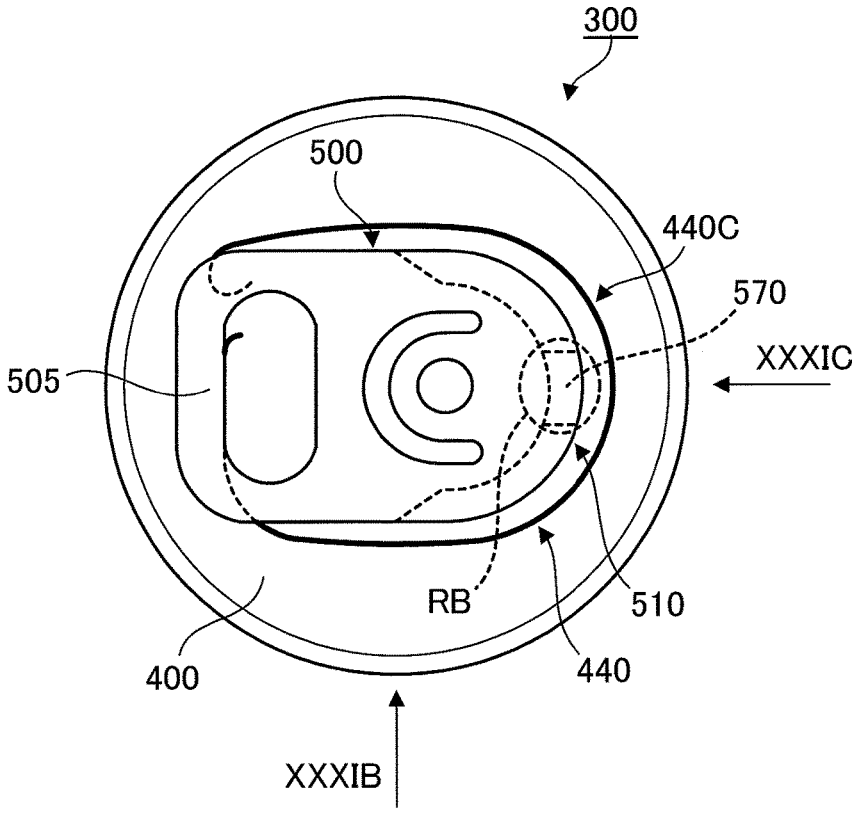
FIG. 31A to 31C are diagrams showing another configuration example of the can lid.
Figure 31C:
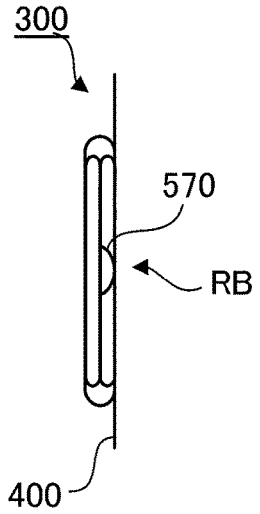
Figure 31B:
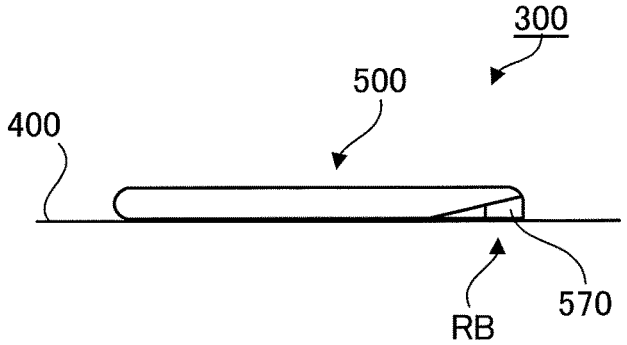

FIG. 31 is a diagram showing still another configuration example of the can lid 300. Note that FIG. 31A is a front view of the can lid 300, FIG. 31B is a diagram showing the can lid 300 as viewed from the direction of arrow XXXIB in FIG. 31A, and FIG. 31C is a diagram showing the can lid 300 as viewed from the direction of arrow XXXIC in FIG. 31A.

In this configuration example, a protrusion 570 is provided to the tip end section 510 of the tab 500. To additionally describe, in this configuration example, the protrusion 570 that protrudes toward the pressed location RB is provided on a side, which faces the panel 400, of the tip end section 510 of the tab 500. In this case, also, as compared to a case where the protrusion 570 is not provided, it becomes possible to apply a load intensively to a narrower region within the third portion 440C of the score line 440, and accordingly, breakage of the panel 400 on the third portion 440C is more likely to occur.

Moreover, though illustration will be omitted, as still another configuration example, the thickness of the portion, of the panel 400, where the third portion 440C is provided (a part where breakage of the panel 400 first occurs) may be smaller than other parts of the panel 400. In this case, also, the breakage of the panel 400 on the third portion 440C of the score line 440 is more likely to be caused.

FIG. 32 is a diagram showing still another configuration example of the can lid 300.

Figure 32A:
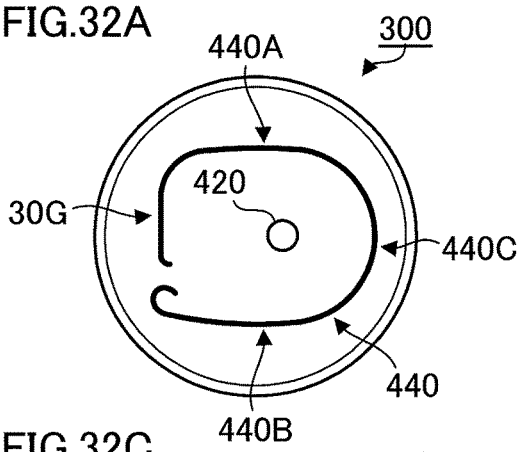
FIG. 32A to 32G are diagrams showing another configuration example of the can lid.

In the above, as shown in FIG. 25, description has been given by taking the configuration example in which the second portion 440B is bent in the middle to head upwardly, to thereby approach the first portion 440A (the configuration example in which the approaching section 30G is provided to the second portion 440B) as an example; however, as shown in FIG. 32A, there may be a configuration in which the first portion 440A is bent in the middle to head downwardly in the figure, and the approaching section 30G is provided to the first portion 440A.

Figure 32B:
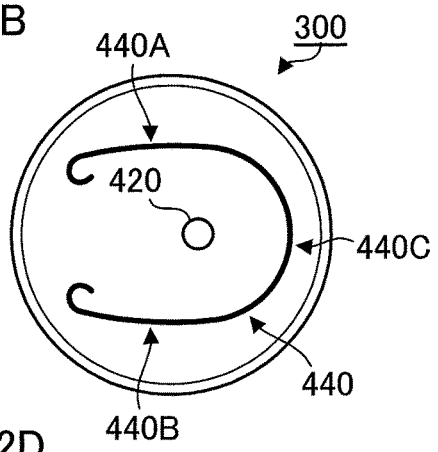

Moreover, as shown in FIG. 32B, it may be possible to omit the approaching section 30G and to form the entire score line 440 into the U-shape.

Figure 32C:
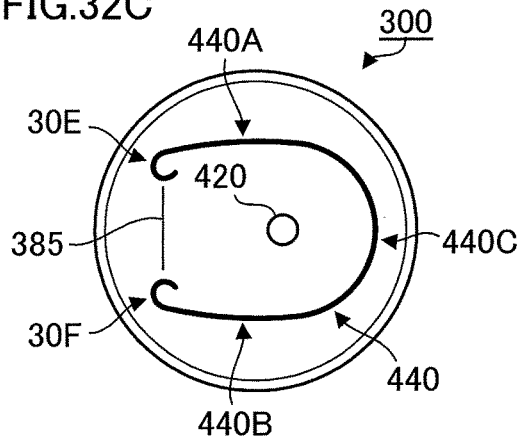

Further, as shown in FIG. 32C, it may be possible to form the entire score line 440 into the U-shape, and to provide a stiffness decreasing section 385 that decreases the stiffness of the panel 400 between the trailing end 30E of the first portion 440A and the trailing end 30F of the second portion 440B. In this case, at the basal part of the tongue section 89 (refer to FIG. 27C), the tongue section 89 becomes likely to be bent. Note that the stiffness decreasing section 385 is configured with, for example, a groove formed on the panel 400.

Figure 32D:
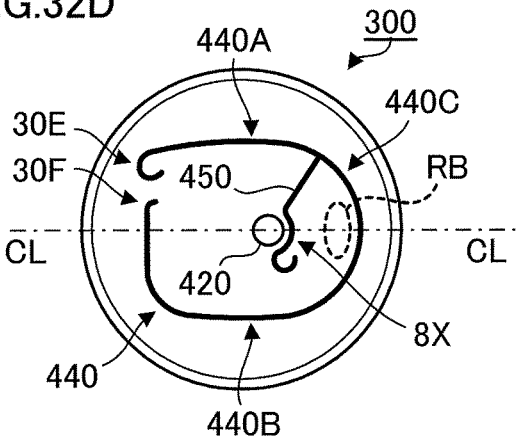

Moreover, as shown in FIG. 32D, in addition to the score line 440, another score line that passes between the protruding section 420 and the pressed location RB may be provided (hereinafter, the score line is referred to as "second score line 450"). The second score line 450 proceeds from the vicinity of the protruding section 420 toward a direction intersecting the direction in which the center line CL of the tab 500 extends, and is connected to the score line 440.

In this configuration example, when the tab 500 is operated, the shearing force acts on the part indicated by the reference sign 8X in the figure, and thereby breakage of the panel 400 is generated at the part where the second score line 450 is provided, which is also between the pressed location RB and the protruding section 420. Thereafter, breakage of the panel 400 proceeds to the connecting section of the score line 440 and the second score line 450. Next, breakage of the panel 400 from the connecting section toward the trailing end 30E of the first portion 440A and breakage of the panel 400 from the connecting section toward the trailing end 30F of the second portion 440B are generated.

Figure 32E:
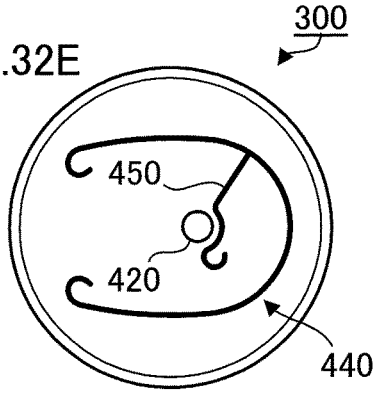

FIG. 32E shows a configuration example in which the second score line 450 is provided, whereas the approaching section 30G is omitted. In this configuration example, the second score line 450 is provided inside the U-shaped score line 440.

Figure 32F:
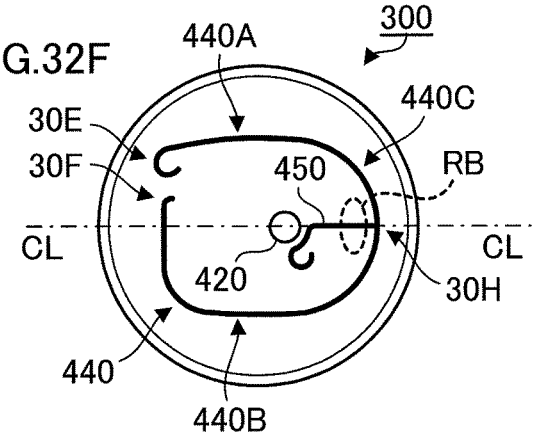
Figure 32G:
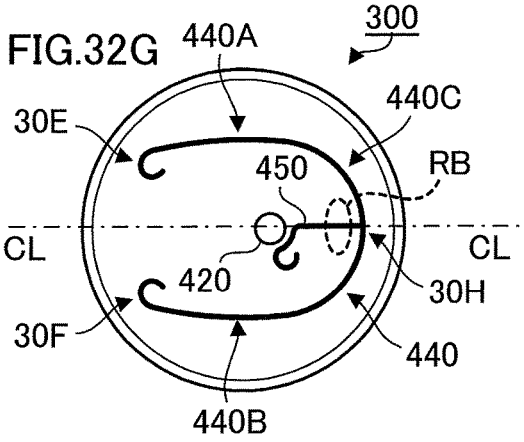

FIG. 32F is a diagram showing a modified example of the configuration shown in FIG. 32D. In addition, FIG. 32G is a diagram showing a modified example of the configuration shown in FIG. 32E. In the configuration examples shown in FIGS. 32F and 32G, the position of arranging the second score line 450 is different.

Specifically, the second score line 450 is arranged along the center line CL of the tab 500. To additionally describe, in these configuration examples, the second score line 450 is formed to head toward the vertex section 30H of the third portion 440C from the vicinity of the protruding section 420. Further, in these configuration examples, the second score line 450 is formed to pass through the pressed location RB.

In the configuration examples shown in FIGS. 32F and 32G, when the pressed location RB is pressed by the tab 500, breakage of the panel 400 is generated at a portion, of the second score line 450, positioned between the pressed location RB and the protruding section 420. Next, the breakage proceeds, along the second score line 450, to the connecting section of the second score line 450 and the score line 440. Subsequently, breakage of the panel 400 heading toward the trailing end 30E of the first portion 440A from the connecting section and breakage of the panel 400 heading toward the trailing end 30F of the second portion 440B from the connecting section are generated.

(Others)

Figure 33:
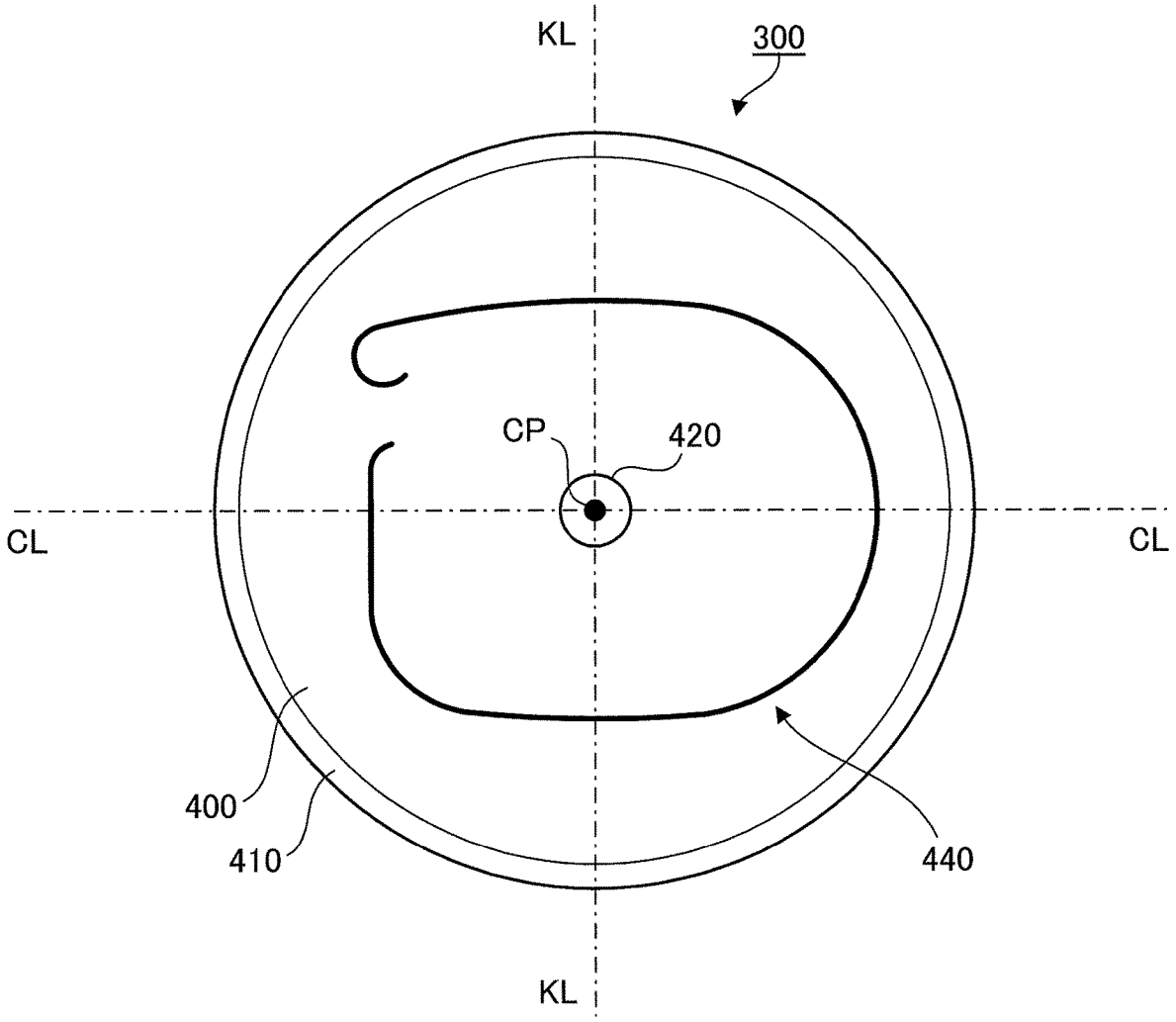
FIG. 33 is a diagram showing another configuration example of the can lid.

In the above, as shown in FIG. 26, the configuration example in which the protruding section 420 (the rivet 900) used to fasten the tab 500 is deviated from the center portion CP of the panel 400 has been described; however, as shown in FIG. 33 (the diagram showing the other configuration example of the can lid 300), the protruding section 420 may be provided to the center portion CP of the panel 400. Note that, except for the position of the protruding section 420, the configuration shown in FIG. 33 has the same configuration as the configuration shown in FIG. 26. Note that, in each of the configuration examples shown in FIG. 32, it is possible to provide the protruding section 420 to the center portion CP of the panel 400 in a similar manner.

Figure 34:
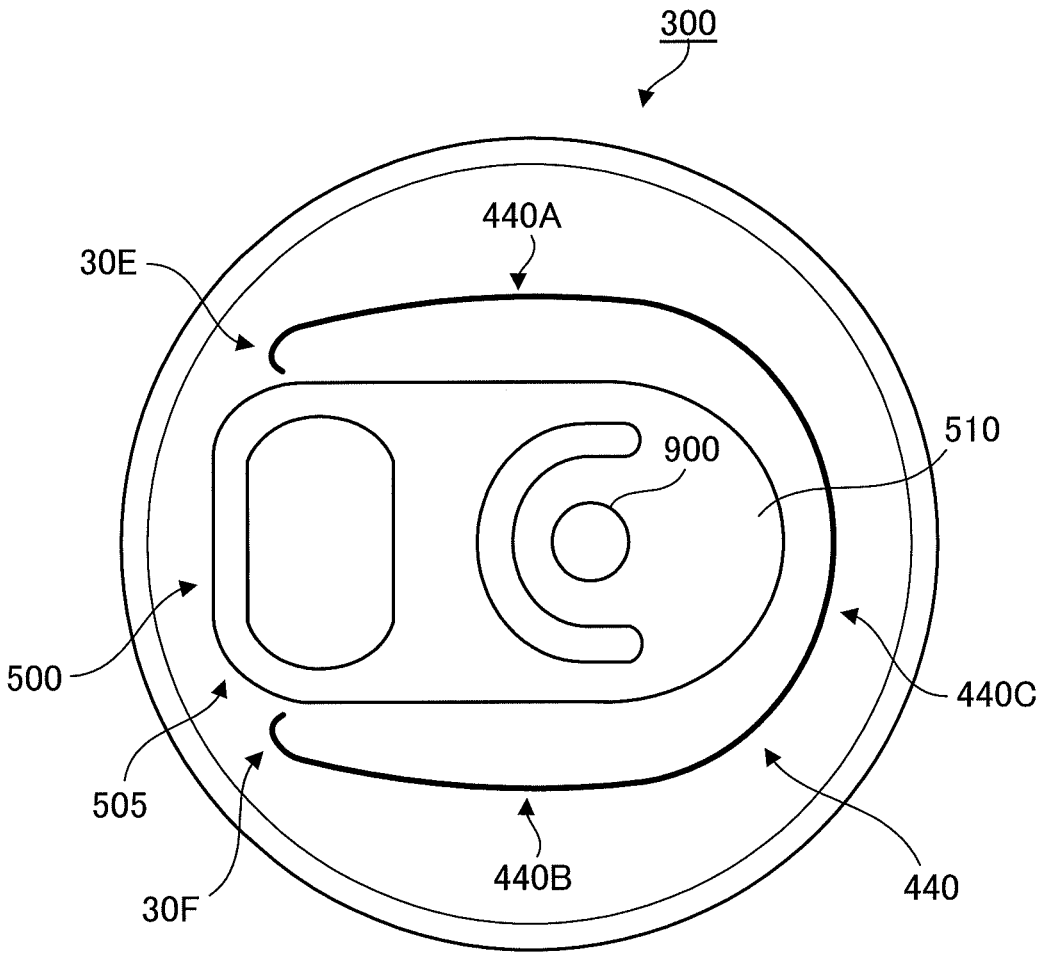
FIG. 34 is a diagram showing another configuration example of the can lid.

Moreover, in the above, as shown in FIG. 25, for example, the configuration in which the trailing end 30E of the first portion 440A and the trailing end 30F of the second portion 440B are positioned at a part positioned on the reverse side of (behind) the operated section 505 of the tab 500 and each of the first portion 440A and the second portion 440B reaches the operated section 505 of the tab 500 has been described; however, as shown in FIG. 34 (the diagram showing the other configuration example of the can lid 300), the configuration may be such that the trailing ends 30E and 30F are positioned beside the operated section 505 of the tab 500, and the first portion 440A and the second portion 440B reach beside the operated section 505 of the tab 500.

Further, the position of the trailing end 30E of the first portion 440A and the position of the trailing end 30F of the second portion 440B may be different. For example, it may be possible that the trailing end 30E of the first portion 440A is arranged on the reverse side of the operated section 505 of the tab 500 and the trailing end 30F of the second portion 440B is, as shown in FIG. 34, arranged beside the operated section 505 of the tab 500. Note that the reverse thereof may be possible, that is, the trailing end 30E of the first portion 440A may be arranged beside the operated section 505 of the tab 500, whereas the trailing end 30F of the second portion 440B may be arranged on the reverse side of the operated section 505 of the tab 500.

Further, for example, it may be possible that any one of the trailing end 30E of the first portion 440A and the trailing end 30F of the second portion 440B is arranged on the reverse side of or beside the operated section 505 of the tab 500, and the other is arranged at a location beyond the operated section 505 of the tab 500 (in FIG. 25, the region indicated by arrow 3C).

REFERENCE SIGNS LIST

70 . . . Recessed groove
71 . . . One end
72 . . . Other end
81 . . . First region
82 . . . Second region
89 . . . Tongue section
100 . . . Beverage can
200 . . . Container body (can barrel)
300 . . . Can lid
380 . . . Protrusion
400 . . . Panel
401 . . . First surface
402 . . . Second surface
410 . . . Outer peripheral edge
420 . . . Protruding section
430 . . . First score line
430A . . . U-shaped section
431 . . . One end section
432 . . . Other end section
433A . . . Vertex section
440 . . . Score line
440A . . . First portion
440B . . . Second portion
450 . . . Second score line
451 . . . One end section
452 . . . Other end section
500 . . . Tab
505 . . . Operated section
510 . . . Tip end section
570 . . . Protrusion
595 . . . Outer peripheral edge
900 . . . Rivet
CP . . . Center portion
RB . . . Pressed location

The invention claimed is:

1. A can lid comprising:

a panel attached to a can barrel, the panel is in the shape of a disk having a center point and a circumference defined by an outer peripheral edge of the panel;

a first score line formed in a U-shape on the panel, the first score line including one end section comprising a first terminating end of the first score line and another end section comprising a second terminating end of the first score line, the first score line defining an inside region enclosed by a concave side of the first score line and a first virtual line, the first virtual line is a straight line extending between the first and second terminating ends of the first score line, and the first score line facilitating breakage of the panel;

a second score line formed on the panel at a position within the inside region, the second score line connected to and extending from the first score line, the second score line having a straight line segment extending inward from the first score line towards a protruding section and a curved segment extending around at least partially around a periphery of the protruding section, and the second score line facilitating breakage of the panel; and a tab connected to the protruding section, the tab configured to press a portion of the panel at a position within the inside region, the tab configured to cause breakage of the panel along the second score line and the first score line, wherein the center point of the panel is within the inside region, wherein at the one end section of the first score line, a curvature that brings the first score line closer to the another end section side of the first score line is imparted, and at the another end section of the first score line, a curvature that brings the first score line closer to the one end section side of the first score line is imparted, and wherein a center line, which is a straight line passing through both the center point and the protruding section, passes through the first score line at two different positions along the first score line, and also passes through the curved segment of the second score line.

2. The can lid according to claim 1, wherein the first score line is formed to be linearly symmetric with respect to the center line of the tab, which extends along a longitudinal direction of the tab, as a symmetrical axis.

3. The can lid according to claim 1, wherein a portion, of the one end section of the first score line, where the curvature is imparted and a portion, of the other end section of the first score line, where the curvature is imparted are positioned behind the tab in a case where the panel is viewed from a side on which the tab is attached.

4. A can lid comprising:

a panel attached to a can barrel, the panel is in the shape of a disk having a center point and a circumference defined by an outer peripheral edge of the panel;

a first score line formed in a U-shape on the panel, the first score line including one end section comprising a first terminating end of the first score line and another end section comprising a second terminating end of the first score line, the first score line defining an inside region enclosed by a concave side of the first score line and a first virtual line, the first virtual line is a straight line extending between the first and second terminating ends of the first score line, and the first score line facilitating breakage of the panel;

a second score line formed on the panel at a position within the inside region, the second score line connected to and extending from the first score line, the second score line having a straight line segment extending inward from the first score line towards a protruding section and a curved segment extending around at least partially around a periphery of the protruding section, and the second score line facilitating breakage of the panel; and a tab connected to the protruding section, the tab configured to press a portion of the panel at a position within the inside region, the tab configured to cause breakage of the panel along the first score line, wherein the center point of the panel is within the inside region, wherein the protruding section is at a position within the inside region, wherein at least at one of the one end section and the another end section of the first score line, a curvature that brings the first score line closer to the other of the one end section and the another end section is imparted, and wherein a center line, which is a straight line passing through both the center point and the protruding section, passes through the first score line at two different positions along the first score line, and also passes through the curved segment of the second score line.

5. The can lid according to claim 4, wherein, also at an other of the one end section and the another end section of the first score line, a curvature that brings the first score line closer to the one of the one end section and the other end section is imparted.

6. A beverage can comprising:

a can barrel containing a beverage; and a can lid attached to the can barrel, wherein the can lid comprises:

a panel attached to the can barrel, the panel is in the shape of a disk having a center point and a circumference defined by an outer peripheral edge of the panel;

a first score line formed into a U-shape on the panel, the first score line including one end section comprising a first terminating end of the first score line and another end section comprising a second terminating end of the first score line, the first score line defining an inside region enclosed by a concave side of the first score line and a first virtual line, the first virtual line is a straight line extending between the first and second terminating ends of the first score line, and the first score line facilitating breakage of the panel;

a second score line formed on the panel at a position within the inside region, the second score line connected to and extending from the first score line, the second score line having a straight line segment extending inward from the first score line towards a protruding section and a curved segment extending around at least partially around a periphery of the protruding section, and the second score line facilitating breakage of the panel; and a tab connected to the protruding section, the tab configured to press a portion of the panel at a position within the inside region, and the tab configured to cause breakage of the panel along the first score line, wherein the center point of the panel is within the inside region, wherein the protruding section is at a position within the inside region, and wherein, at least at one of the one end section and the another end section of the first score line, a curvature that brings the first score line closer to the other of the one end section and the another end section is imparted, and wherein a center line, which is a straight line passing through both the center point and the protruding section, passes through the first score line at two different positions along the first score line, and also passes through the curved segment of the second score line.

7. A can lid comprising:

a panel including an outer peripheral edge, and attached to an aperture of a can barrel, the panel is in the shape of a disk having a center point and a circumference defined by the outer peripheral edge of the panel;

a first score line including a U-shaped portion that has one end section comprising a first terminating end of the first score line and another end section comprising a second terminating end of the first score line, the first score line formed to swell toward the outer peripheral edge side of the panel, the first score line includes a vertex section on the outer peripheral edge side, the first score line defining an inside region enclosed by a concave side of the first score line and a first virtual line, the first virtual line is a straight line extending between the first and second terminating ends of the first score line, and the first score line facilitating breakage of the panel;

a second score line formed on the panel at a position within the inside region, the second score line connected to and extending from the first score line, the second score line having a straight line segment extending inward from the first score line towards a protruding section and a curved segment extending around at least partially around a periphery of the protruding section, and the second score line facilitating breakage of the panel; and a tab connected to the protruding section, the protruding section attached to an attached section positioned within the inside region, arranged along one direction from the vertex section side of the U-shaped portion toward a center portion side of the panel to press the inside of the inside region of the panel, and the tab configured to press a side on which the vertex section is positioned with respect to a second virtual line, which is orthogonal to the one direction and passes through the attached section when pressing, wherein the first score line is further provided with a portion, which is connected to one of the one end section and the another end section of the U-shaped portion, and extends, from a connecting section with the one of the one end section and the another end section as a starting point, toward the other of the one end section and the another end section, wherein the center point of the panel is within the inside region, and wherein a center line, which is a straight line passing through both the center point and the protruding section, passes through the first score line at two different positions along the first score line, and also passes through the curved segment of the second score line.

8. The can lid according to claim 7, wherein the portion, which extends from the one of the one end section and the another end section as the starting point toward the other of the one end section and the another end section, is provided to reach a location beyond a straight line that extends while passing through the vertex section and the attached section.

9. A beverage can comprising:

a can barrel containing a beverage; and a can lid attached to an aperture of the can barrel, wherein the can lid comprises:

a panel including an outer peripheral edge, and attached to the aperture of the can barrel, the panel is in the shape of a disk having a center point and a circumference defined by the outer peripheral edge of the panel;

a first score line formed in a U-shape on the panel, the first score line has one end section comprising a first terminating end of the first score line and another end section comprising a second terminating end of the first score line, the first score line formed to swell toward the outer peripheral edge side and includes a vertex section on the outer peripheral edge side, and the first score line facilitating breakage of the panel;

a tab connected to a protruding section, the protruding section attached to an attached section positioned within an inside region of the panel enclosed by the U-shaped portion, arranged along one direction from the vertex section side of the U-shaped portion toward a center portion side of the panel to press the inside of the inside region of the panel, and pressing a side on which the vertex section is positioned with respect to a virtual line, which is orthogonal to the one direction and passes through the attached section when pressing; and a second score line formed on the panel at a position within the inside region, the second score line connected to and extending from the first score line, the second score line having a straight line segment extending inward from the first score line towards the protruding section and a curved segment extending around at least partially around a periphery of the protruding section, and the second score line facilitating breakage of the panel, wherein the center point of the panel is within the inside region, and wherein the first score line is further provided with a portion, which is connected to one of the one end section and the another end section of the U-shaped portion, and extends, from a connecting section with the one of the one end section and the another end section as a starting point, toward the other of the one end section and the another end section.

10. A can lid comprising:

a panel attached to an aperture of a can barrel, the panel is in the shape of a disk having a center point and a circumference defined by an outer peripheral edge of the panel;

a tab including one end section and another end section, a portion of the tab is positioned between the one end section and the another end section being fastened to the panel by a rivet, and the tab is configured to press a predetermined pressed location of the panel with the another end section;

a first score line formed on the panel, the first score line including a first portion that passes one side of the tab to head toward the one end section side of the tab, a second portion that passes the another end section side of the tab to head toward the one end section side of the tab, and a third portion that is formed to connect the first portion and the second portion and passes outside of an outer peripheral edge of the tab on the other end section side of the tab; and a second score line formed on the panel, the second score line connected to and extending from the first score line, the second score line having a straight line segment extending inward from the first score line towards the rivet and a curved segment extending around at least partially around a periphery of the rivet, and the second score line facilitating breakage of the panel, wherein each of the first portion and the second portion heading toward the one end section side is formed to reach any of a location beyond the one end section, a location where the one end section is positioned, and a location positioned beside the one end section, wherein the first score line defines an inside region enclosed by a concave side of the first score line and a virtual line, and the first virtual line is straight line extending between terminating ends of the first score line, wherein the center point of the panel is at a position within the inside region, and wherein the rivet is at a position within the inside region.

11. The can lid according to claim 10, wherein one of the first portion and the second portion is formed to have a curvature and to change a proceeding direction thereof to head toward the other of the portions, or, one of the first portion and the second portion is formed to have a curvature and to change a proceeding direction thereof to head toward the other of the portions, and the other of the portions is also formed to have a curvature and to change a proceeding direction thereof to head toward the one of the portions.

12. The can lid according to claim 10, wherein the tab is attached to, of one surface and the other surface of the panel, the one surface side, due to breakage of the panel on the first score line, a tongue-shaped portion that is configured with part of the panel and formed into a tongue-shape is generated, the tongue-shaped portion is bent toward the other surface side of the panel by an operation of the tab by an operator, and the tab is moved with the tongue-shaped portion to the other surface side of the panel.

13. The can lid according to claim 12, wherein, in a state in which the tab has been moved to the other surface side of the panel, the one end section of the tab is not positioned on the other surface side, but is positioned on the one surface side.

14. The can lid according to claim 10, wherein, at the predetermined pressed location of the panel, a protrusion that protrudes toward the tab side is provided.

15. The can lid according to claim 10, wherein, at the other end section of the tab, a protrusion that protrudes toward the panel side is provided.

16. The can lid according to claim 10, wherein a location, of the panel, where the third portion of the first score line is provided has a thickness smaller than thicknesses of the other locations of the panel.

17. The can lid according to claim 10, wherein the second score line passes between the predetermined pressed location of the panel and the rivet.

18. A beverage can comprising:

a can barrel containing a beverage; and a can lid attached to an aperture of the can barrel, wherein the can lid comprises:

a panel attached to the aperture of the can barrel, the panel is in the shape of a disk having a center point and a circumference defined by an outer peripheral edge of the panel;

a tab including one end section and another end section, a portion of which positioned between the one end section and the another end section being fastened to the panel by a rivet, the tab configured to press a predetermined pressed location of the panel with the other end section, and the tab connected to a protruding section of the panel;

a first score line formed on the panel, which includes a first portion that passes one side of the tab to head toward the one end section side of the tab, a second portion that passes the other side of the tab to head toward the one end section side of the tab, and a third portion that is formed to connect the first portion and the second portion and passes outside of an outer peripheral edge of the tab on the other end section side of the tab; and a second score line formed on the panel, the second score line connected to and extending, from the first score line, the second score line having a straight line segment extending inward from the first score line towards the protruding section and a curved segment extending around at least partially around a periphery of the protruding section, and the second score line facilitating breakage of the panel, wherein each of the first portion and the second portion heading toward the one end section side is formed to reach any of a location beyond the one end section, a location where the one end section is positioned, and a location positioned beside the one end section, wherein the first score line defines an inside region enclosed by a concave side of the first score line and a virtual line, and the first virtual line is a straight line extending between terminating ends of the first score line, wherein a center point of the panel is at a position within the inside region, wherein the protruding section is at a position within the inside region, and wherein a center line, which is a straight line passing through both the center point and the protruding section, passes through the first score line at two different positions along the first score line, and also passes through the curved segment of the second score line.

19. The beverage can according to claim 18, wherein, due to breakage of the panel on the first score line, a tongue-shaped portion that is configured with part of the panel and formed into a tongue-shape is generated, the tongue-shaped portion enters into an inside of the beverage can by an operation of the tab by an operator, and the tab is moved with the tongue-shaped portion and enters into the inside of the beverage can.

20. The beverage can according to claim 19, wherein, in a state in which the tab has entered into the inside of the beverage can, the one end section of the tab does not enter into the inside of the beverage can, but is positioned outside the beverage can.

* * * * *